US008672368B2

(12) United States Patent
Grosdemouge

(10) Patent No.: US 8,672,368 B2
(45) Date of Patent: Mar. 18, 2014

(54) ELECTROMECHANICAL COMPRESSION LATCH

(75) Inventor: Thibaut Bernard Paul Grosdemouge, Cheltenham (GB)

(73) Assignee: Southco, Inc., Concordville, PA (US)

( * ) Notice: Subject to any disclaimer, the term of this patent is extended or adjusted under 35 U.S.C. 154(b) by 337 days.

(21) Appl. No.: 13/049,875

(22) Filed: Mar. 16, 2011

(65) Prior Publication Data

US 2011/0227351 A1 Sep. 22, 2011

Related U.S. Application Data

(60) Provisional application No. 61/314,156, filed on Mar. 16, 2010.

(51) Int. Cl.
*E05C 3/06* (2006.01)
*E05C 3/00* (2006.01)

(52) U.S. Cl.
USPC ..... 292/201; 292/216; 292/280

(58) Field of Classification Search
USPC ..... 292/201, 216, 280
See application file for complete search history.

(56) References Cited

U.S. PATENT DOCUMENTS

| | | | | |
|---|---|---|---|---|
| 2,736,186 | A | | 2/1956 | Marple |
| 2,898,138 | A | | 8/1959 | Van Noord |
| 2,916,319 | A | | 12/1959 | Du Bois |
| 2,943,880 | A | | 7/1960 | Joachim et al. |
| 3,262,725 | A | | 7/1966 | Ballantyne |
| 3,332,713 | A | | 7/1967 | De Claire et al. |
| 3,378,289 | A | | 4/1968 | Beckman et al. |
| 3,378,291 | A | | 4/1968 | Brian |
| 3,386,761 | A | | 6/1968 | Johnstone et al. |
| 3,844,593 | A | | 10/1974 | Slattery |
| 3,961,504 | A | | 6/1976 | Sprecher |
| 4,135,377 | A | | 1/1979 | Kleefeldt et al. |
| 4,262,830 | A | | 4/1981 | Haves |
| 4,374,320 | A | | 2/1983 | Barnett |
| 4,492,395 | A | | 1/1985 | Yamada |
| 4,518,180 | A | | 5/1985 | Kleefeldt et al. |
| 4,518,181 | A | | 5/1985 | Yamada |
| 4,538,845 | A | | 9/1985 | Yamada |
| 4,544,189 | A | | 10/1985 | Fiordellisi et al. |
| 4,569,544 | A | | 2/1986 | Escaravage |
| 4,575,138 | A | | 3/1986 | Nakamura et al. |
| 4,597,598 | A | | 7/1986 | Bascou |
| 4,664,430 | A | * | 5/1987 | Bernard ..... 292/201 |
| 4,667,991 | A | | 5/1987 | Pébre |

(Continued)

FOREIGN PATENT DOCUMENTS

| | | |
|---|---|---|
| DE | 1505721 | 7/1970 |
| DE | 3333746 | 6/1985 |

(Continued)

*Primary Examiner* — Carlos Lugo
(74) *Attorney, Agent, or Firm* — Paul & Paul

(57) ABSTRACT

The present invention is directed to improvements in latch design. The illustrated embodiment of the present invention is a rotary pawl latch with the capability to provide a compressive force between the first member and the second member. The illustrated embodiment of the present invention is of an electromechanical type. The control circuit of the latch detects when a striker attached to one member, for example a door, has moved the pawl to a first latched position. A motor is then activated that drives the pawl to a second latched position to provide compression between the first member and a second member, for example a door frame.

30 Claims, 76 Drawing Sheets

(56) References Cited

U.S. PATENT DOCUMENTS

| | | | | |
|---|---|---|---|---|
| 4,671,548 | A | 6/1987 | Häberle et al. | |
| 4,703,960 | A | 11/1987 | Lense | |
| 4,707,007 | A | 11/1987 | Inoh | |
| 4,739,585 | A | 4/1988 | Pickles | |
| 4,746,153 | A | 5/1988 | Compeau et al. | |
| 4,763,936 | A | 8/1988 | Rogakos et al. | |
| 4,796,932 | A | 1/1989 | Tame | |
| 4,806,712 | A * | 2/1989 | Hoffman et al. | 200/61.62 |
| 4,848,809 | A | 7/1989 | Escaravage | |
| 4,851,742 | A | 7/1989 | Chapman | |
| 4,861,089 | A | 8/1989 | Compeau et al. | |
| 4,875,723 | A | 10/1989 | Compeau et al. | |
| 4,889,371 | A | 12/1989 | Girard et al. | |
| 4,892,340 | A | 1/1990 | Matumoto | |
| 4,896,906 | A | 1/1990 | Weinerman et al. | |
| 4,906,035 | A | 3/1990 | Nagai et al. | |
| 4,927,196 | A | 5/1990 | Girard et al. | |
| 4,968,073 | A | 11/1990 | Kuhlman | |
| 4,969,672 | A | 11/1990 | Childs et al. | |
| 4,974,885 | A | 12/1990 | Yokoyama | |
| 4,976,477 | A | 12/1990 | Nakao | |
| 4,976,478 | A | 12/1990 | Acciacca et al. | |
| 4,982,984 | A | 1/1991 | Yokota et al. | |
| 4,998,049 | A | 3/1991 | Chapman | |
| 5,007,261 | A | 4/1991 | Quantz | |
| 5,020,838 | A | 6/1991 | Fukumoto | |
| 5,033,789 | A | 7/1991 | Hayashi et al. | |
| 5,069,491 | A | 12/1991 | Weinerman et al. | |
| 5,163,723 | A | 11/1992 | Rückert | |
| 5,172,947 | A | 12/1992 | Schap | |
| 5,180,198 | A | 1/1993 | Nakamura et al. | |
| 5,222,775 | A | 6/1993 | Kato | |
| 5,232,253 | A | 8/1993 | Tamiya | |
| 5,273,325 | A | 12/1993 | Zimmermann | |
| 5,299,844 | A | 4/1994 | Gleason | |
| 5,411,302 | A | 5/1995 | Shimada | |
| 5,429,400 | A | 7/1995 | Kawaguchi et al. | |
| 5,439,260 | A | 8/1995 | Weinerman et al. | |
| 5,443,292 | A | 8/1995 | Shimada et al. | |
| 5,445,326 | A | 8/1995 | Ferro et al. | |
| 5,498,040 | A | 3/1996 | Silye | |
| 5,549,337 | A | 8/1996 | McCulloch | |
| 5,564,295 | A | 10/1996 | Weinerman et al. | |
| 5,586,458 | A | 12/1996 | Weinerman et al. | |
| 5,595,409 | A | 1/1997 | Fier et al. | |
| 5,611,224 | A | 3/1997 | Weinerman et al. | |
| 5,620,226 | A | 4/1997 | Sautter, Jr. | |
| 5,632,515 | A | 5/1997 | Dowling | |
| 5,634,677 | A | 6/1997 | Büscher et al. | |
| 5,639,130 | A | 6/1997 | Rogers, Jr. et al. | |
| 5,642,636 | A | 7/1997 | Mitsui | |
| 5,765,884 | A | 6/1998 | Armbruster | |
| 5,769,468 | A | 6/1998 | Armbruster | |
| 5,816,628 | A | 10/1998 | Götzen et al. | |
| 5,868,444 | A | 2/1999 | Brackmann et al. | |
| 5,884,948 | A | 3/1999 | Weinerman et al. | |
| 5,909,918 | A | 6/1999 | Kowalewski et al. | |
| 5,931,290 | A | 8/1999 | Wehrli, III et al. | |
| 5,934,717 | A | 8/1999 | Wirths et al. | |
| 5,961,163 | A | 10/1999 | Brackmann et al. | |
| 5,992,194 | A | 11/1999 | Baukholt et al. | |
| 5,997,054 | A | 12/1999 | Baudu et al. | |
| 6,053,543 | A | 4/2000 | Arabia, Jr. et al. | |
| 6,059,327 | A | 5/2000 | Yoshikuwa | |
| 6,067,869 | A | 5/2000 | Chilla et al. | |
| 6,076,868 | A | 6/2000 | Roger, Jr. et al. | |
| 6,113,161 | A | 9/2000 | Jung et al. | |
| 6,116,664 | A | 9/2000 | Wegner | |
| 6,139,073 | A | 10/2000 | Heffner et al. | |
| 6,158,786 | A | 12/2000 | Droste et al. | |
| 6,176,528 | B1 | 1/2001 | Taga | |
| 6,216,980 | B1 | 4/2001 | Baudu et al. | |
| 6,223,468 | B1 | 5/2001 | Kobayashi | |
| 6,338,508 | B1 | 1/2002 | Kleefeldt | |
| 6,341,807 | B2 | 1/2002 | Cetnar et al. | |
| 6,386,599 | B1 | 5/2002 | Chevalier | |
| 6,394,511 | B1 | 5/2002 | Lam et al. | |
| 6,419,286 | B1 | 7/2002 | Szablewski | |
| 6,422,615 | B1 | 7/2002 | Roos et al. | |
| 6,427,505 | B2 | 8/2002 | Ocana | |
| 6,471,260 | B1 | 10/2002 | Weinerman et al. | |
| 6,505,867 | B1 | 1/2003 | Szablewski et al. | |
| 6,510,656 | B1 | 1/2003 | Fukumoto et al. | |
| 6,511,107 | B2 | 1/2003 | Barczynski et al. | |
| 6,557,911 | B2 * | 5/2003 | Nelsen et al. | 292/216 |
| 6,575,507 | B2 | 6/2003 | Reddmann | |
| 6,648,379 | B1 | 11/2003 | Kordowski et al. | |
| 6,651,467 | B1 | 11/2003 | Weinerman et al. | |
| 6,659,515 | B2 * | 12/2003 | Raymond et al. | 292/201 |
| 6,666,482 | B2 | 12/2003 | Hansen et al. | |
| 6,712,407 | B2 | 3/2004 | Duriez | |
| 6,719,333 | B2 | 4/2004 | Rice et al. | |
| 6,776,442 | B2 | 8/2004 | Edgar | |
| 6,832,793 | B2 | 12/2004 | Bingle et al. | |
| 6,848,727 | B1 * | 2/2005 | Cetnar et al. | 292/201 |
| 6,863,317 | B2 | 3/2005 | Alton et al. | |
| 6,863,318 | B2 | 3/2005 | Mejean et al. | |
| 6,886,869 | B2 | 5/2005 | Martinez et al. | |
| 6,948,745 | B2 | 9/2005 | Chevalier | |
| 6,971,967 | B2 | 12/2005 | Whitmarsh | |
| 6,988,749 | B2 | 1/2006 | Hashiba et al. | |
| 6,997,488 | B2 | 2/2006 | Kurten et al. | |
| 7,029,040 | B2 | 4/2006 | Lippoldt et al. | |
| 7,032,938 | B2 | 4/2006 | Kachouh | |
| 7,036,853 | B2 | 5/2006 | Smock et al. | |
| 7,040,673 | B2 | 5/2006 | Smock et al. | |
| 7,089,948 | B2 | 8/2006 | DeBoer et al. | |
| 7,128,361 | B2 | 10/2006 | Guillez et al. | |
| 7,152,890 | B2 * | 12/2006 | Torkowski et al. | 292/216 |
| 7,156,430 | B2 | 1/2007 | Hidding et al. | |
| 7,261,334 | B2 * | 8/2007 | Oberheide et al. | 292/201 |
| 7,296,830 | B2 | 11/2007 | Koveal et al. | |
| 7,455,335 | B2 | 11/2008 | Garneau et al. | |
| 7,726,707 | B2 | 6/2010 | Simchayoff et al. | |
| 7,766,397 | B2 | 8/2010 | Carabalona | |
| 7,823,936 | B2 * | 11/2010 | Compeau | 292/201 |
| 2001/0024041 | A1 | 9/2001 | Barczynski et al. | |
| 2001/0052705 | A1 | 12/2001 | Fisher | |
| 2003/0111863 | A1 | 6/2003 | Weyerstall et al. | |
| 2005/0200137 | A1 | 9/2005 | Nelsen et al. | |
| 2006/0267349 | A1 | 11/2006 | Garneau et al. | |
| 2008/0169657 | A1 | 7/2008 | Horton et al. | |
| 2008/0231060 | A1 | 9/2008 | Carabalona et al. | |
| 2008/0252083 | A1 | 10/2008 | Carabalona | |
| 2008/0265588 | A1 | 10/2008 | Carabalona | |
| 2009/0001733 | A1 | 1/2009 | Garneau et al. | |
| 2009/0058102 | A1 | 3/2009 | Garneau et al. | |
| 2009/0235767 | A1 | 9/2009 | Garneau et al. | |

FOREIGN PATENT DOCUMENTS

| | | | |
|---|---|---|---|
| DE | 10009370 | | 9/2001 |
| EP | 0408951 | | 1/1991 |
| FR | 2807778 | A1 | 10/2001 |
| FR | 2860023 | | 3/2005 |
| WO | 0236907 | A2 | 5/2002 |
| WO | 2005008000 | A2 | 1/2005 |
| WO | 2005008000 | A3 | 1/2005 |

* cited by examiner 204
206
254
290
233
286
207
52
218
205
214
216
215
210

204
206
254
290
233
318
286
207
52
218
205
214
216
210
215

233
254
290
206
204
205
52
207
286
218
216
214
210

ELECTROMECHANICAL COMPRESSION LATCH

BACKGROUND OF THE INVENTION

1. Field of the Invention

The present invention relates to a latch for releasably securing a first member, such as a door, panel or the like, relative to a second member.

2. Description of the Prior Art

Latches are used to releasably secure panels, covers, doors, electronic modules, and the like to other structures such as compartments, cabinets, containers, doorframes, other panels, frames, racks, etc. Although many latch designs are known in the art, none offers the advantages of the present invention. The advantages of the present invention will be apparent from the attached detailed description and drawings.

SUMMARY OF THE INVENTION

The present invention is directed to improvements in latch design. The illustrated embodiment of the present invention is a rotary pawl latch with the capability to provide a compressive force between the first member and the second member. The illustrated embodiment of the present invention is of an electromechanical type. The control circuit of the latch detects when a striker attached to one member, for example a door, has moved the pawl to a first latched position. A motor is then activated that drives the pawl to a second latched position to provide compression between the first member and a second member, for example a door frame.

It is an object of the present invention to provide an electromechanical latch that provides compression between two members.

It is another object of the present invention to provide an electromechanical latch that can reverse operation to open.

It is yet another object of the present invention to provide an electromechanical latch that can detect obstructions and reverse operation.

It is yet another object of the present invention to provide an electromechanical latch that can detect premature movement of the pawl to a fully latched position and reverse operation.

It is yet another object of the present invention to provide an electromechanical latch that continues to provide a latching function in the event of power failure.

It is yet another object of the present invention to provide an electromechanical latch that permits manual opening in the event of power failure.

These and other objects of the invention will become apparent from the attached description, drawings, and claims.

BRIEF DESCRIPTION OF THE DRAWINGS

The same reference numbers are used consistently throughout the several views.

DETAILED DESCRIPTION OF THE PREFERRED EMBODIMENTS

Figure 1:
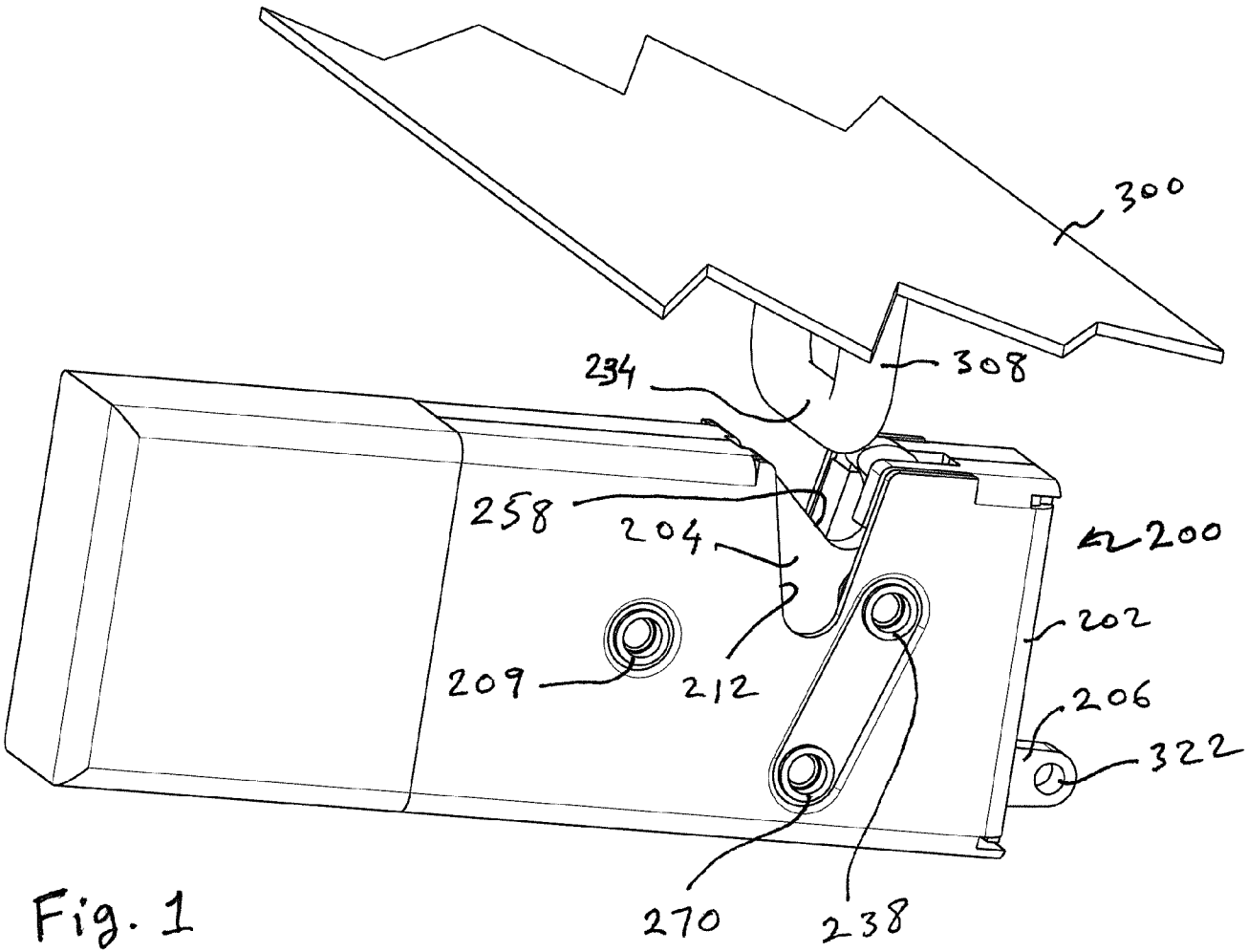
FIGS. 1-10 are views of a latch assembly according to the present invention.
Figure 2:
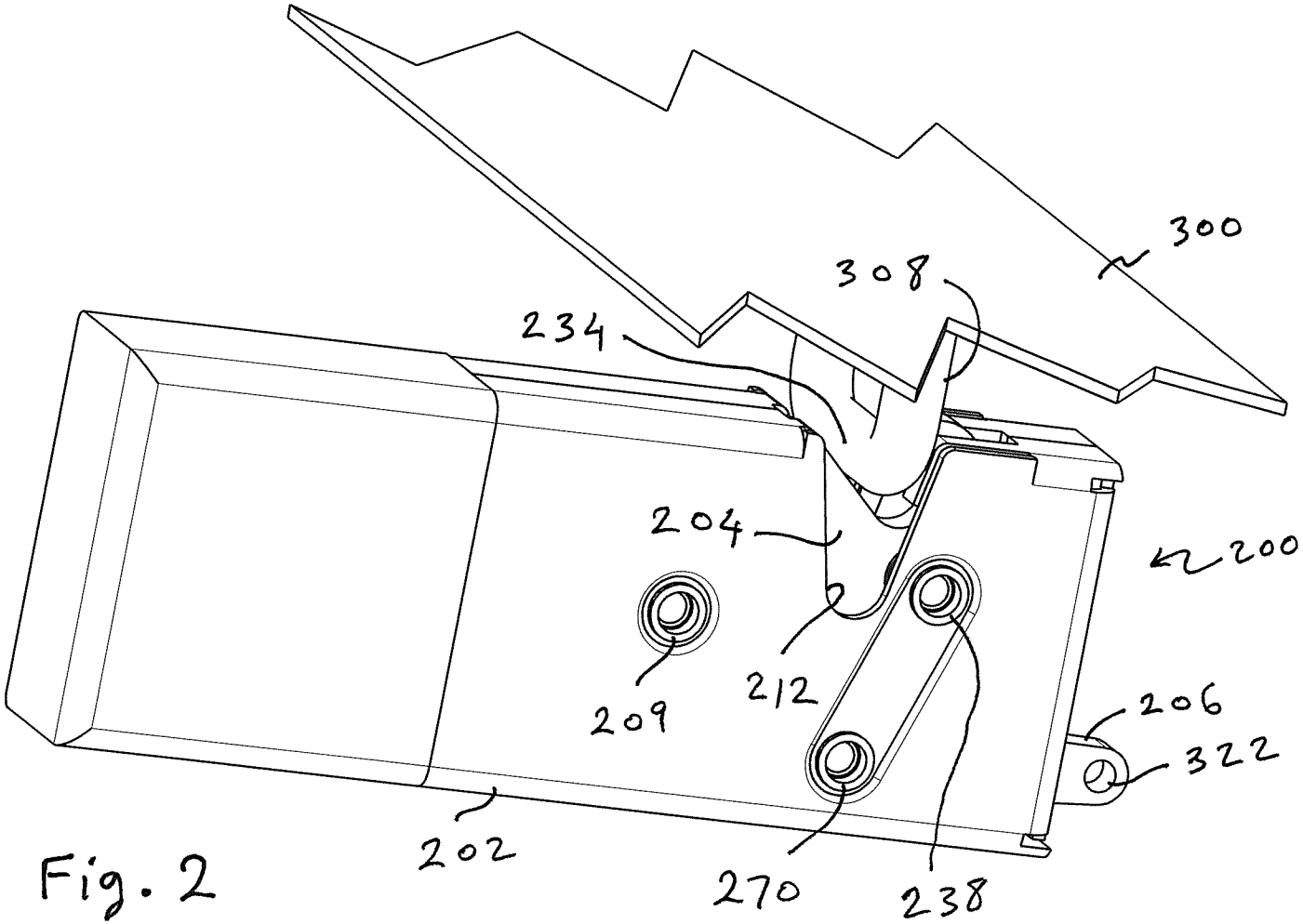
Figure 3:
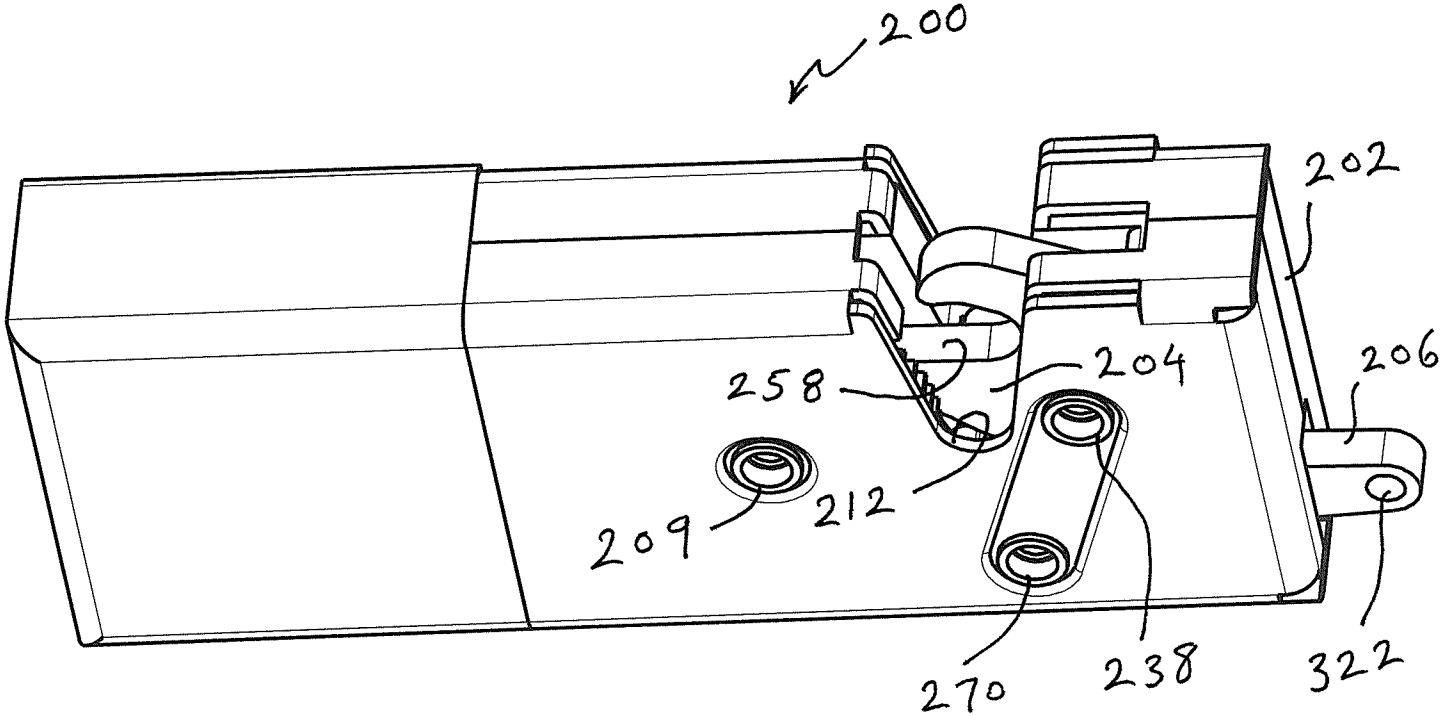
Figure 4:
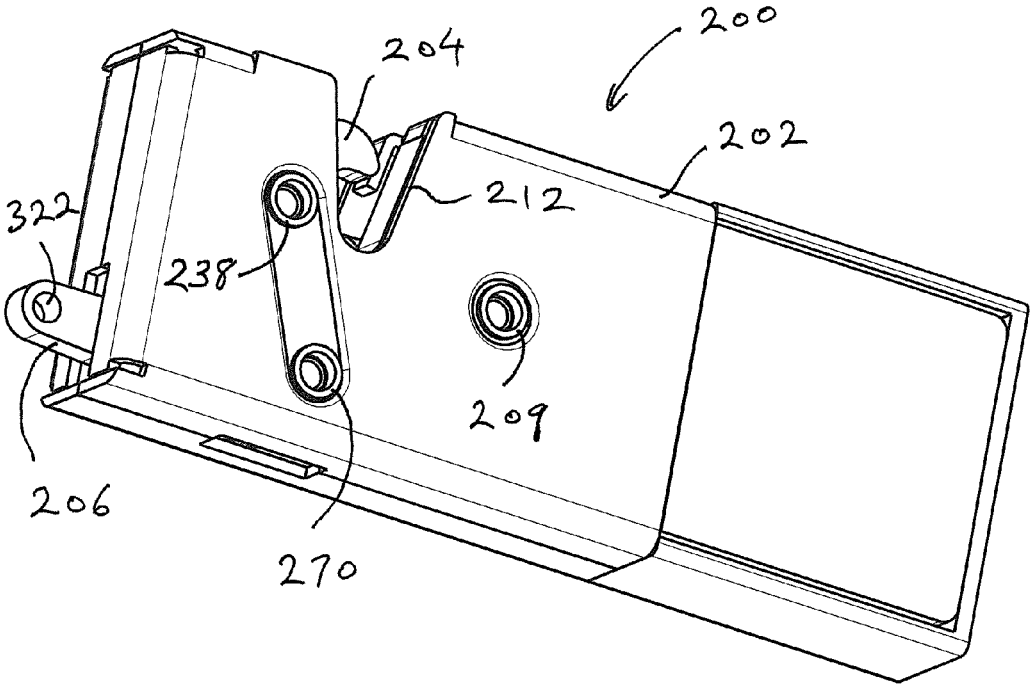
Figure 5:
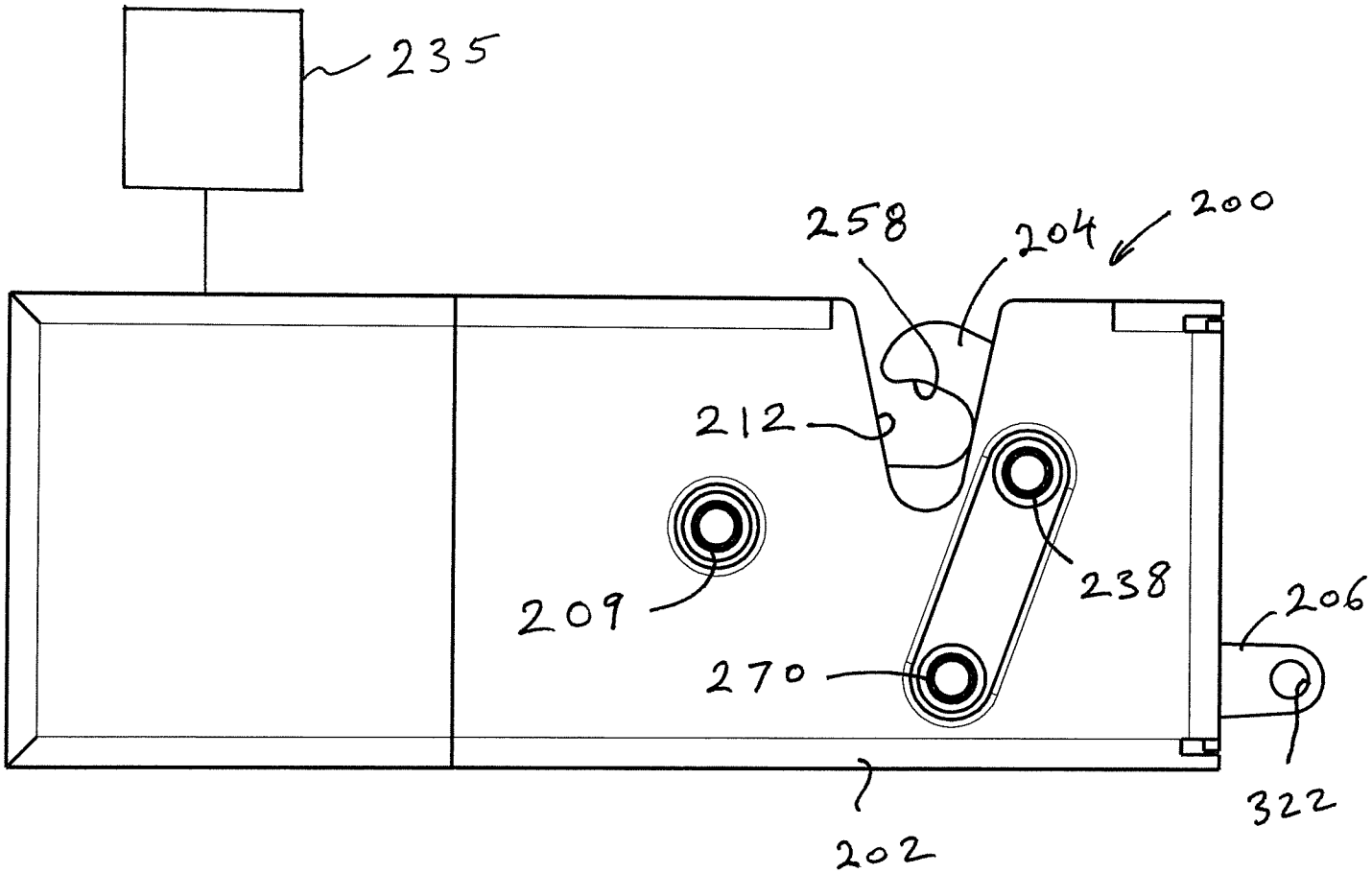
Figure 6:
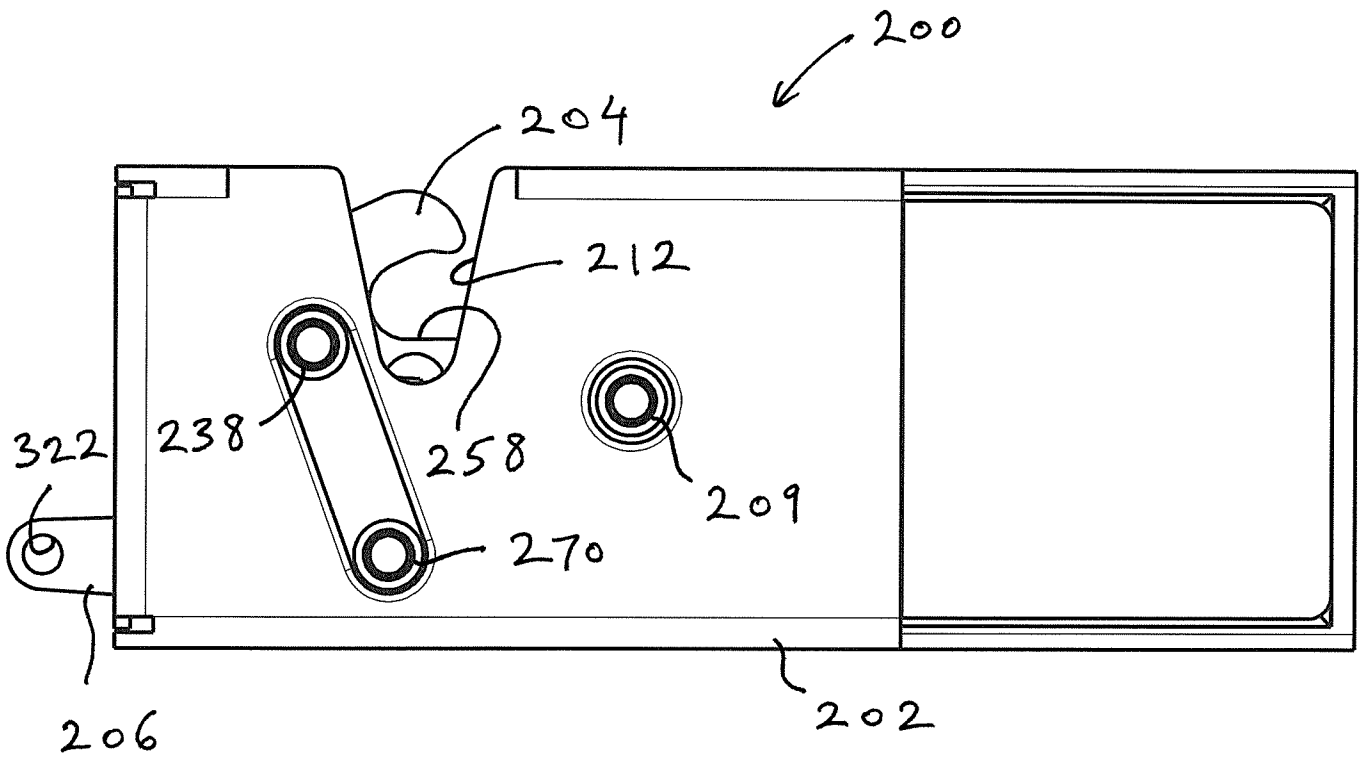
Figure 7:
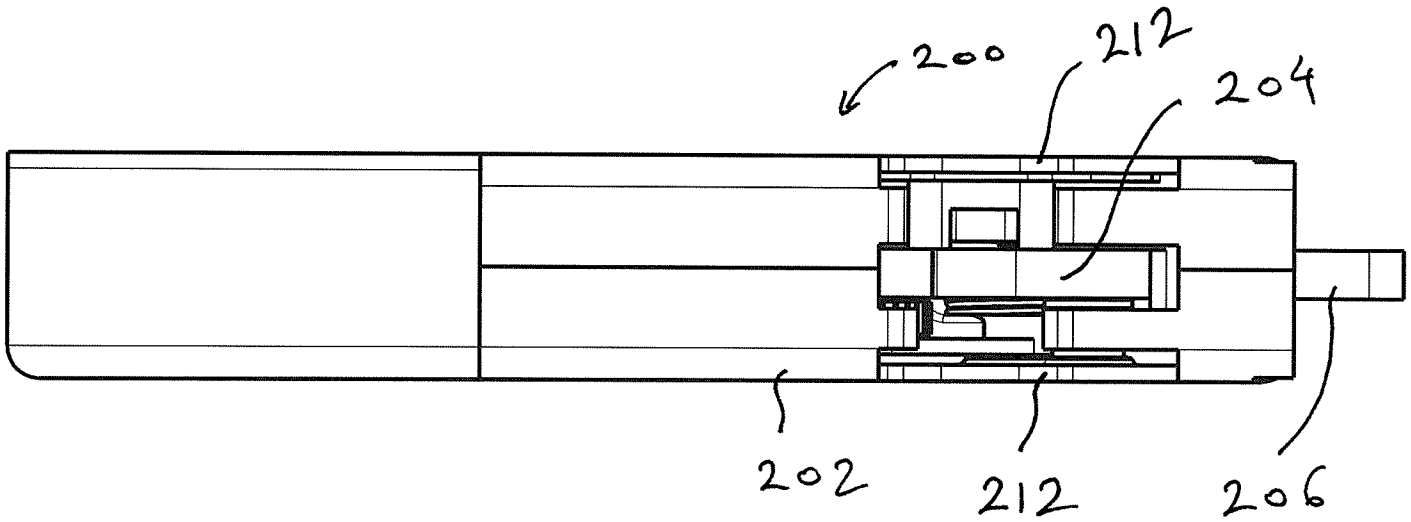
Figure 8:
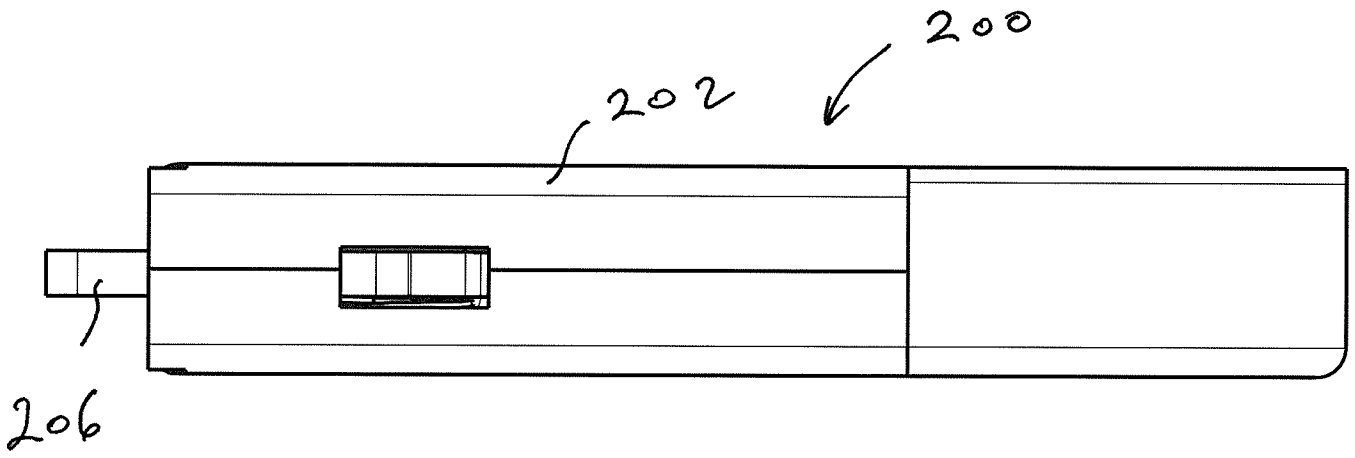
Figure 9:
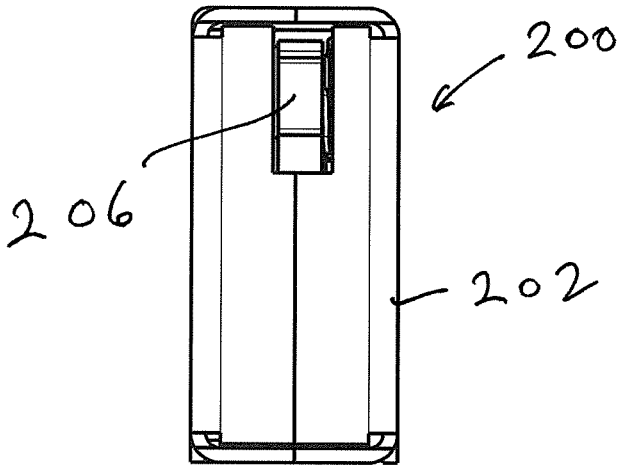
Figure 10:
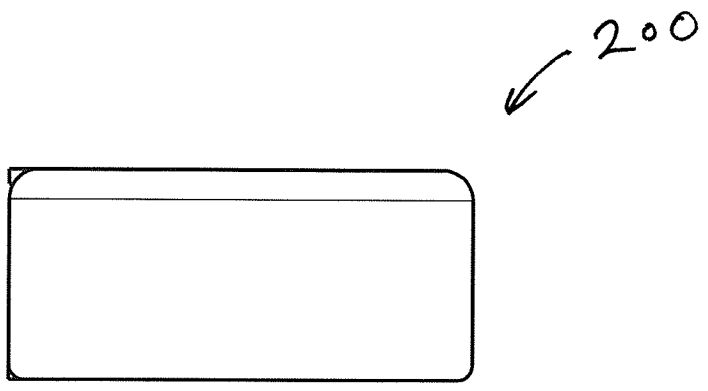
Figure 11A:
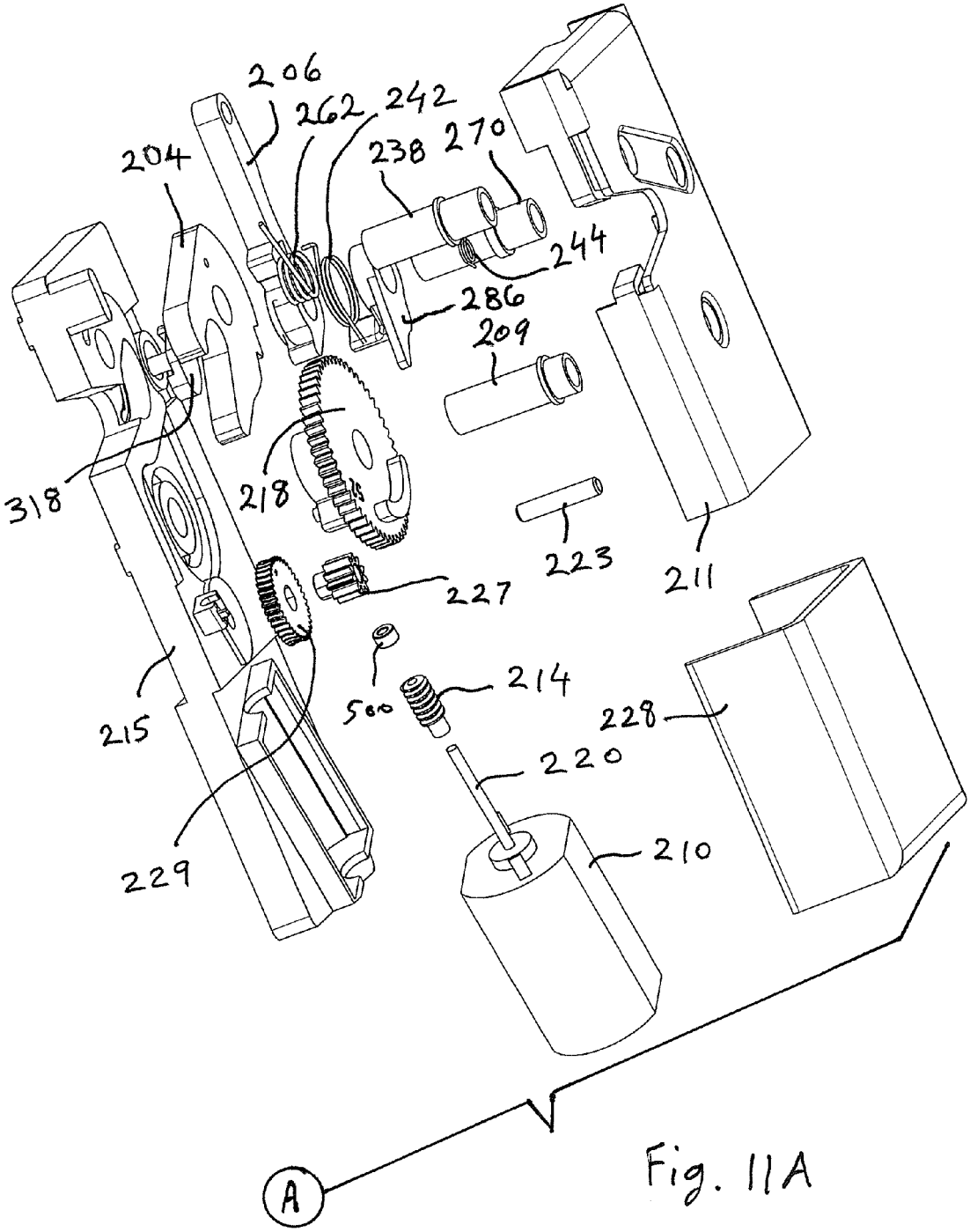
FIGS. 11A-12 are exploded views of a latch according to the present invention.
Figure 11B:
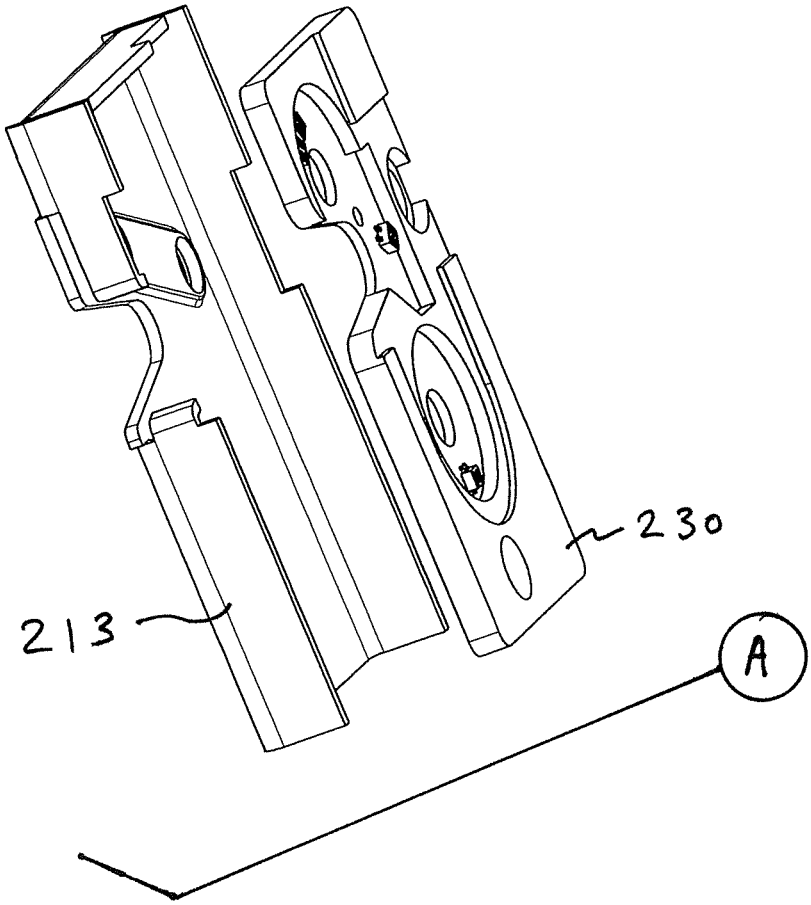
Figure 12:
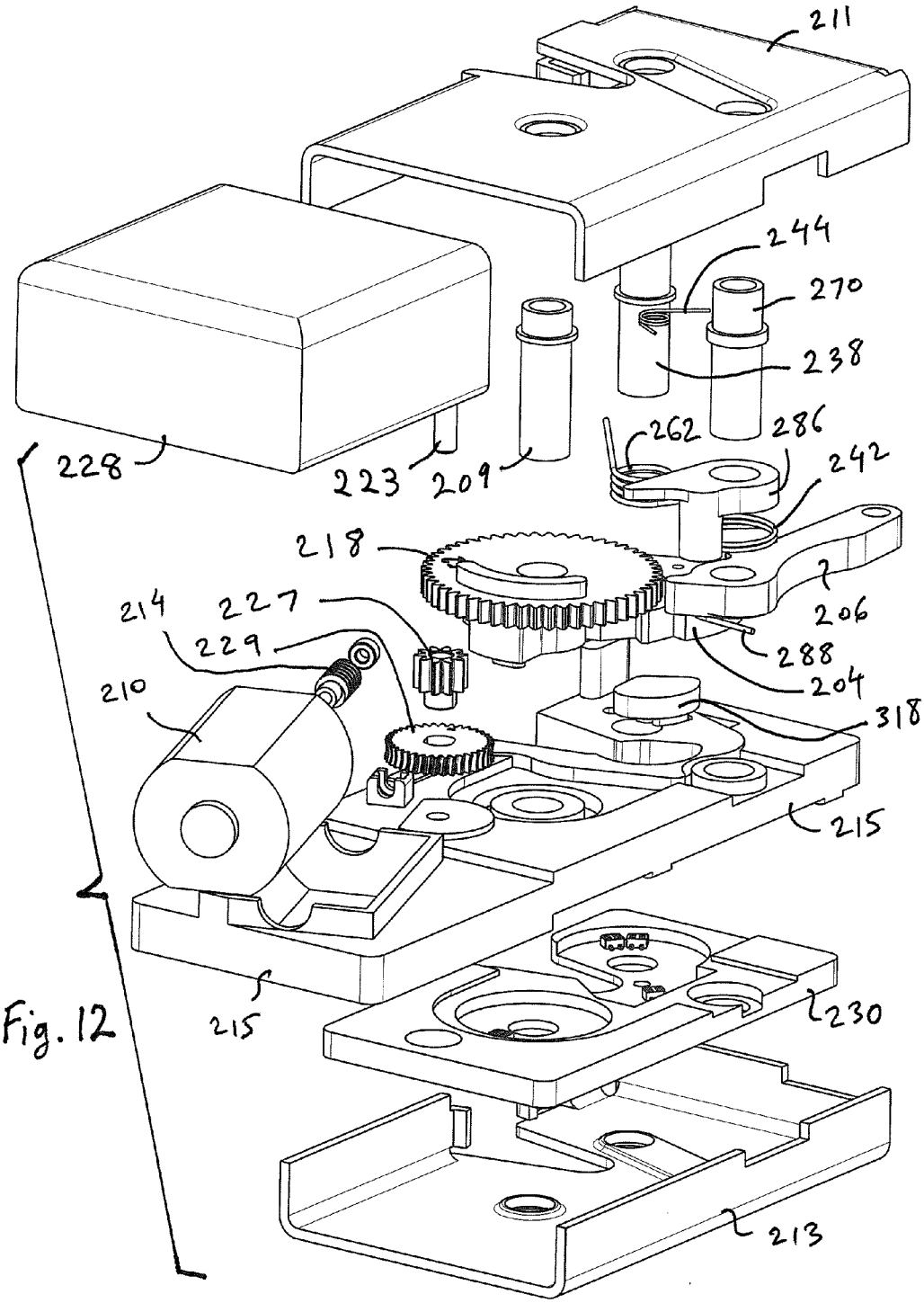
Figure 13:
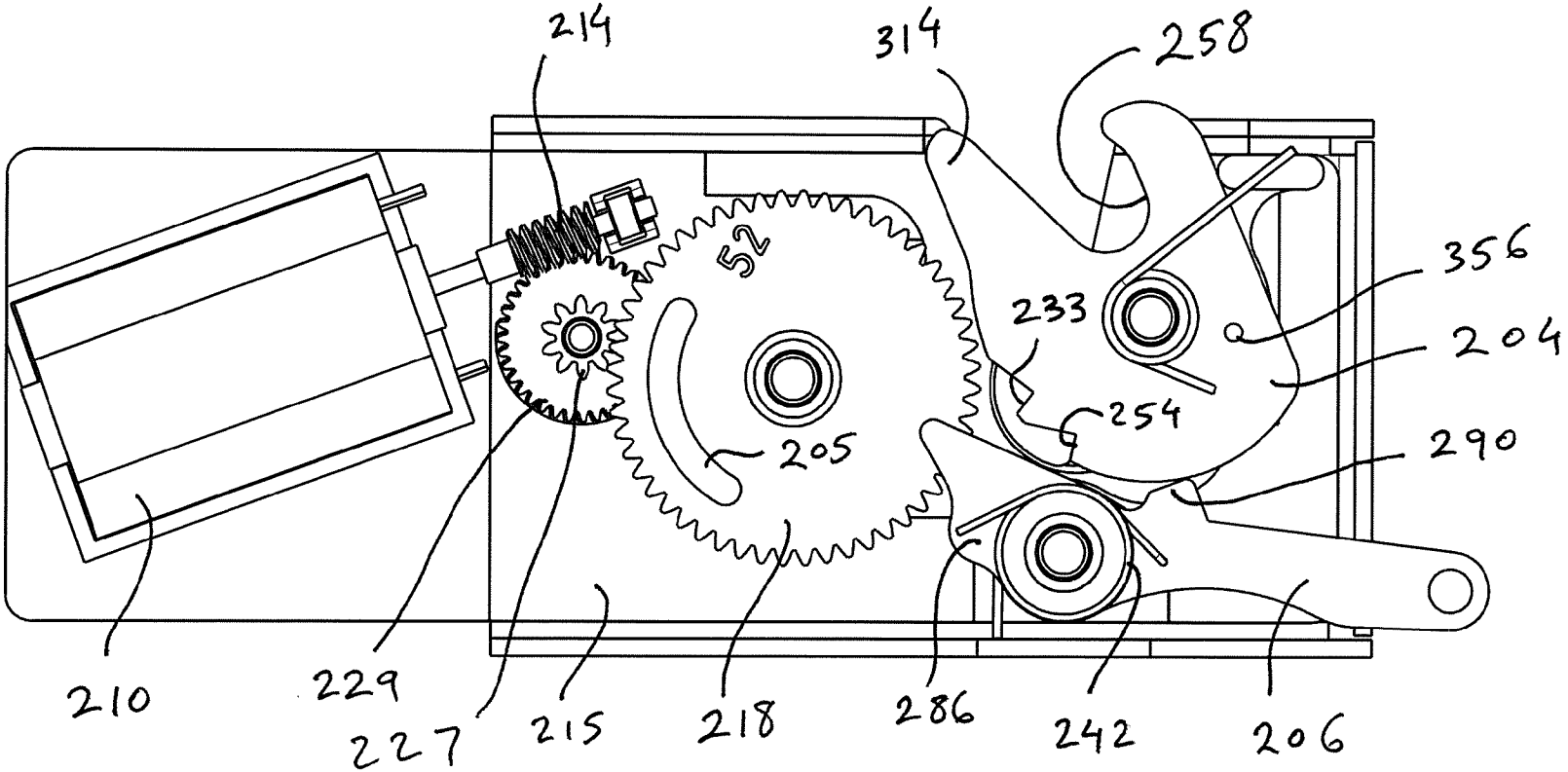
FIGS. 13-15 are views of a latch according to the present invention showing the latch in the unlatched configuration with the cover removed to reveal internal detail.
Figure 14:
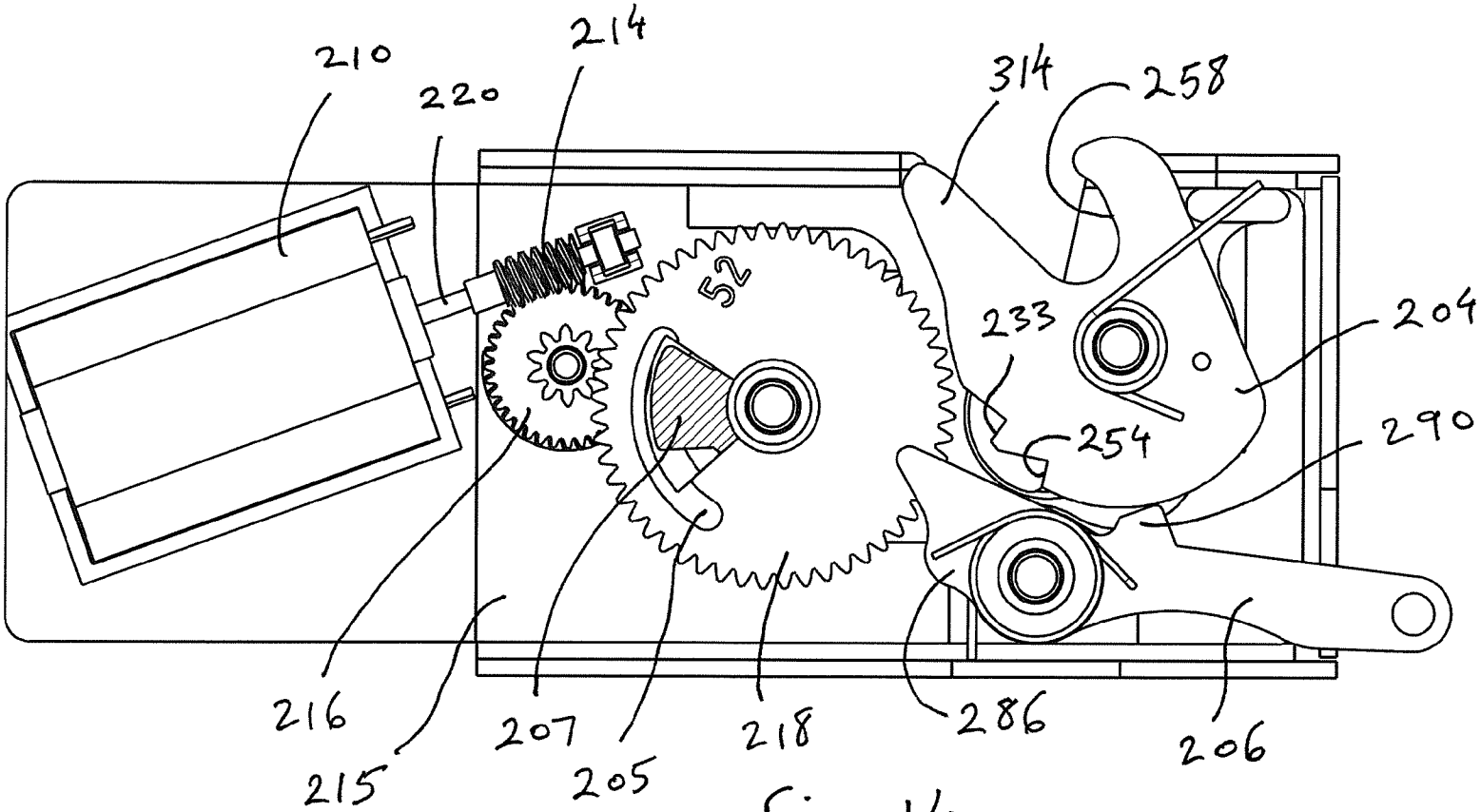
Figure 15:
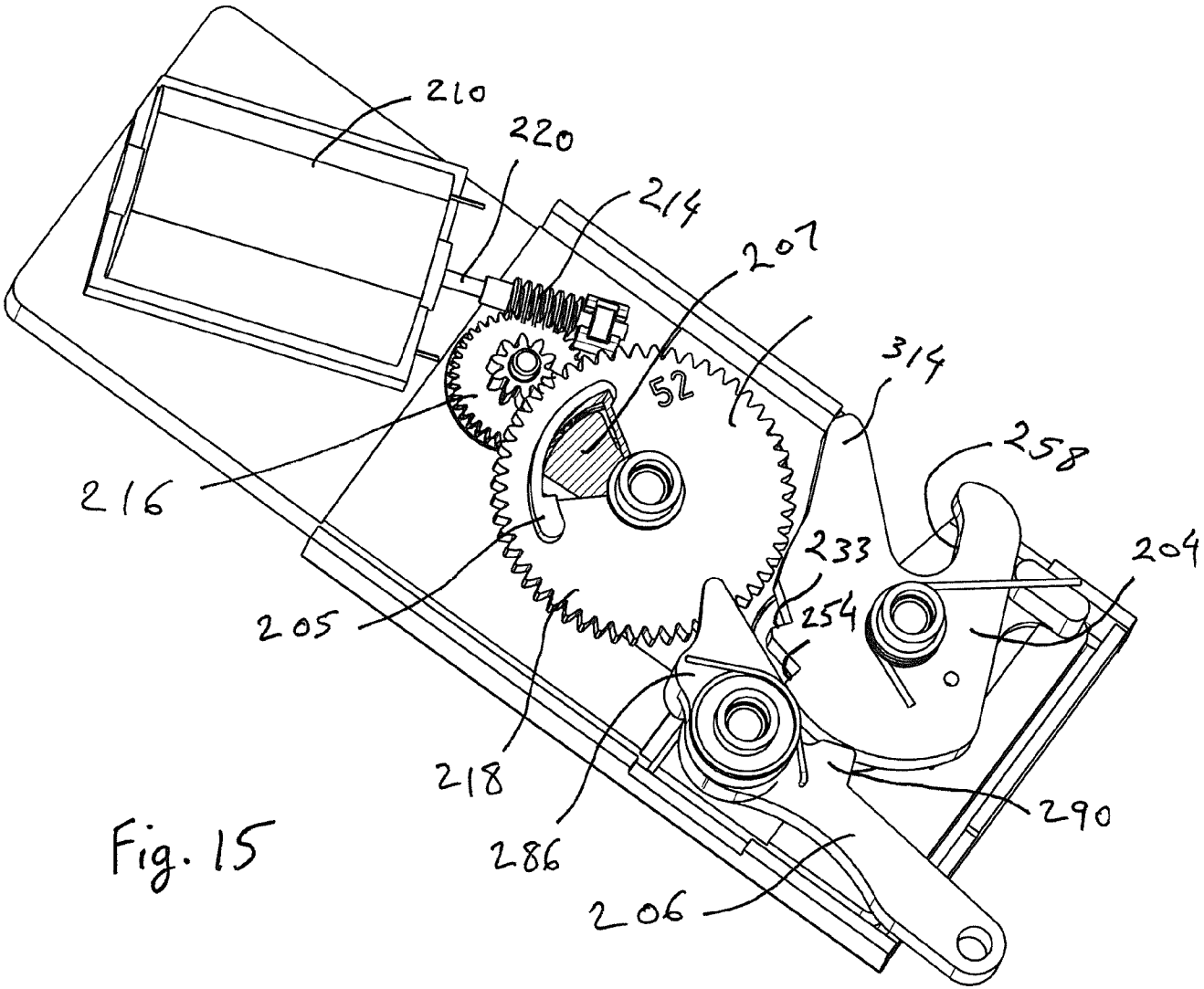
Figure 16:
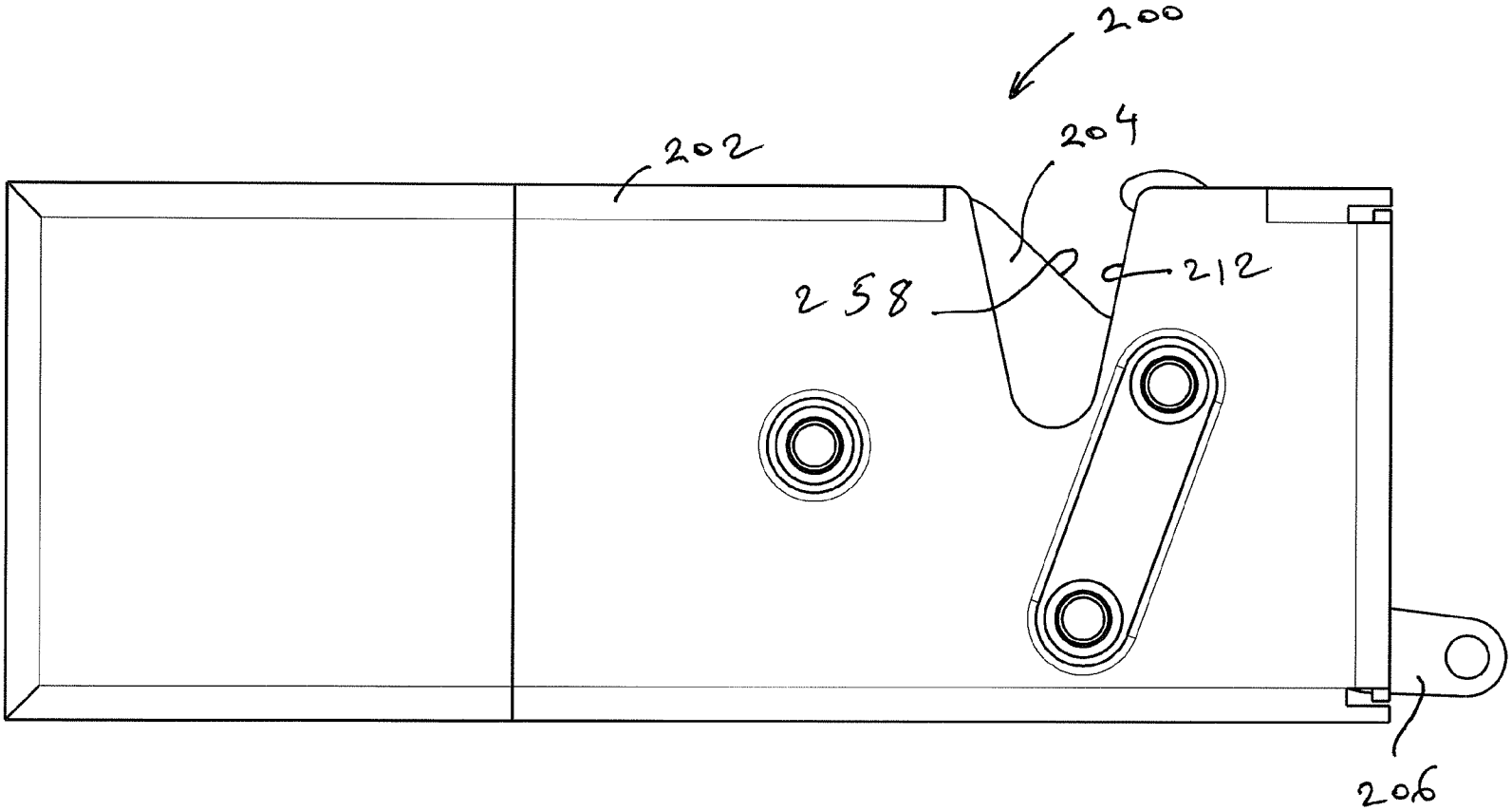
FIG. 16 is a view of a latch according to the present invention showing the latch in the unlatched configuration.
Figure 112:
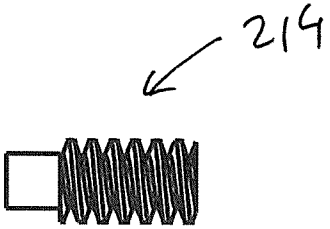
FIGS. 111-112 are views of the worm gear of a latch according to the present invention.
Figure 111:
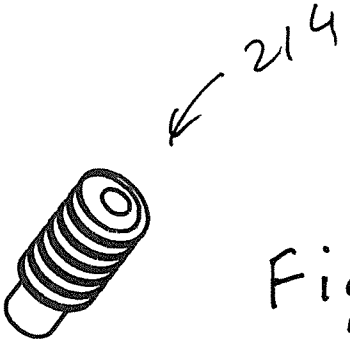

Referring to FIGS. 1-112, a latch 200 in accordance with an exemplary embodiment of the present invention can be seen. The latch 200 includes a latch housing 202, a pawl 204, a trigger or catch 206, and actuation means for selectively moving the trigger 206 out of engagement with the pawl 204 and for moving the pawl 204 from a first or initial latched position to a second or final latched position to thereby draw a portion of a striker farther into the interior of the housing 202. In the illustrated embodiment, an electrically operated actuator assembly 208 serves as the actuation means.

The latch 200 is generally applicable wherever one or more closure members need to be secured in a certain position. The latch 200 can be used together with the striker 308 to secure any two closure members together. In the illustrated example, the latch 200 is shown being used for securing a panel 300 relative to some compartment (not shown) for which the panel 300 serves as a closure. In use, the latch 200 can be secured to the interior of the compartment, for example the passenger compartment of an automobile, using any well known means such as, for example, screws, bolts, or the like, with the latch 200 positioned such that it can be engaged by the striker 308.

Preferably, the housing 202 is of the two-piece type having a first portion 211 and a second portion 213 so as to allow the housing 202 to receive the various components of the latch 200. Furthermore, the housing must be adapted to allow an unobstructed path to the pawl slot 258 for the striker 308 when the pawl 204 is in the open or unlatched position relative to the housing 202. The housing 202 has an opening that allows at least a portion of the striker 308 to enter the housing 202 for engagement by the pawl 204. In the illustrated example, the opening is in the form of a slot 212 that passes through the first and second portions 211, 213 of the housing 202. The slot 212 forms an open, approximately U-shaped cut-out in the housing 202 as viewed in profile. The slot 212 allows at least a portion of the striker 308 to enter the housing 202 for engagement by the pawl 204. The slot 212 allows an unobstructed path to the pawl slot 258 when the pawl 204 is in the open configuration relative to the housing 202. The slot 212 is sized such that the housing 202 will not interfere with the movement of the striker 308 relative to the housing 202 as the pawl 204 is moved from the unlatched position to the first latched position relative to the housing 202 by contact with the striker 308 and as the pawl 204 is rotated to the second latched position relative to the housing 202 by the electrically operated actuator assembly 208. In the illustrated example, the housing is provided with a motor cover 228, which provides a protective cover for the motor.

The electrically operated actuator assembly 208 includes a motor 210, a worm gear 214 that is in the form of an Archimedes or helical screw, a combination gear 216, a cam gear 218, the support plate 215, and the printed circuit board 230. The motor 210 has an output shaft 220 that normally rotates in response to the motor being energized. Reversing the polarity of the current supplied to the motor 210 causes the direction of rotation of the output shaft 220 to be reversed. The motor 210 is received in the housing 202 and is installed at a fixed location therein. The worm gear 214 is attached to the output shaft 220 of the motor 210 such that the worm gear 214 rotates with the shaft 220 as a unit during normal operation of the latch 200.

The combination gear 216 includes two adjacent coaxial gear wheels 229, 227 that rotate as a unit about a common axis of rotation. The first gear wheel 229 is of a larger diameter as compared to the second gear wheel 227. The combination gear 216, including the gear wheels 229, 227, may be of one-piece or two-piece construction. The combination gear 216 is rotationally supported in the housing 202 by the combination gear axle 223. The worm gear 214 is in mesh with the combination gear 216. In the illustrated example, the helical screw of the worm gear 214 engages the gear teeth 225 of the gear wheel 229, such that the worm gear 214 is in mesh with a first set of teeth 225 of the combination gear 216. Accordingly, rotation of the worm gear 214 causes rotation of the combination gear 216 when the motor 210 is energized.

The cam gear 218 includes a gear wheel 222, a first cam 203, and a second cam 205. The first cam 203 is provided on one side of the gear wheel 222 and the second cam 205 is provided on the opposite side of the gear wheel 222. The gear wheel 222, the first cam 203, and the second cam 205 rotate as a unit about a common axis of rotation. The gear wheel 222 of the cam gear 218 has a plurality of gear teeth 310 evenly distributed about its circumference. The first cam 203 has a cam lobe 207, located at a distance from the axis of rotation of the cam gear 218, for rotating the pawl 204. The second cam 205 is in the form of an elongated, arc-shaped raised rib and functions to selectively trip or move the catch or trigger 206. In the illustrated example, the cam gear 218, including the gear wheel 222, the first cam 203, and the second cam 205, is of one-piece construction. The cam gear 218 is rotationally supported in the housing 202 by the cam gear axle 209. The cam gear 218 is in mesh with the combination gear 216. In the illustrated example, the teeth 310 of gear wheel 222 of the cam gear 218 engage the gear teeth 312 of the gear wheel 227, such that the cam gear 218 is in mesh with a second portion or second set of teeth of the combination gear 216. Accordingly, rotation of the combination gear 216 causes rotation of the cam gear 218 when the motor 210 is energized.

The support plate 215 is supported by the housing 202 in a fixed position relative to the housing 202. The pawl 204 is supported for rotational movement relative to the support plate 215 and the housing 202 by the pawl axle 238. The trigger 206 is supported for rotational movement relative to the support plate 215 and the housing 202 by the trigger axle 270. The support plate 215 has a cut-out 224 proximate the pawl 204 such that the support plate 215 will not interfere with the movement of the striker 308 relative to the housing 202 as the pawl 204 is moved from the unlatched position to the first latched position relative to the housing 202 by contact with the striker 308 and as the pawl 204 is rotated to the second latched position relative to the housing 202 by the electrically operated actuator assembly 208. The support plate 215 has a first window in the form of an arcuate, elongated slot 221 that allows the position of the pawl to be detected by sensors 332 and 316 provided on the circuit board 230. The printed circuit board 230 is positioned on the opposite side of the support plate 215 as compared to the pawl 204, the trigger 206 and the cam gear 218. The circuit board 230 is supported by the housing 202 in a fixed position relative to the housing 202 and the support plate 215.

The support plate 215 has a second window 324 to allow detection of the position of the cam gear 218 by a sensor 326 provided on the circuit board 230. The second window 324 is square shaped. A portion of the cam lobe 207 of the first cam 203 registers with the second window 324, at least when the cam gear 218 is in its initial or starting position, to allow the sensor 326 to detect when the cam gear 218 is in its initial or starting position. The sensor 326 then generates a signal to the latch control circuit 235 when the cam gear 218 is in its initial or starting position to thus allow the latch control circuit 235 to detect whether or not the cam gear 218 is in its initial or starting position.

As previously stated the latch assembly 200 includes a pawl 204 shown pivotally or rotationally supported on the support plate 215 with suitable attachment means such as the pawl axle 238 that passes through the hole 240 in the pawl 204. The support plate 215 is provided with a hole 232 for receiving part of the pawl axle 238. Thus, the pawl 204 is rotationally supported relative to the support plate 215.

The pawl 204 has first and second notches 254, 233 provided for engagement by the trigger 206. The pawl 204 is provided with a pawl slot 258 to capture and hold the striker 308 when the pawl 204 is in either one of the first latched position (shown in FIGS. 19-26) and the second latched position (shown in FIGS. 29-37) relative to the support plate 215. In the illustrated example, the striker 308 has a rod-shaped portion 234 that engages the pawl slot 258 as the panel 300, for example a car door, is moved to the closed position relative to the vehicle's passenger compartment (not shown) and consequently relative to the latch 200.

During normal operation, assuming the latch 200 is initially in the normal unlatched configuration shown in FIGS. 13-16, when the panel 300 is closed, the rod-shaped portion 234 of the striker 308 will be positioned or caught in the pawl slot 258 with the pawl 204 being moved to the first latched position relative to the support plate 215 and housing 202.

A pawl torsion spring 262 is installed on the support plate 215 with the coiled portion 264 of the torsion spring 262 surrounding the pawl axle 238. An arm 268 of the torsion spring 262 engages the pawl 204. The torsion spring 262 also has a second arm 272 that engages the support plate 215 or the housing 202.

With the arm 272 of the torsion spring 262 in engagement with the support plate 215 or the housing 202, the arm 268 of the torsion spring 262 exerts a force on the pawl 204 that biases the pawl 204 toward the open or unlatched position relative to the support plate 215.

Figure 17:
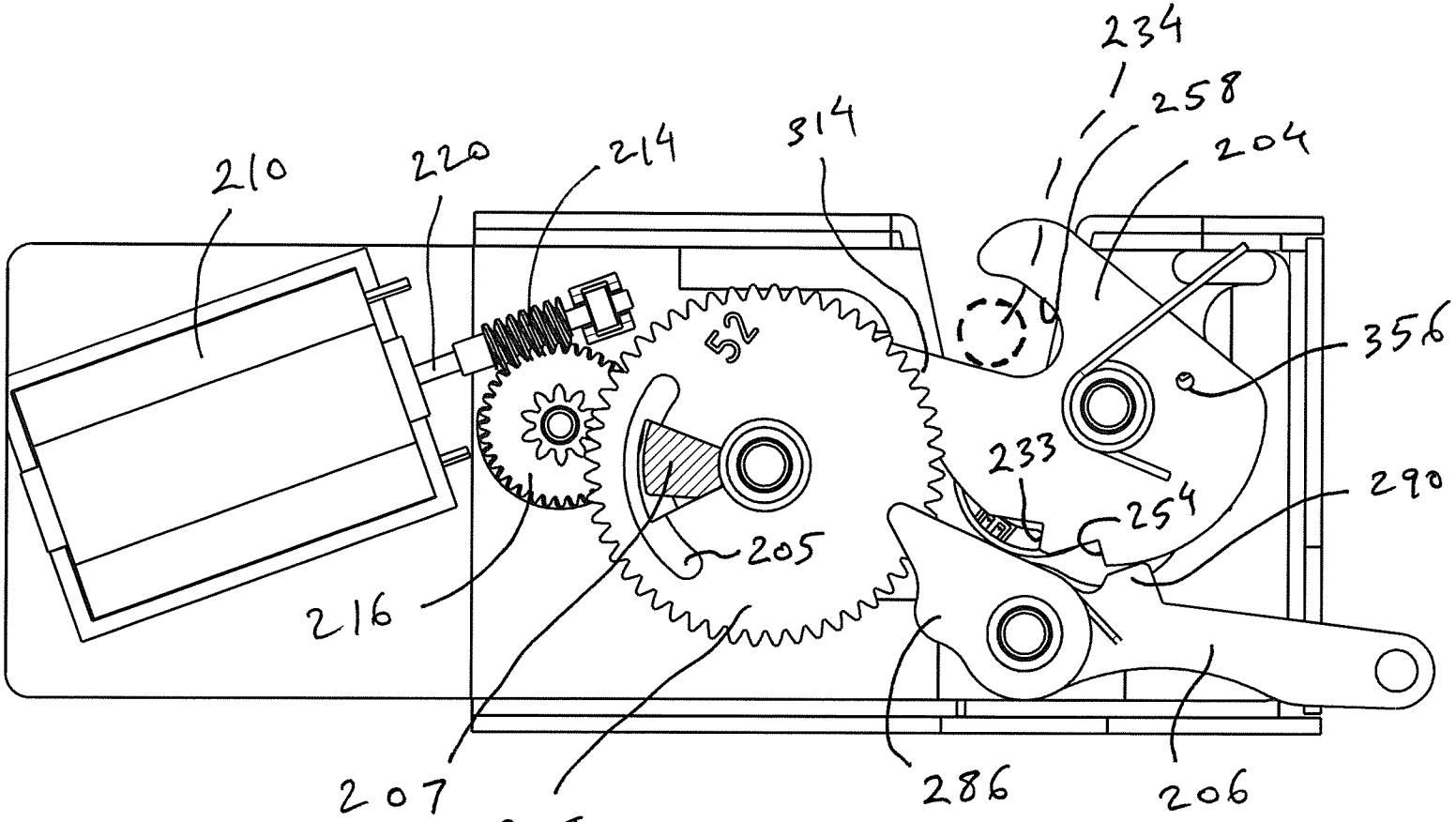
FIGS. 17-21 are a sequence of views of a latch according to the present invention showing the pawl moving from the unlatched position to the first latched position with the cover removed to reveal internal detail.
Figure 18:
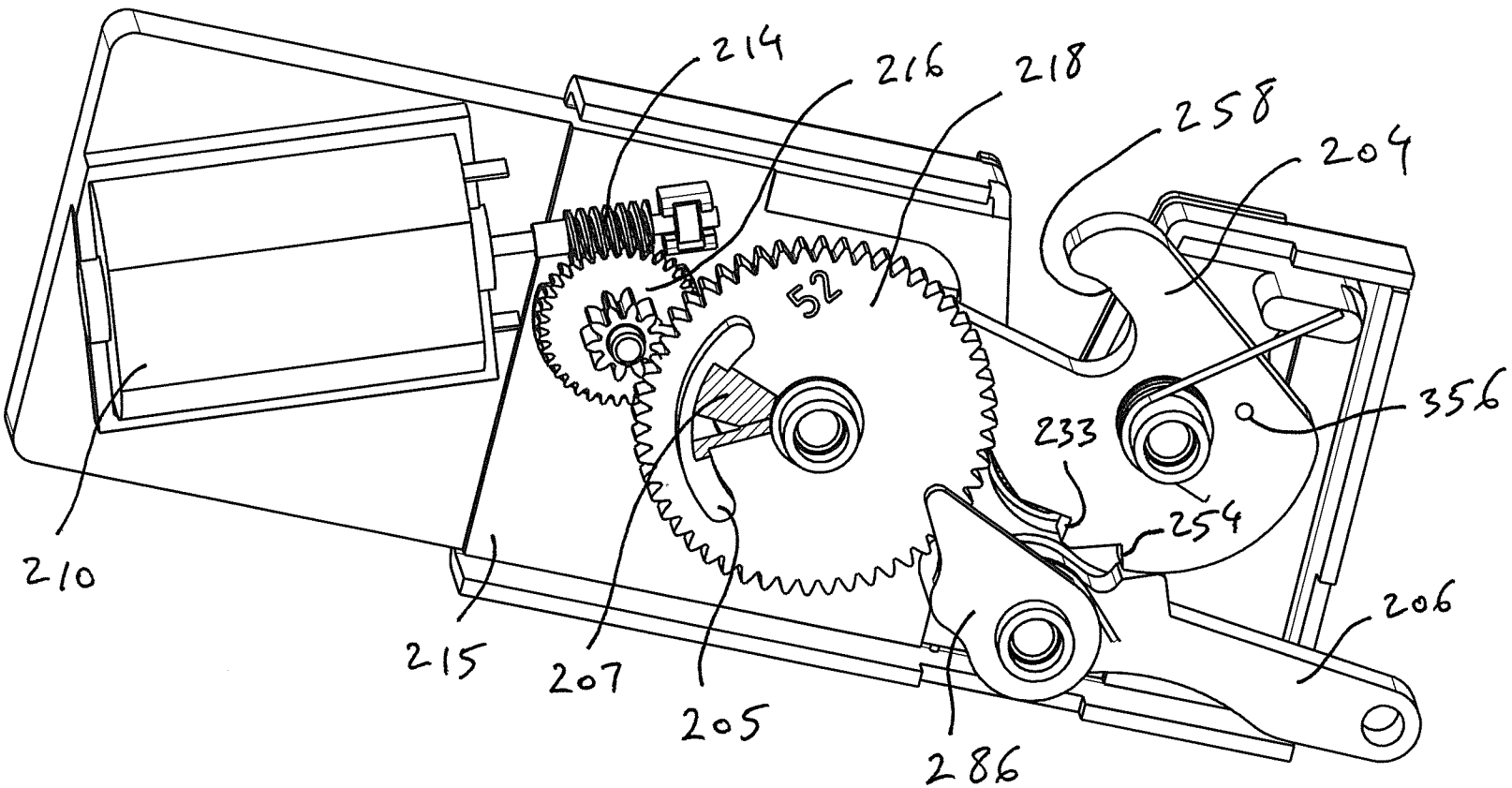
Figure 39:
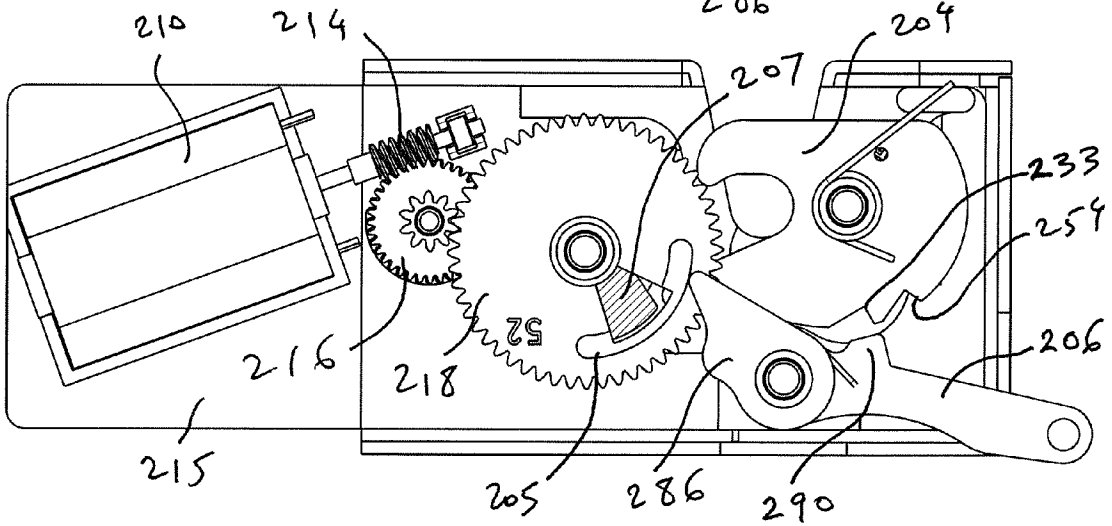
Figure 40:
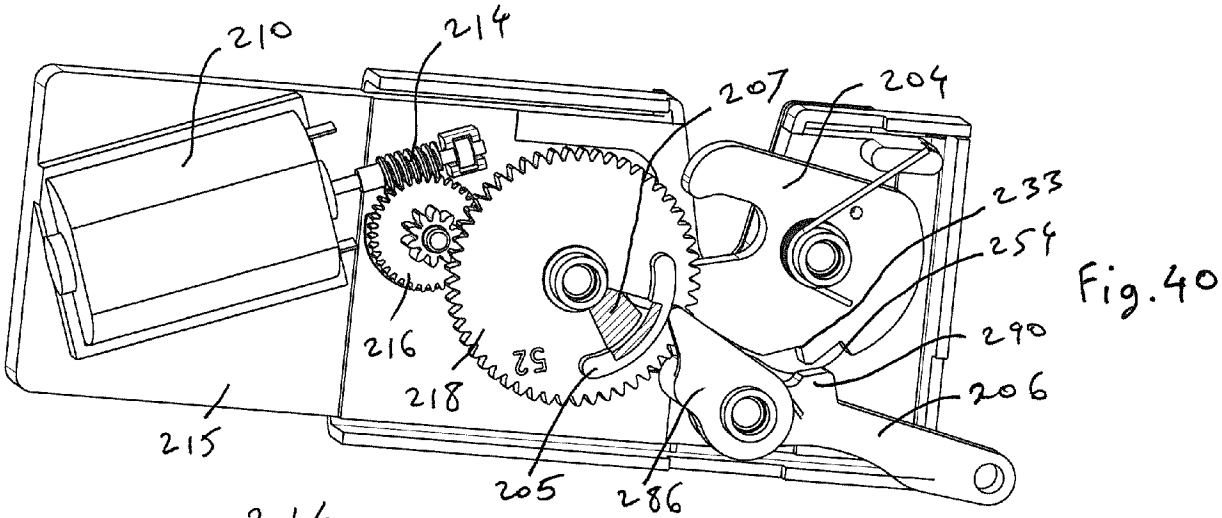
Figure 41:
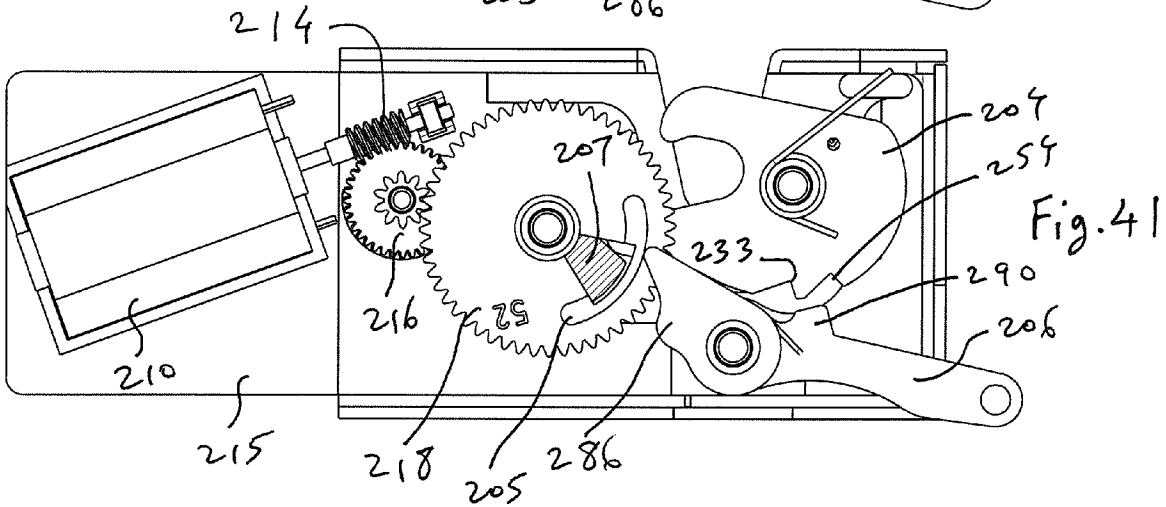
Figures 42, 43:
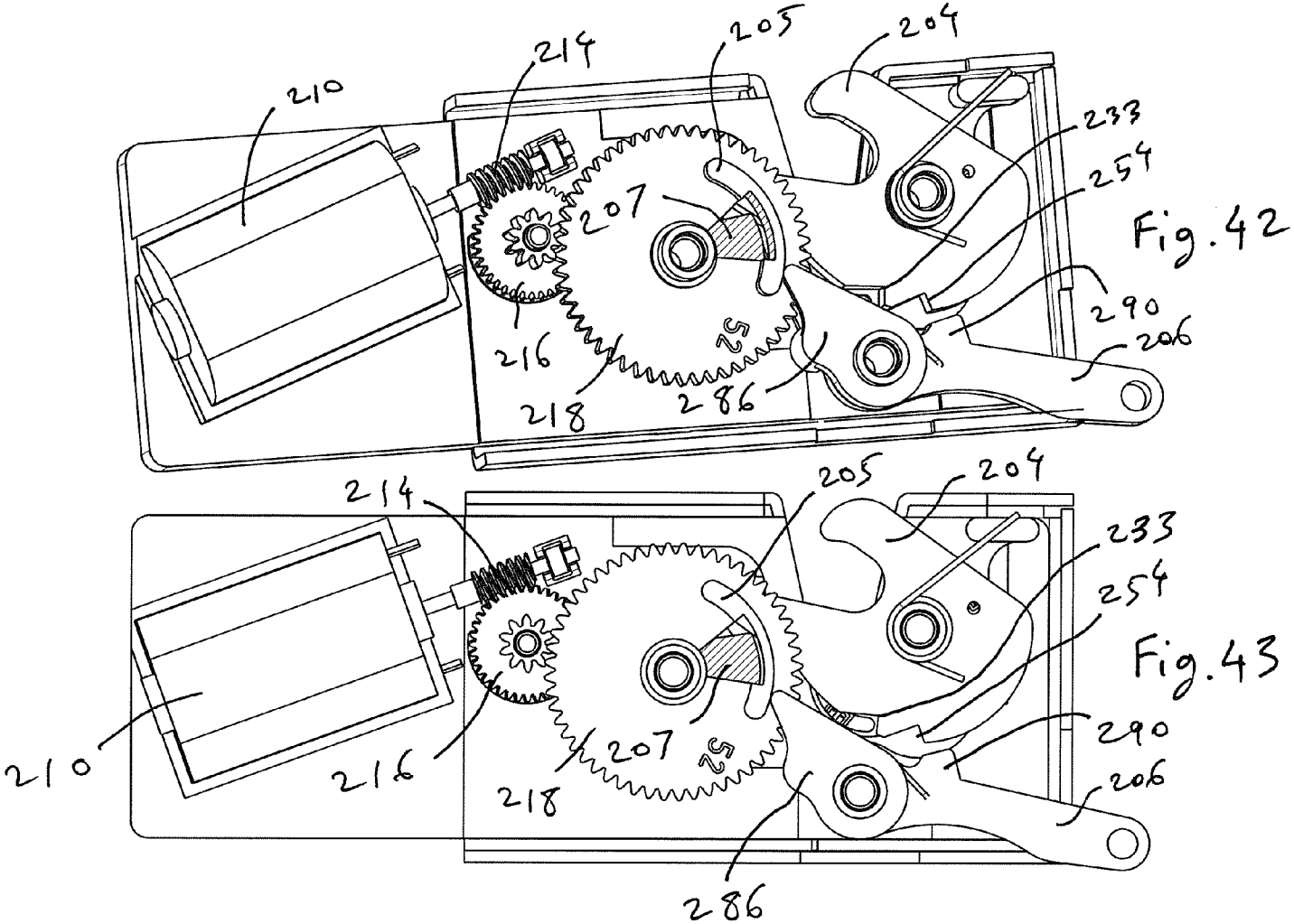
Figure 44:
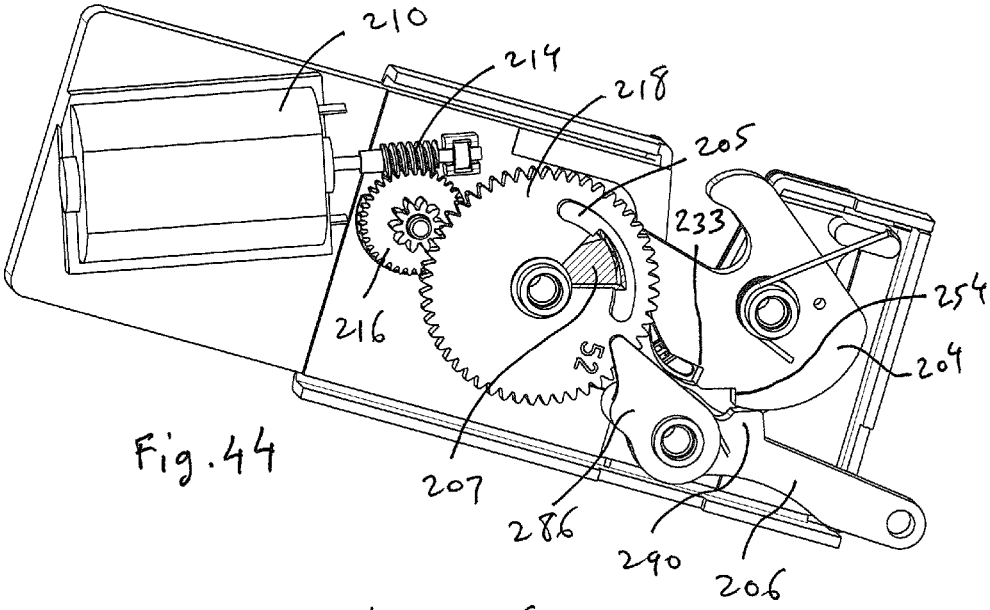
Figure 45:
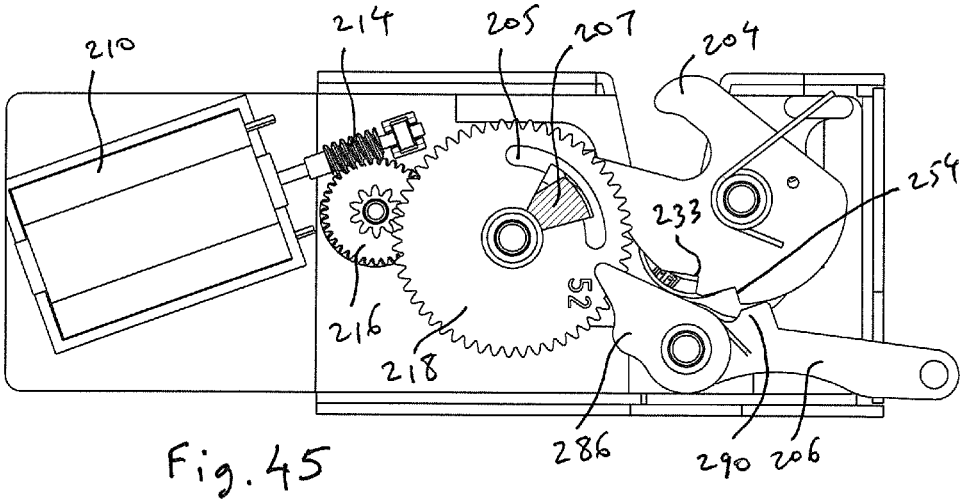
Figure 46:
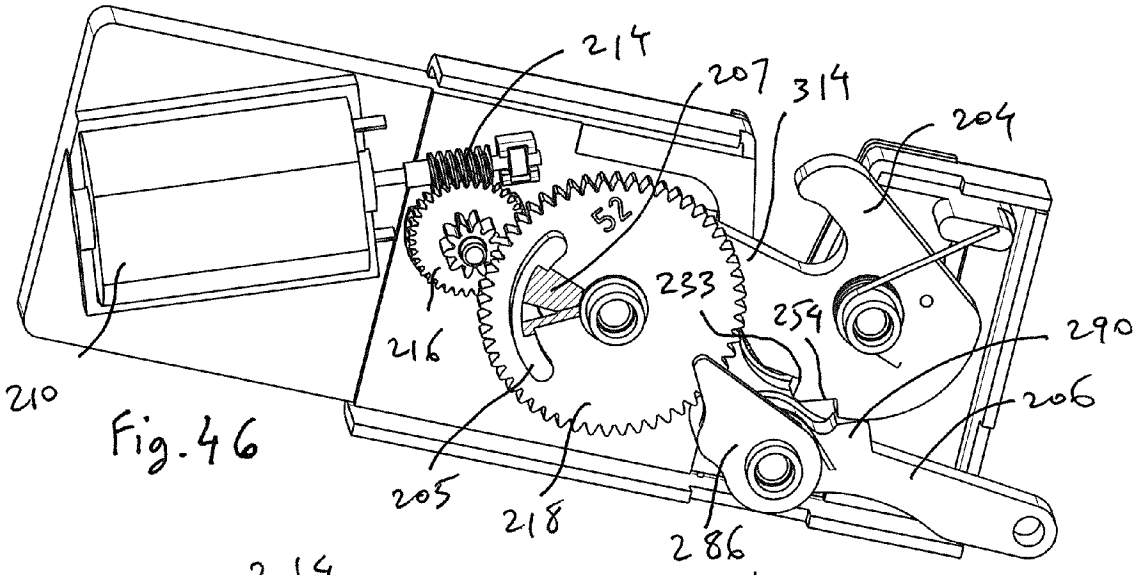
Figure 47:
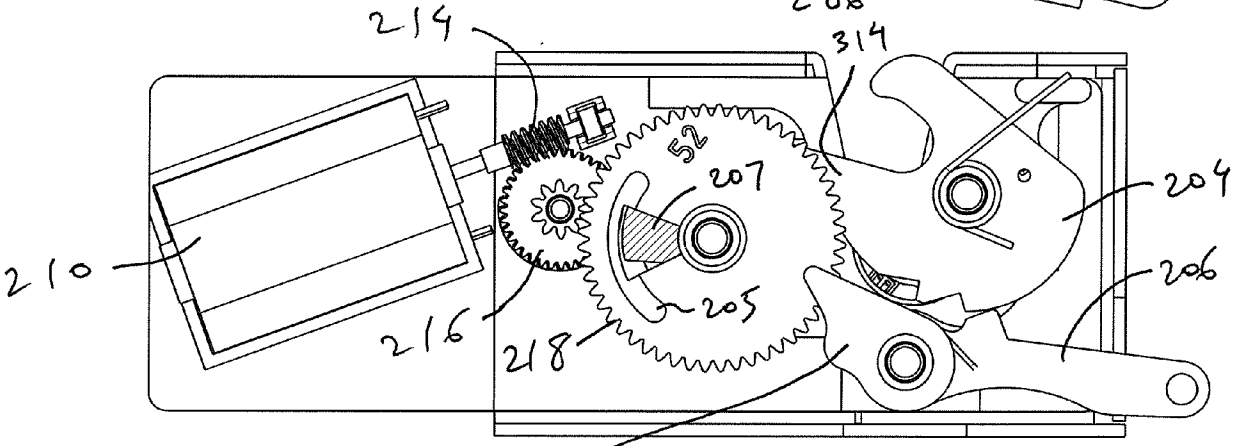
Figure 48:
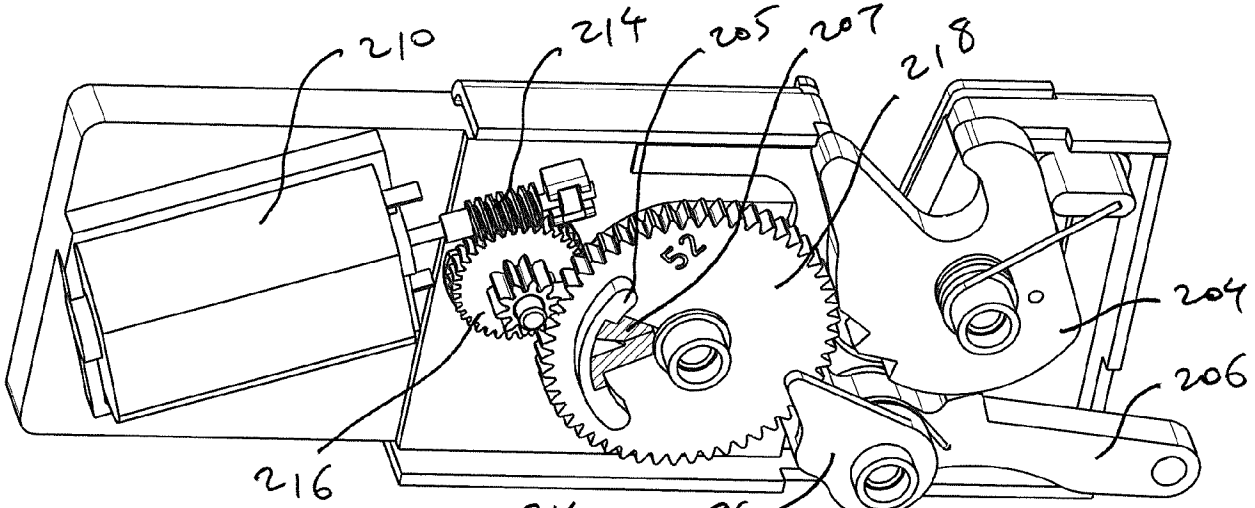
Figure 49:
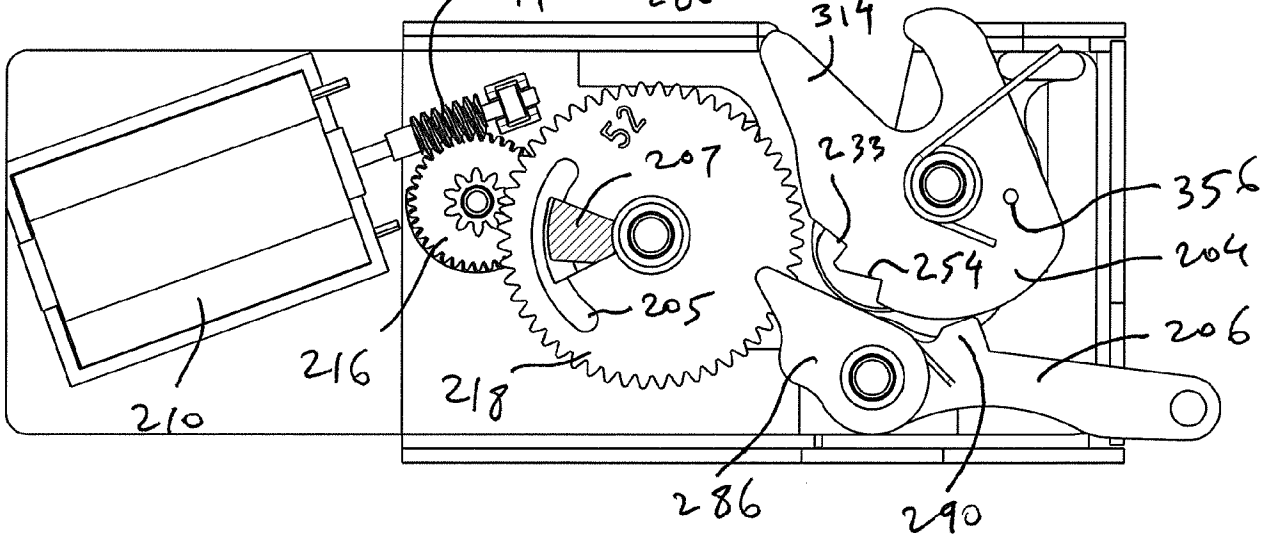
Figure 50:
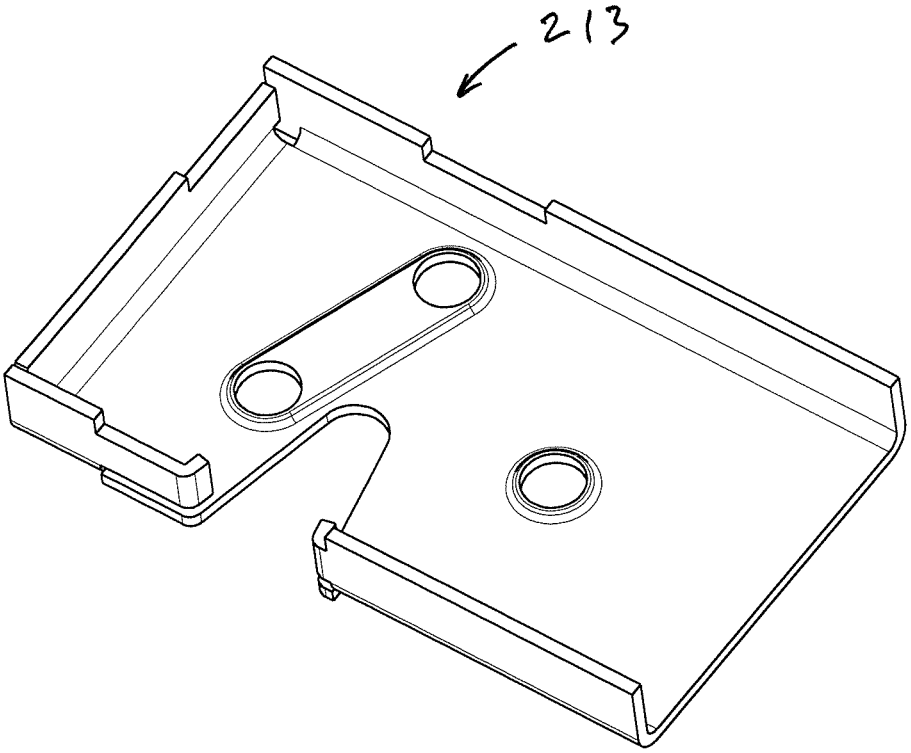
FIGS. 50-51 are views of the second portion of the housing of a latch according to the present invention.
Figure 51:
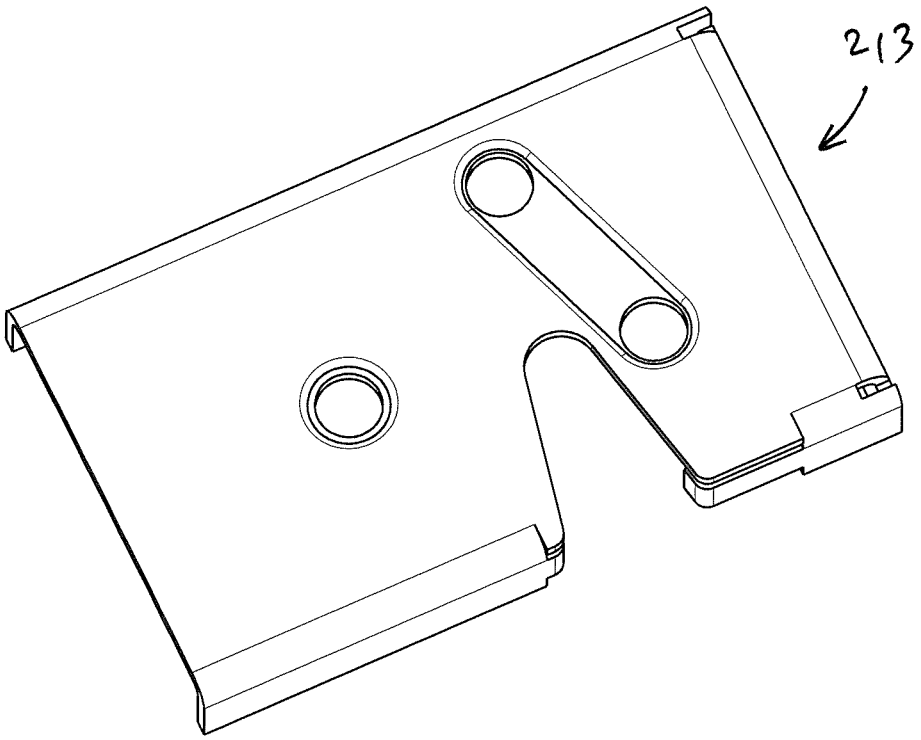
Figure 53:
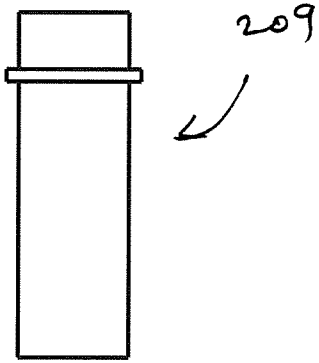
FIGS. 52-53 are views of the cam gear axle of a latch according to the present invention.
Figure 52:
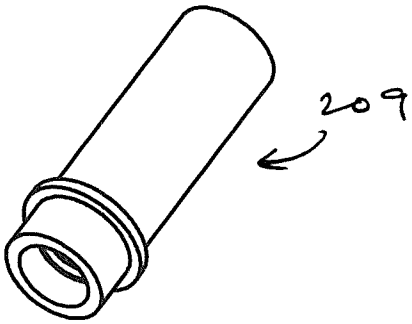
Figure 55:
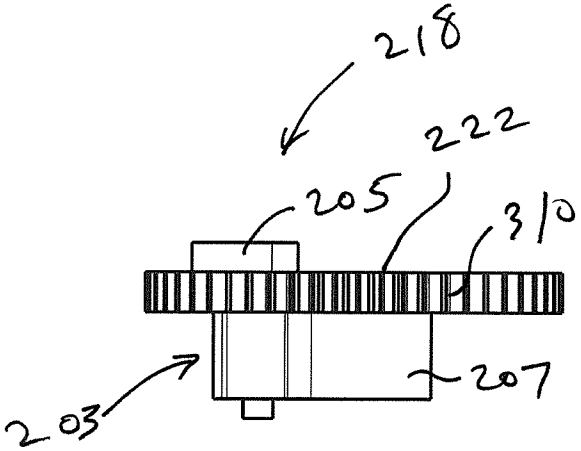
FIGS. 54-60 are views of the cam gear of a latch according to the present invention.
Figure 54:
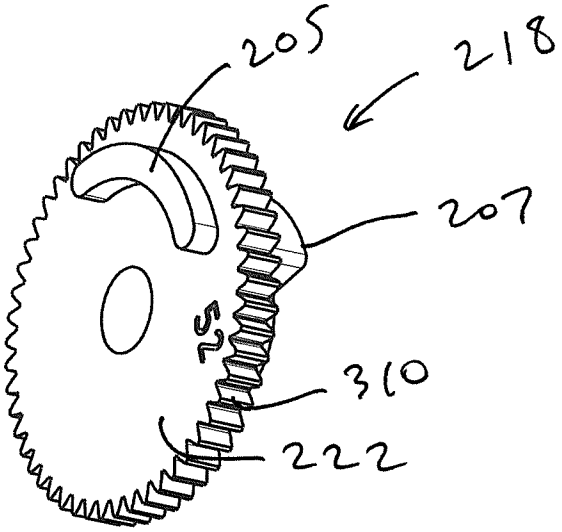
Figure 58:
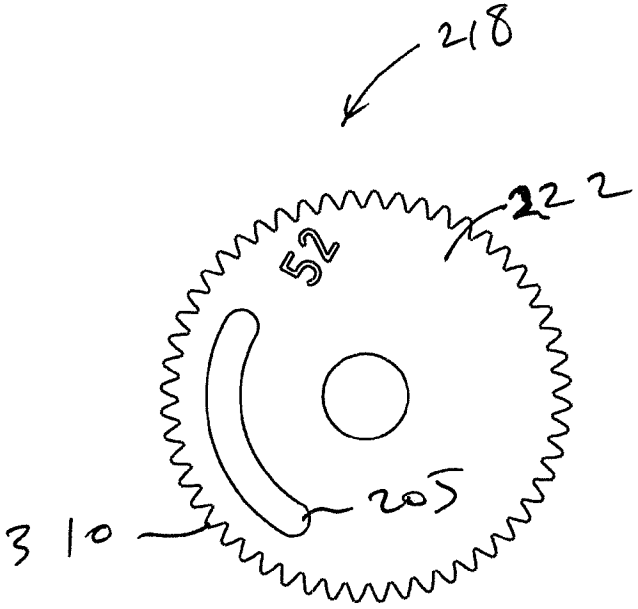
Figure 57:
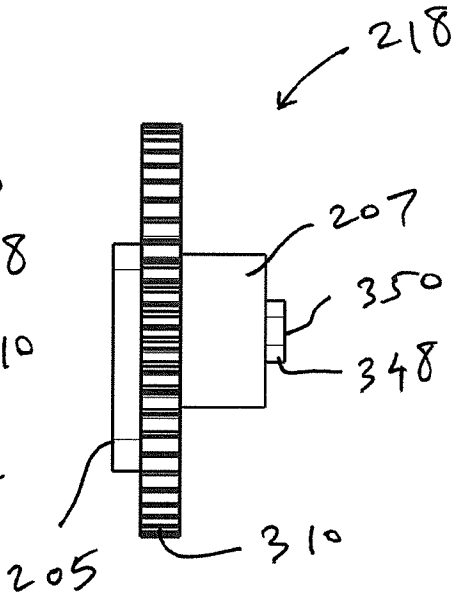
Figure 56:
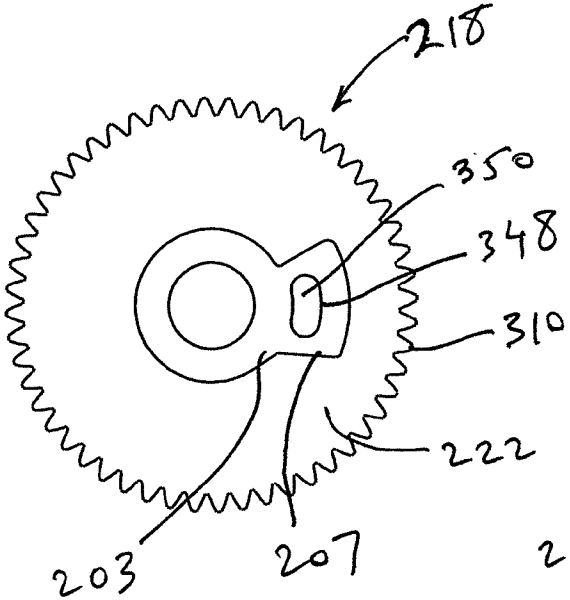
Figure 60:
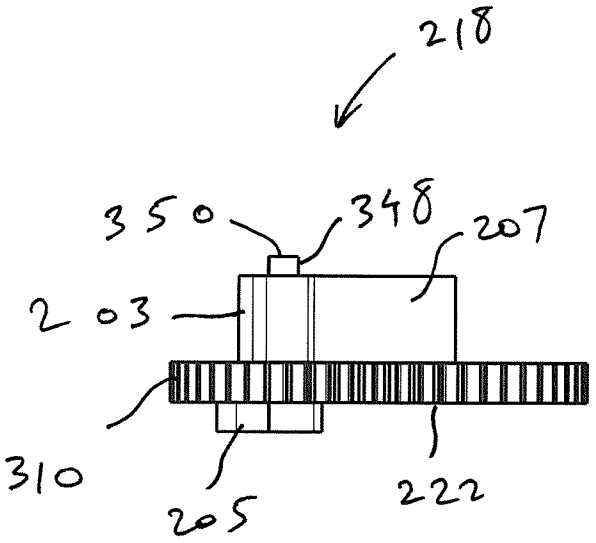
Figure 59:
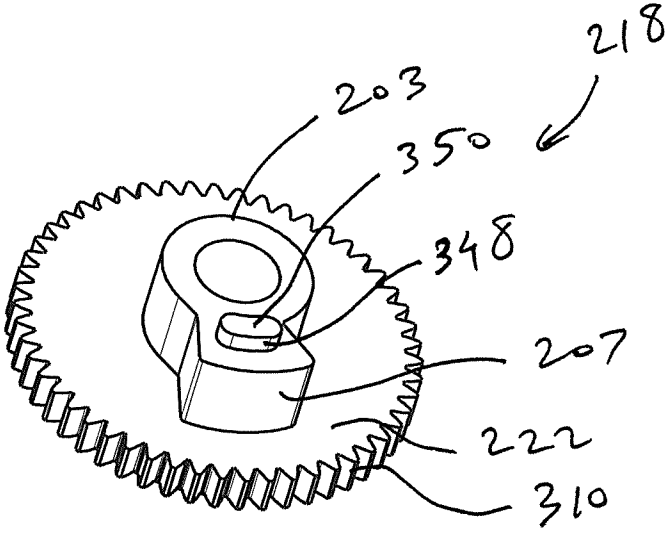
Figure 61:
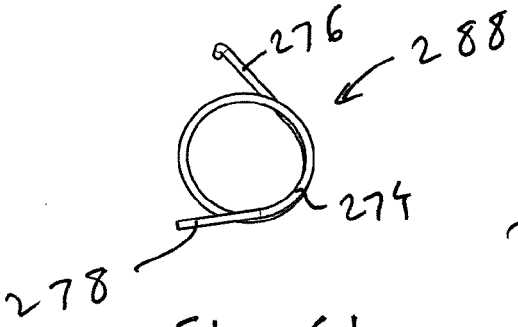
FIGS. 61-65 are views of the trigger spring of a latch according to the present invention.
Figure 62:
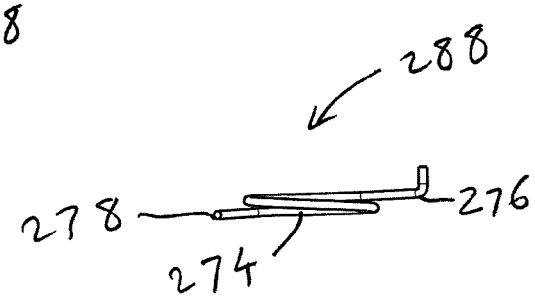
Figure 63:
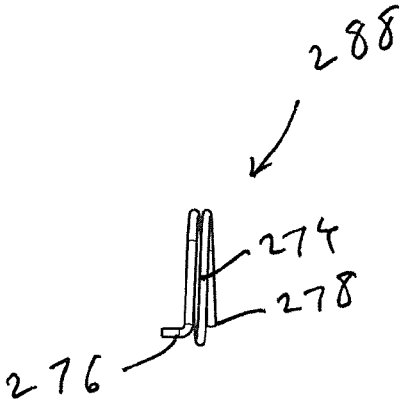
Figure 64:
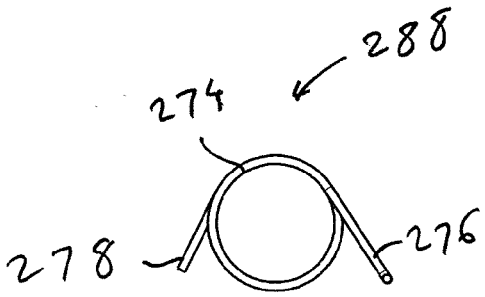
Figure 65:
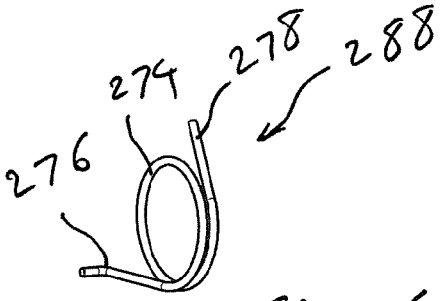
Figure 66:
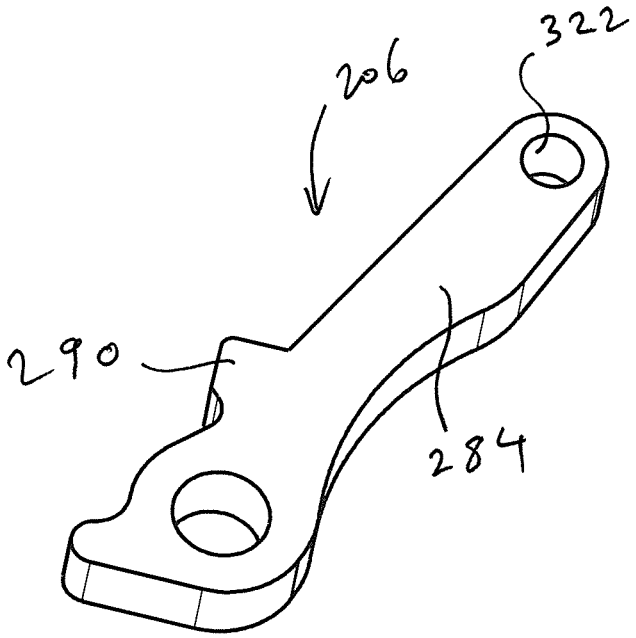
FIGS. 66-68 are views of the trigger of a latch according to the present invention.
Figure 68:
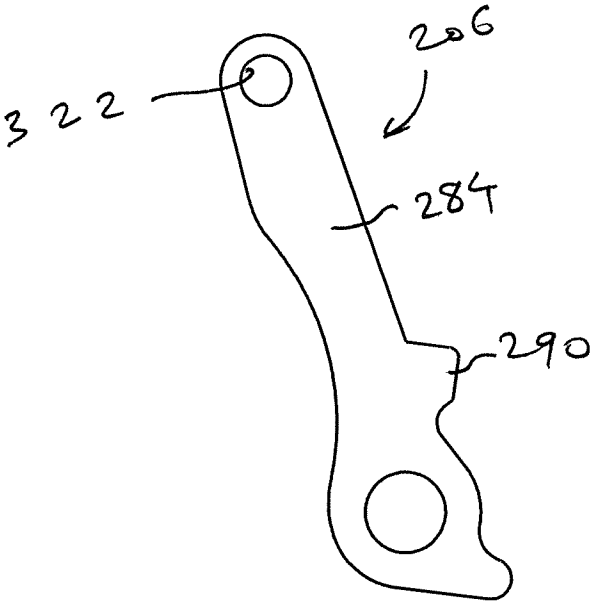
Figure 67:
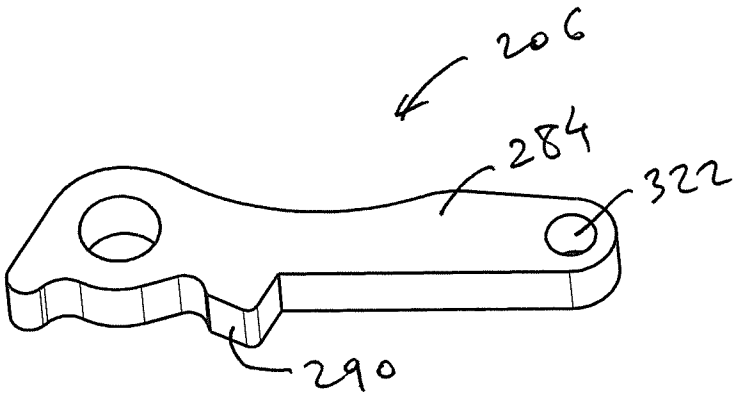
Figure 69:
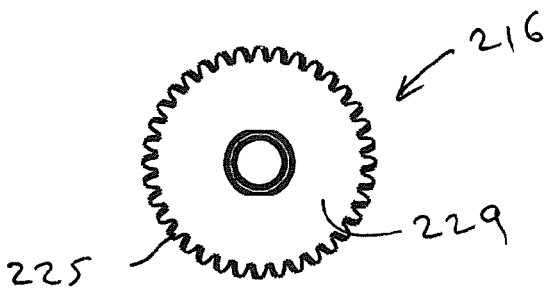
FIGS. 69-73 are views of the combination gear of a latch according to the present invention.
Figure 70:
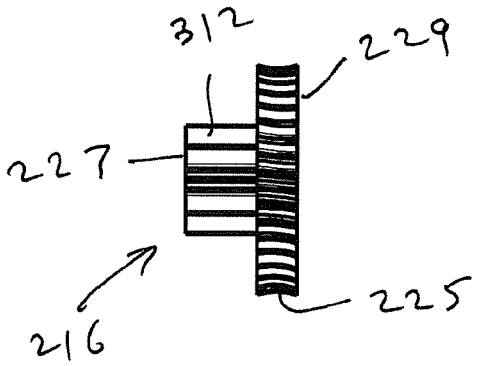
Figure 71:
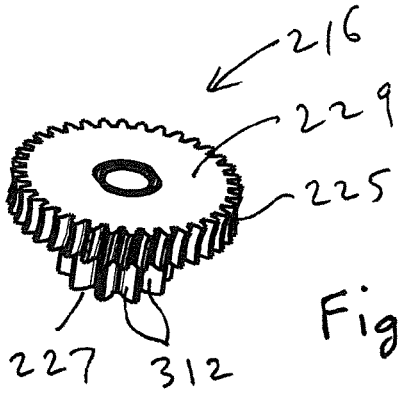
Figure 72:
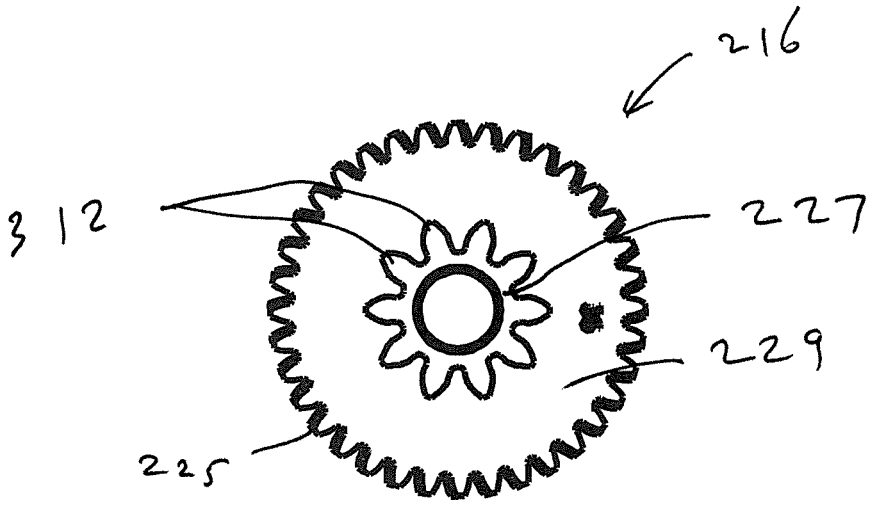
Figure 73:
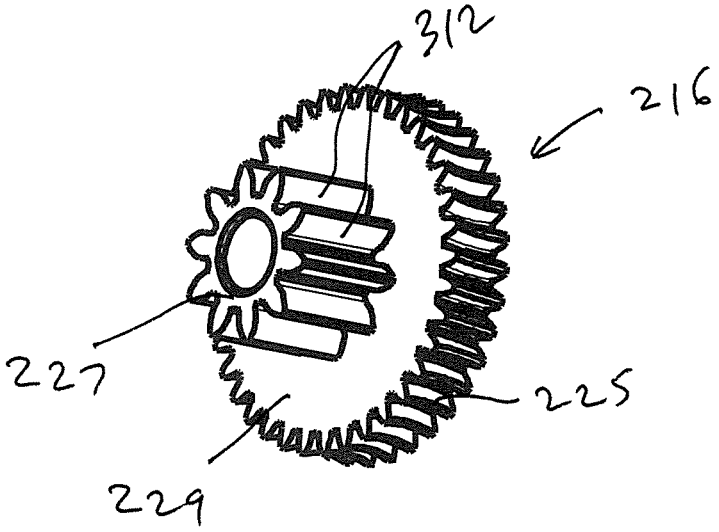
Figure 74:
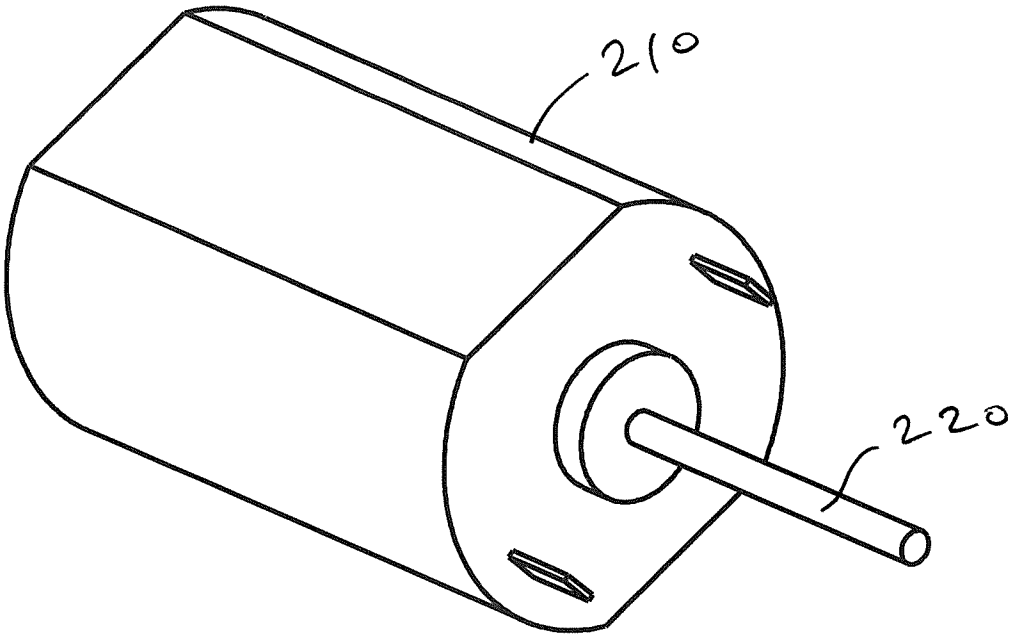
FIG. 74 is a view of the motor of a latch according to the present invention.
Figure 76:
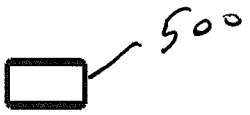
FIGS. 75-76 are views of the bushing for supporting the end of the motor shaft of a latch according to the present invention.
Figure 75:
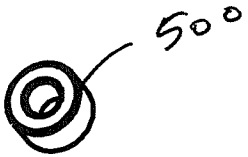
Figure 77:
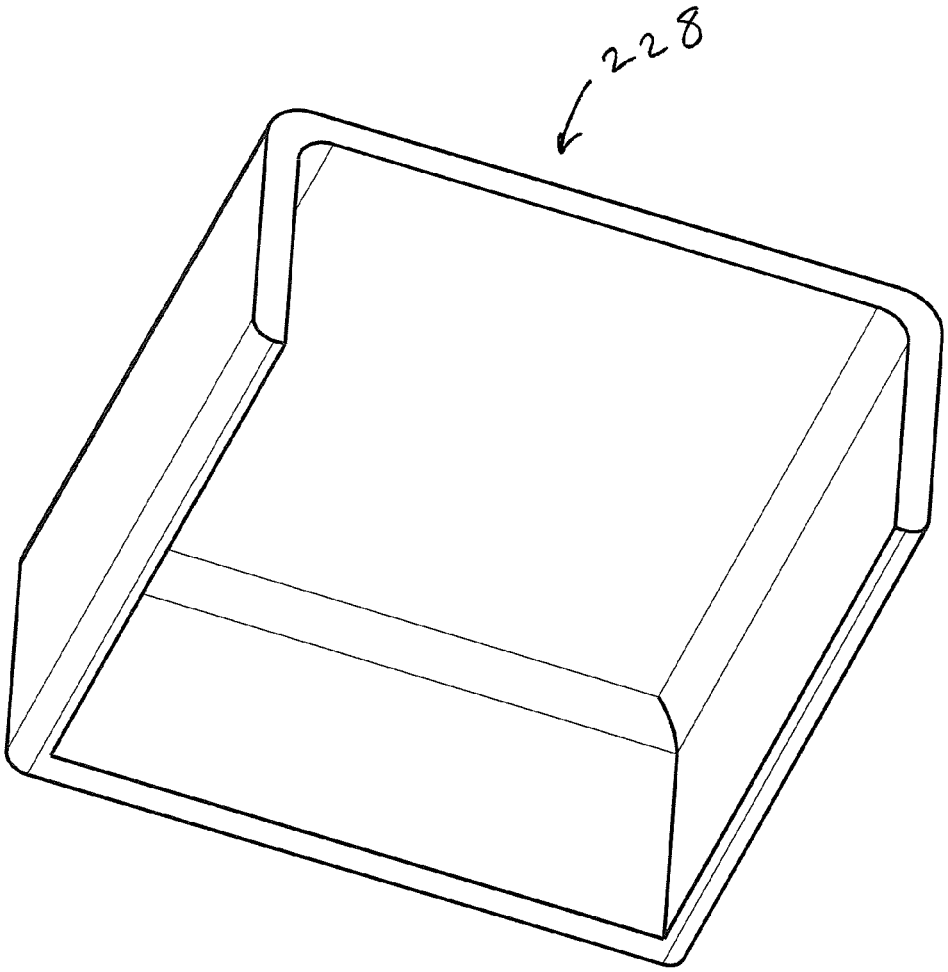
FIG. 77 is a view of the motor cover of a latch according to the present invention.
Figure 78:
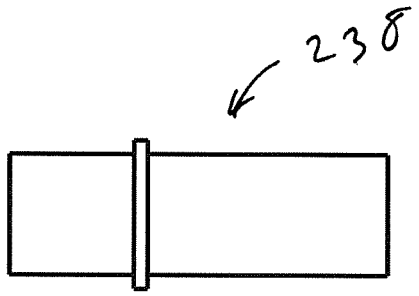
FIGS. 78-79 are views of the pawl axle of a latch according to the present invention.
Figure 79:
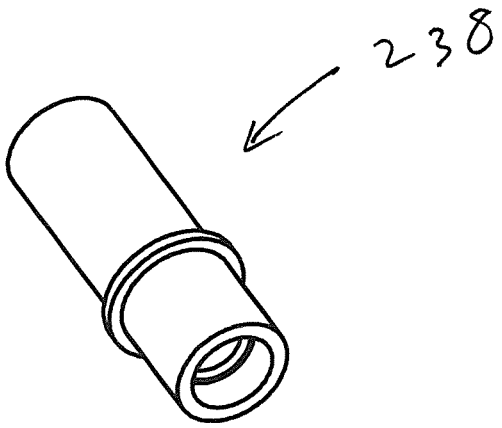
Figure 81:
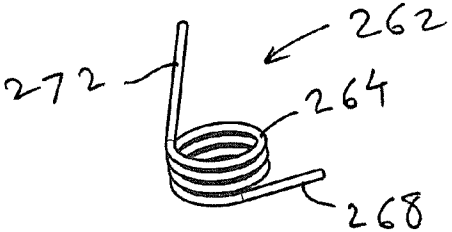
FIGS. 80-83 are views of the pawl torsion spring of a latch according to the present invention.
Figure 83:
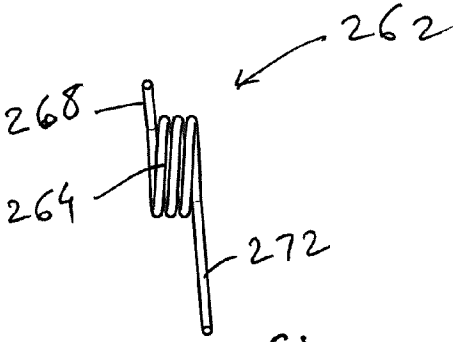
Figure 80:
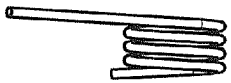
Figure 82:
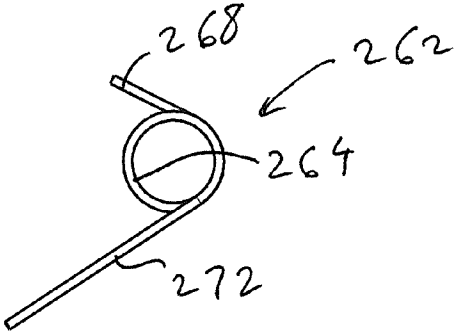
Figure 85:
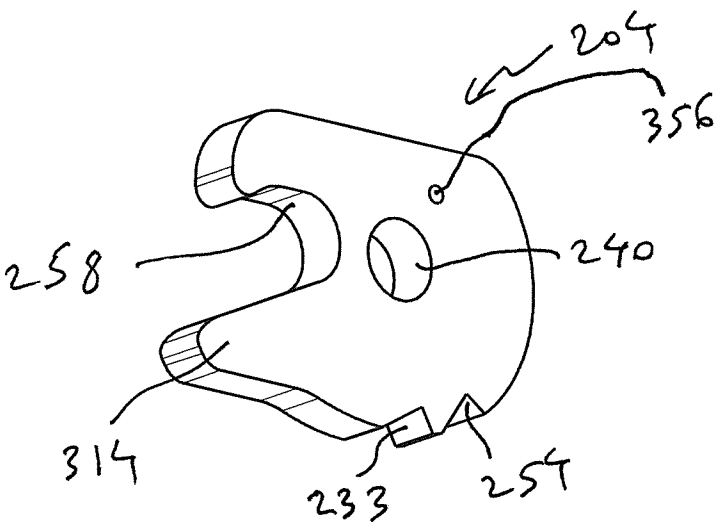
FIGS. 84-86 are views of the pawl of a latch according to the present invention.
Figure 84:
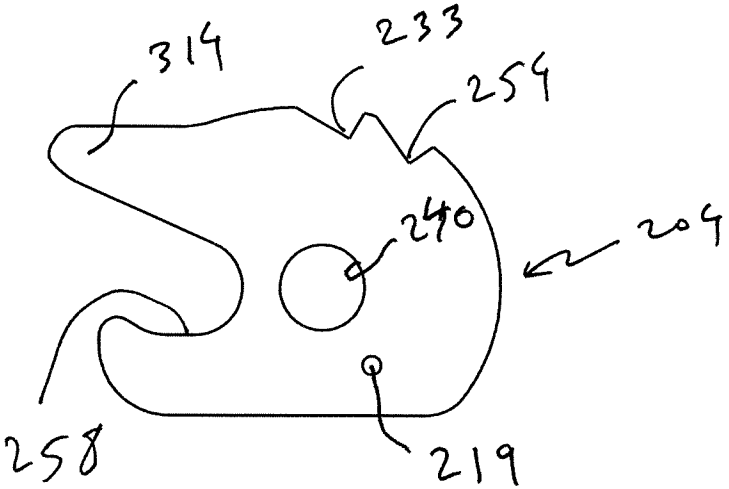
Figure 86:
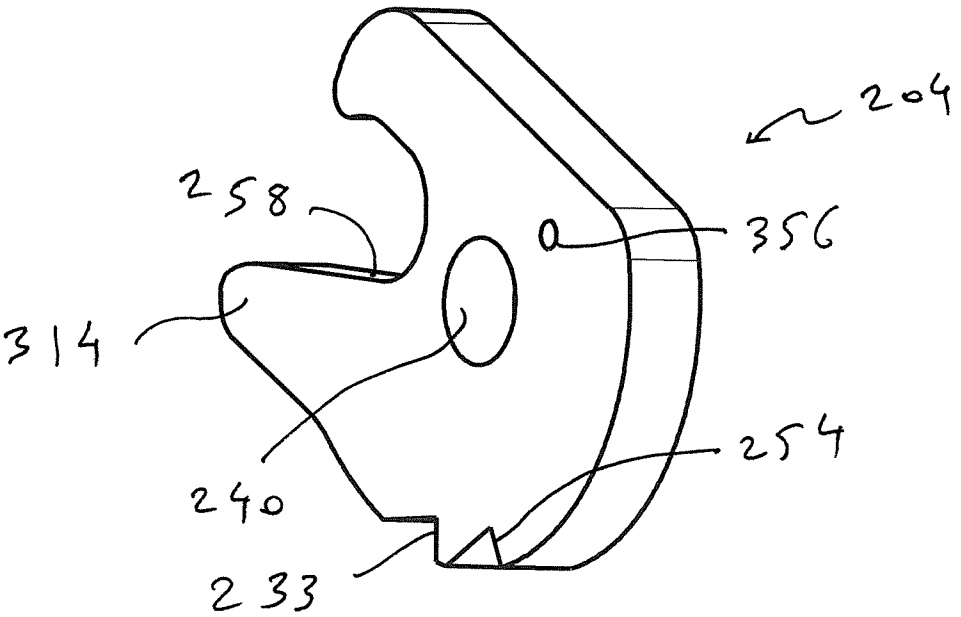
Figure 87:
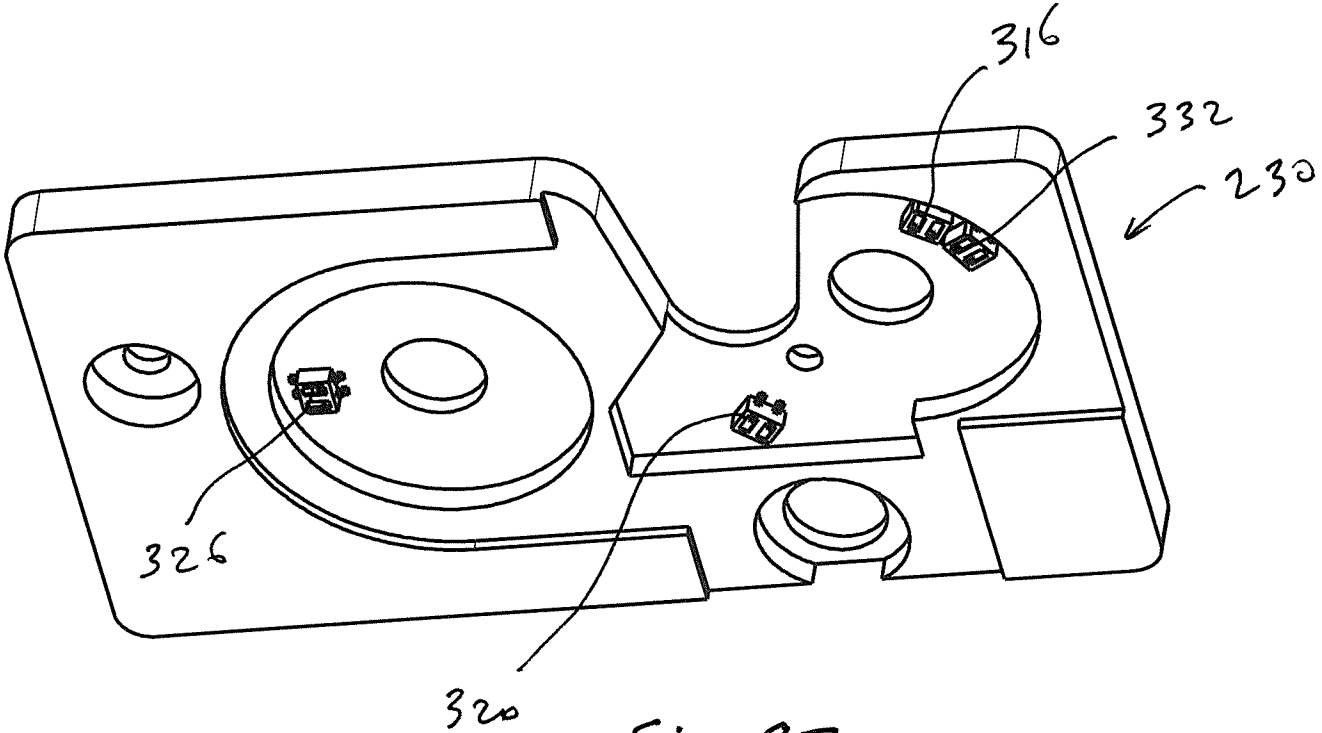
FIGS. 87-88 are views of the circuit board of a latch according to the present invention.
Figure 88:
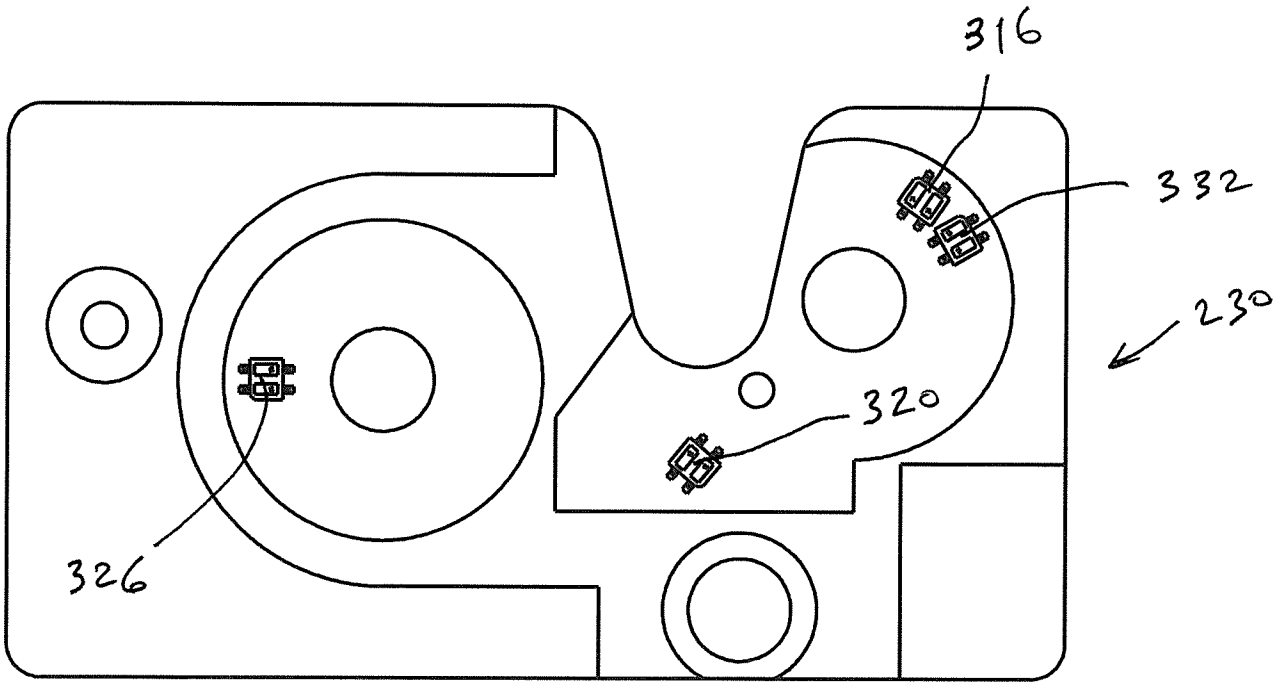
Figure 89:
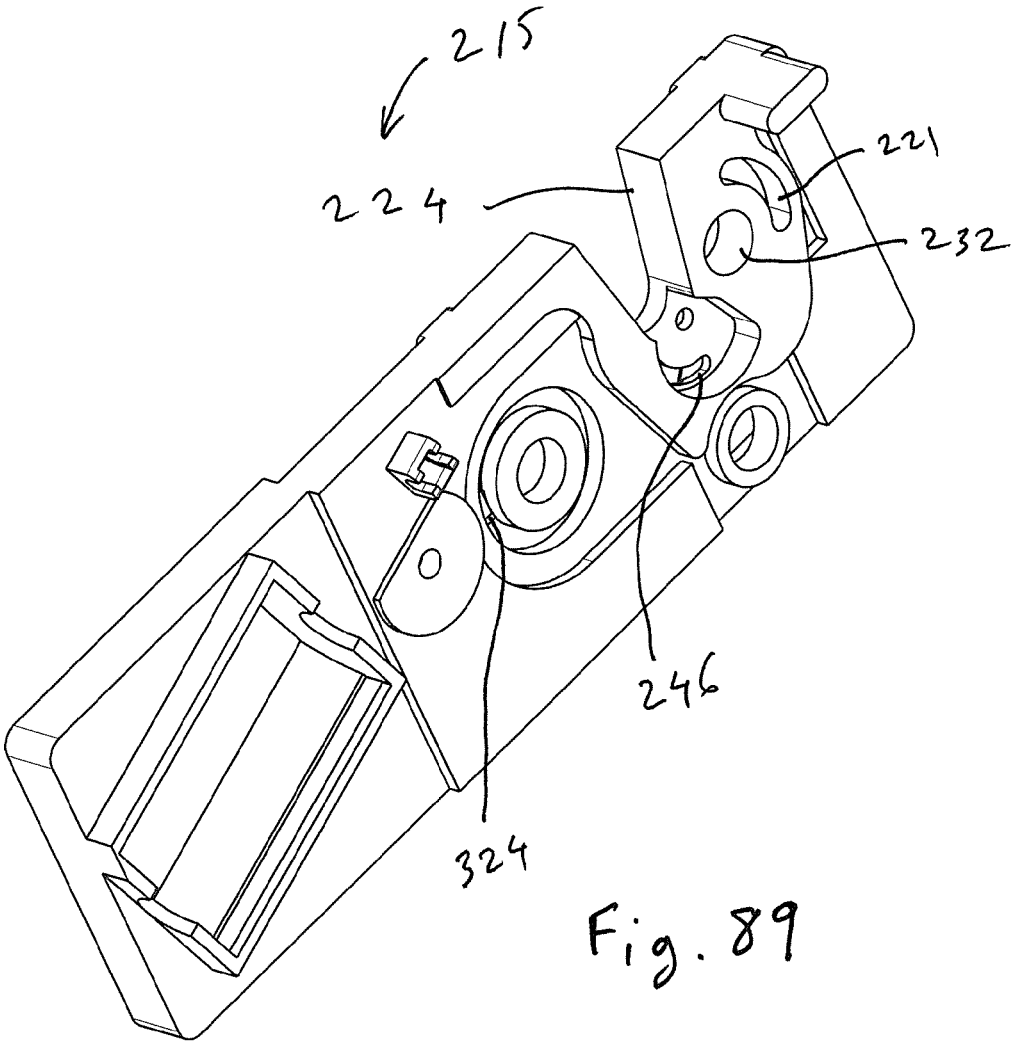
FIGS. 89-92 are views of the support plate of a latch according to the present invention.
Figure 90:
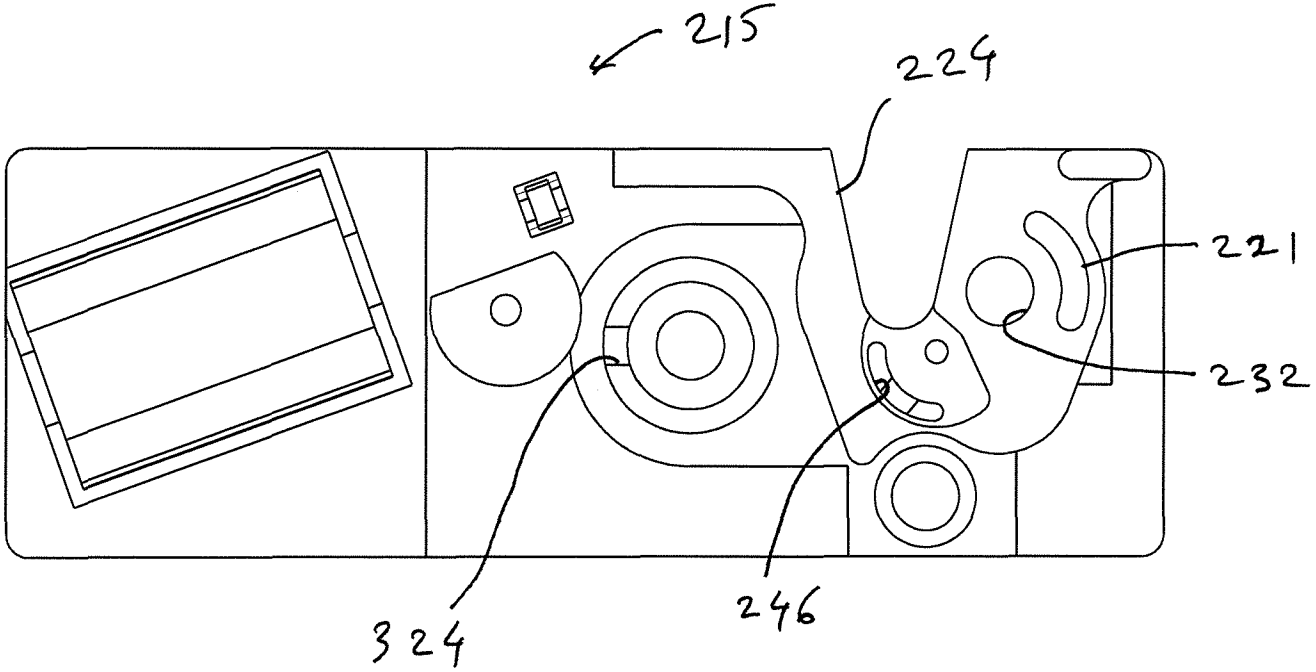
Figure 91:
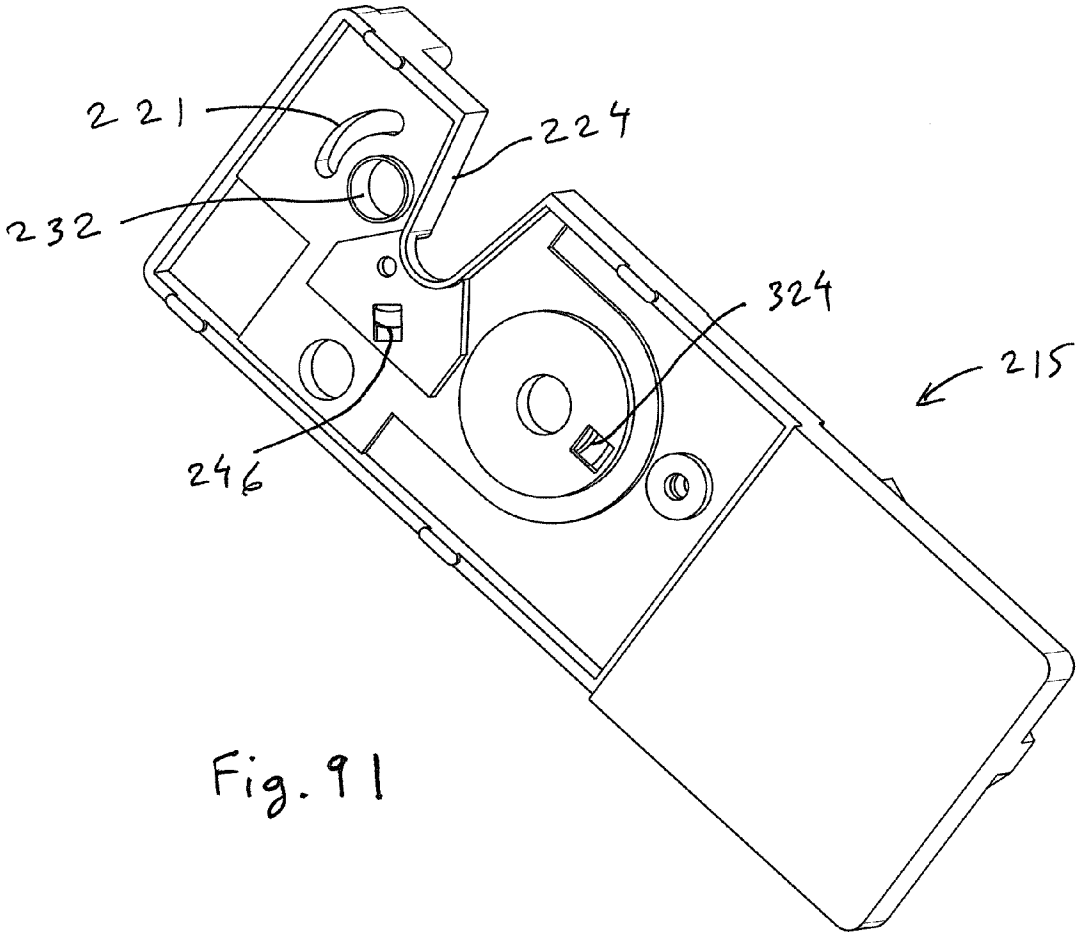
Figure 92:
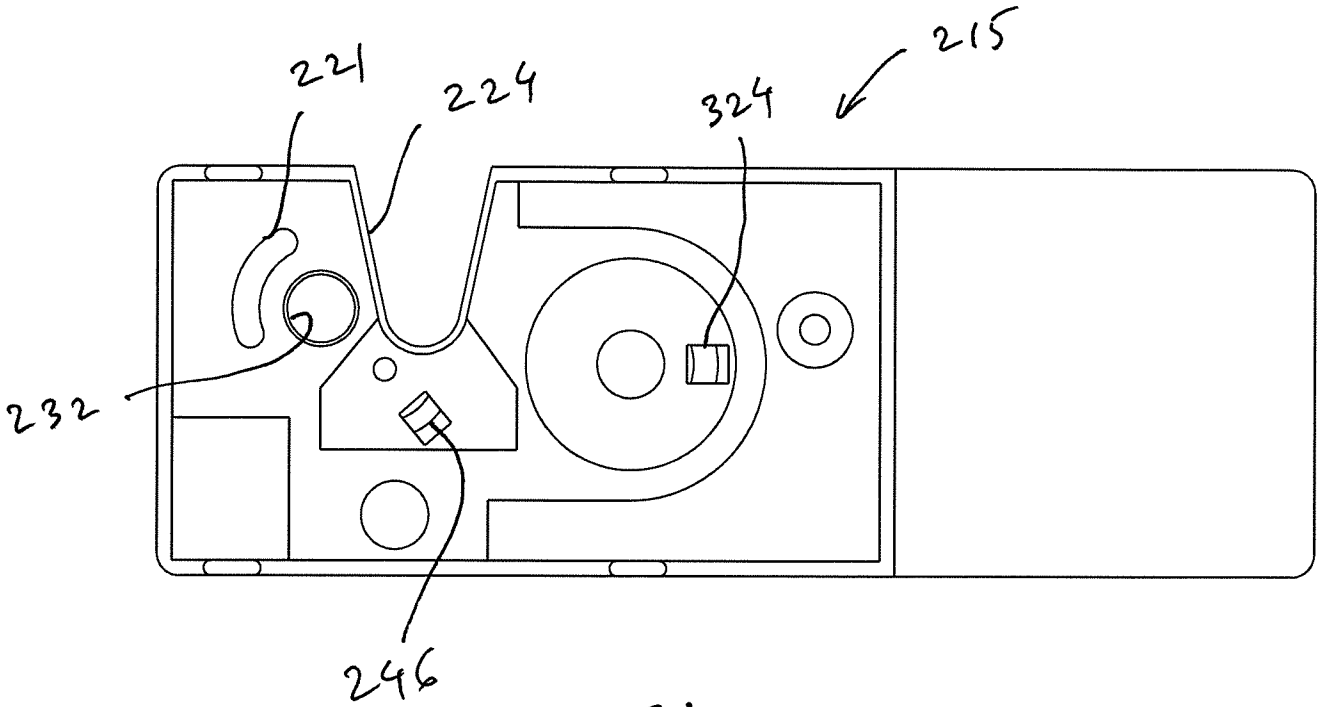
Figure 94:
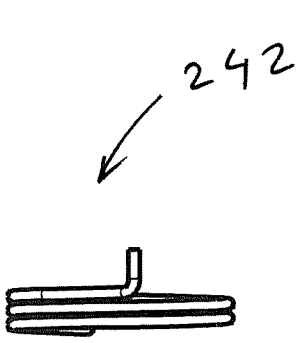
FIGS. 93-94 are views of the torsion spring of the trigger actuator lever of a latch according to the present invention.
Figure 93:
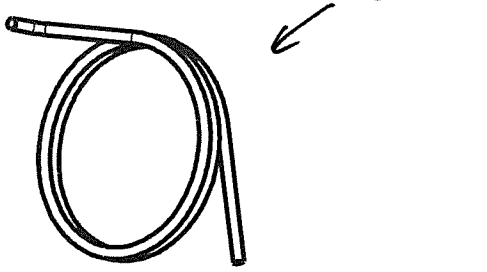
Figure 97:
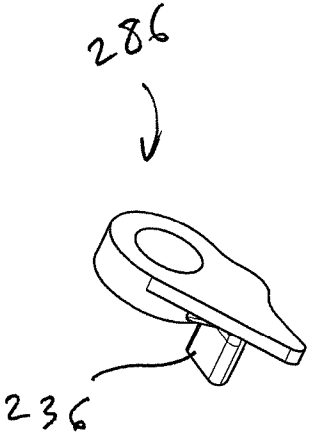
FIGS. 95-97 are views of the trigger actuator lever of a latch according to the present invention.
Figure 96:
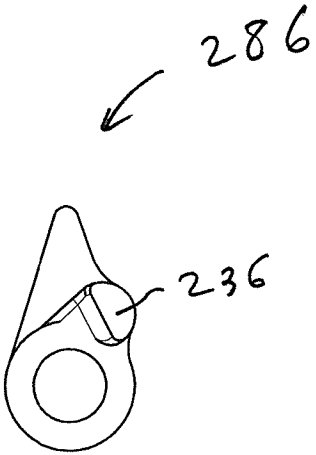
Figure 95:
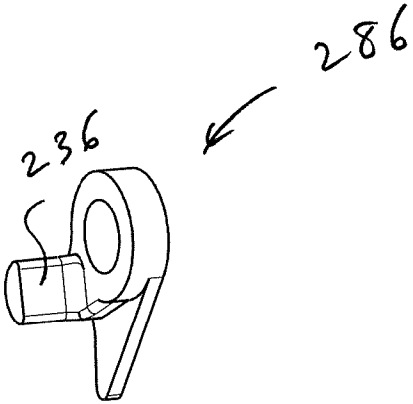
Figure 99:
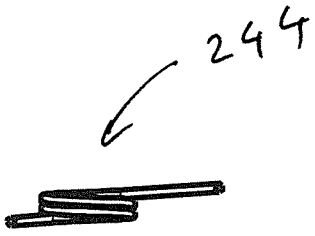
FIGS. 98-99 are views of the torsion spring of the striker detector of a latch according to the present invention.
Figure 98:
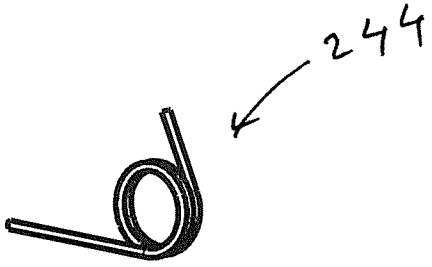
Figure 100:
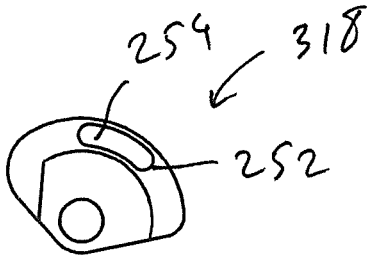
FIGS. 100-104 are views of the striker detector of a latch according to the present invention.
Figure 101:
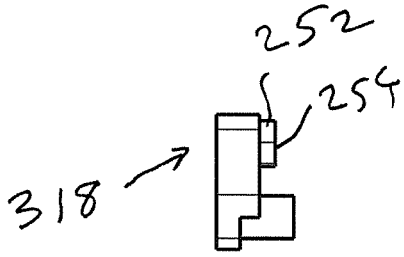
Figure 102:
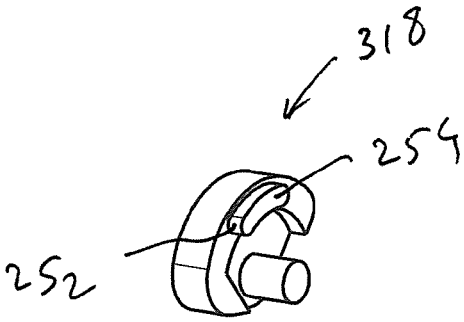
Figure 103:
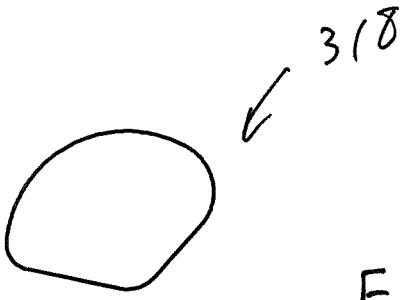
Figure 104:
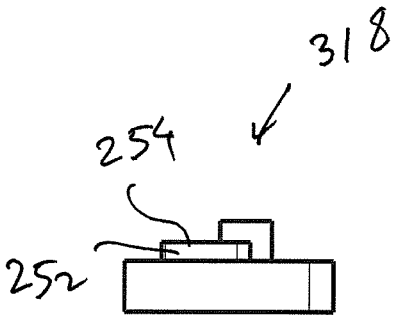
Figure 105:
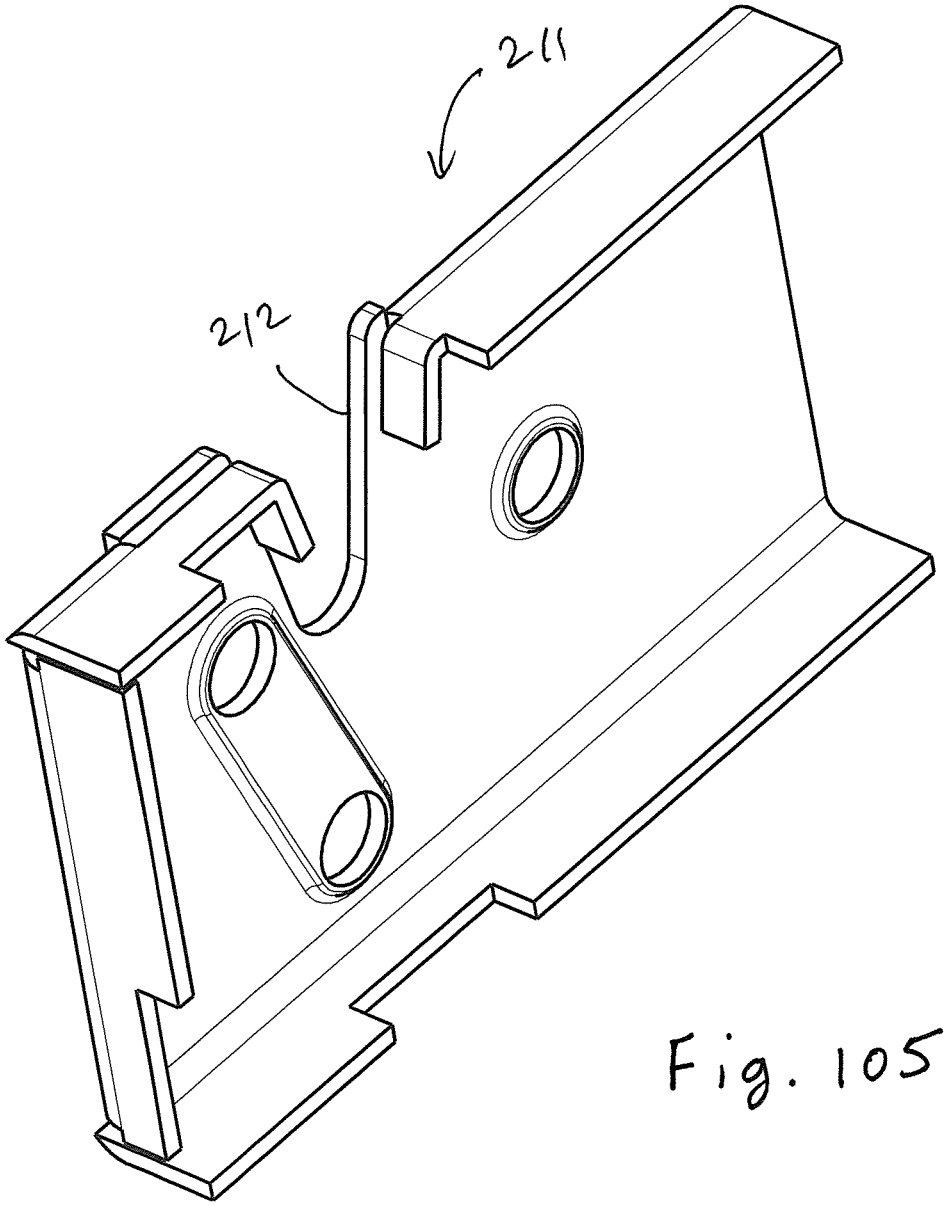
FIGS. 105-106 are views of the first portion of the housing of a latch according to the present invention.
Figure 106:
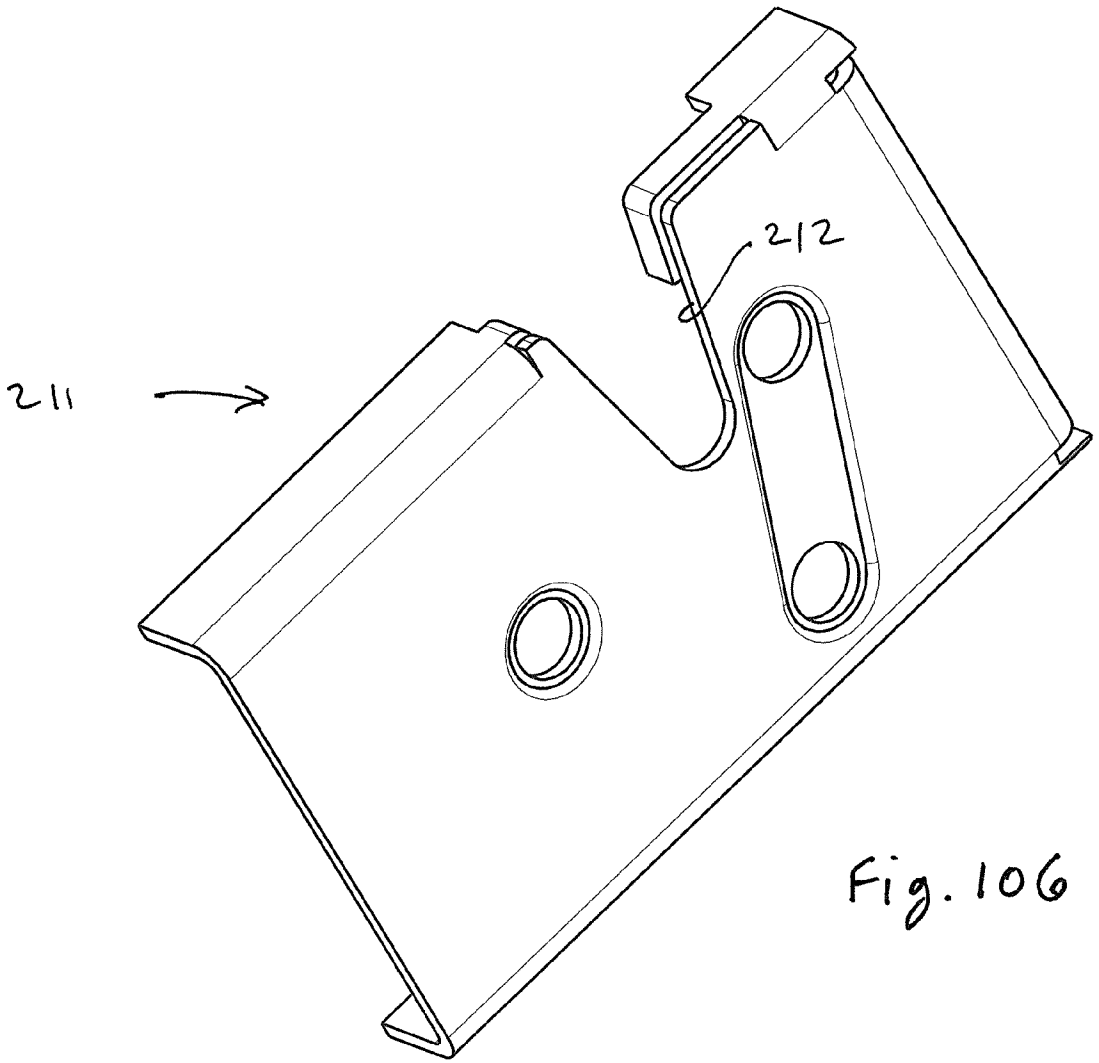
Figure 108:
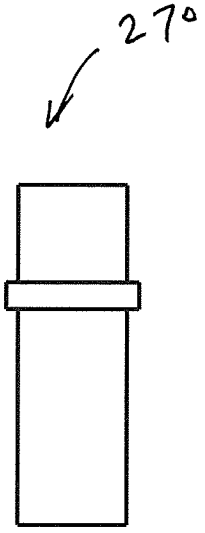
FIGS. 107-108 are views of the trigger axle of a latch according to the present invention.
Figure 107:
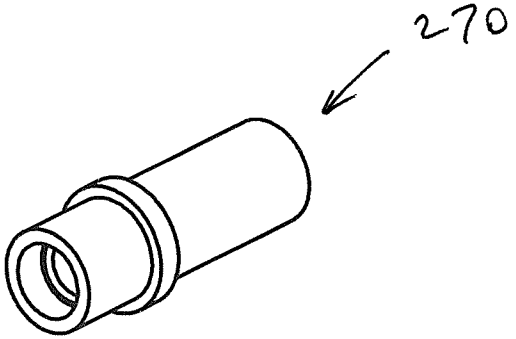
Figure 109:
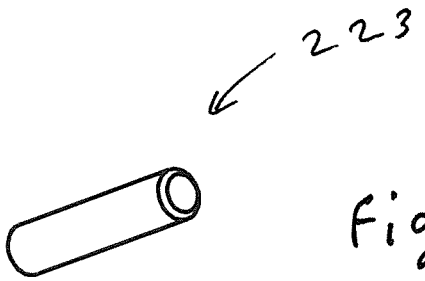
FIGS. 109-110 are views of the combination gear axle of a latch according to the present invention.
Figure 110:
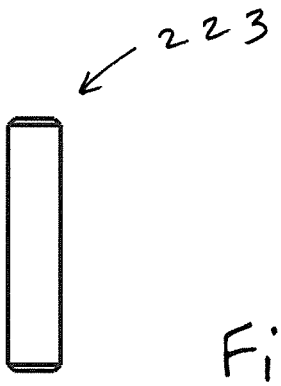

The trigger 206 is pivotally supported on the support plate 215. The pivot axis of the trigger 206, as defined by the trigger axle 270, is parallel to the pivot axis or axis of rotation of the pawl 204. Furthermore, the pivot axis of the trigger 206, as defined by the trigger axle 270, is spaced apart from the pivot axis or axis of rotation of the pawl 204. The trigger 206 is pivotally movable between any one of a first engaged position (shown in FIGS. 19-26) and a second engaged position (shown in FIGS. 29-37) and a disengaged position (shown in FIGS. 17, 18, and 39) and is spring biased toward the first and second engaged positions. In the illustrated embodiment, the first and second engaged positions of the trigger 206 may be coincident, but they need not be so. A trigger spring 288 is provided for biasing the trigger 206 toward the first and second engaged positions. In other words, the trigger spring 288 biases the trigger 206 toward engagement with the pawl 204. The trigger spring 288 is a torsion spring and has a coiled portion 274, a first arm 276, and a second arm 278. The trigger spring 288 is installed on the support plate 215 with the coiled portion 274 of the torsion spring 288 surrounding the trigger axle 270. The arm 276 of the torsion spring 288 engages the trigger 206. The second arm 278 of the torsion spring 288 engages the support plate 215 or the housing 202.

The trigger 206 has a lever arm 284 that extends on one side of the pivot axis of the trigger 206 as defined by the trigger axle 270. The trigger axle 270 passes through a hole in the trigger 206. The trigger 206 has a tooth 290 that engages the first notch 254 of the pawl 204 to hold or retain the pawl 204 in the first latched position relative to the support plate 215. Also, the tooth 290 of the trigger 206 engages the second slot 233 of the pawl 204 to hold or retain the pawl 204 in the second latched position relative to the support plate 215.

The trigger 206 has associated with it a trigger actuator lever 286. The trigger actuator lever 286 is mounted within the housing 202 so that it can rotate about a common axis with the trigger 206. The trigger actuator lever 286 has a one-way rotation stop 236. The trigger actuator lever 286 is provided with a torsion spring 242 that biases the one-way rotation stop 236 into engagement with the trigger 206. When the cam gear 218 starts from its initial starting position (see FIGS. 13-15) and rotates in the first or forward direction until the second cam 205 engages the trigger actuator lever 286, continued rotation of the cam gear 18 in the first direction moves the one-way rotation stop 236 away from or out of engagement with the trigger 206 such that the trigger actuator lever 286 can rotate out of the way of the second cam 205 without affecting the engagement of the trigger 206 with the pawl 204. This allows the second cam 205 to slide past the trigger actuator lever 286 without affecting the position of the trigger 206, which must be positioned to engage the notches 254 and 233 as the cam lobe 207 of the first cam 203 moves the pawl from the first latched position to the second latched position as seen in FIGS. 26-30.

During the opening operation of the latch 200, the cam gear 218 starts from its initial starting position (see FIGS. 32-35) and rotates in the second or reverse direction until the second cam 205 engages the trigger actuator lever 286. Continued rotation of the cam gear 18 in the second direction moves the one-way rotation stop 236 into engagement with the trigger 206 such that the trigger actuator lever 286 cannot rotate relative to the trigger 206 with the result that the second cam 205 pushes the trigger 206 out of engagement with the pawl 204 so as to release the pawl 204 for rotation to the unlatched position as illustrated in FIGS. 36-49.

During the opening operation of the latch 200, the cam gear 218 starts from its initial starting position (see FIGS. 32-33) and rotates in the second or reverse direction until the first cam 205 disengages the trigger from the pawl 204 to thus release the pawl 204 for rotation to the unlatched position. At this same time the cam lobe 207 of the first cam 203 can engage the elongated prong 314 of the pawl 204 to assist the pawl 204 toward the unlatched position if the progress of the pawl 204 under spring bias is impeded by, for example, a sticky door seal. The length of the second cam 205 is selected such that the trigger 206 is disengaged from the pawl 204 during opening before the first cam 203 can engage the pawl 204 and such that the trigger 206 will remain disengaged from the pawl 204 until the first notch 254 is beyond any possibility of engagement with the trigger 206.

A striker detector 318 is pivotally supported within the housing 202 by the support plate 215. The striker detector 318 is provided with a torsion spring 244 that biases the striker detector 318 into occupying a first position coincident with the position of the rod-shaped portion 234 of the striker 308 when the striker 308 is captured by the pawl 204 and the pawl 204 is in the second latched position. Accordingly, when the striker 308 is captured by the pawl 204 and the pawl 204 is in the second latched position, the striker detector 318 is pushed to a second position by the striker 308. A portion of the striker detector 318 registers with a third window 246 provided in the support plate 215, at least when the striker detector is in its second position, to allow a sensor 320 to detect when the striker detector 318 is in its second position, which corresponds to the striker 308 being captured by the pawl 204 and the pawl 204 being in the second latched position. The sensor 320 generates a signal to the latch control circuit 235 when the striker detector 318 is in its second position to thus allow the latch control circuit 235 to detect whether or not the striker 308 is in the proper position when the pawl 204 is in the second latched position. In the illustrated example, the third window 246 is in the form of an arcuate, elongated slot. The sensor 320 is provided on the circuit board 230.

In the illustrated embodiment, the sensors 316, 320, 326, and 332 are of the opto-electronic type. Each sensor 316, 320, 326, and 332 includes a light emitter and a light detector. The pawl 204 is provided with a reflective surface at the end of the pin 219, which is inserted into a hole in the pawl 204. When the pawl 204 is in the first and second latched positions or any position therebetween, the reflective surface at the end of the pin 219 registers with the first window 221. When the pawl 204 is in the first latched position, the reflective surface at the end of the pin 219 registers with the first sensor 332 to generate a signal to the latch control circuit 235 indicating that the pawl 204 is in the first latched position. When the pawl 204 is in the second latched position, the reflective surface at the end of the pin 219 registers with the second sensor 316 to generate a signal to the latch control circuit 235 indicating that the pawl 204 is in the second latched position.

The cam lobe 207 has a raised platform 348 that is provided with a reflective surface 350. When the cam gear 218 is in the initial or starting position, the reflective surface 350 registers with the second window 324. When the cam gear 218 is in the initial or starting position, the reflective surface 350 registers with the third sensor 326 to generate a signal to the latch control circuit 235 indicating that the cam gear 218 is in the initial or starting position.

The striker detector 318 has a raised platform 352 that is provided with a reflective surface 354. When the striker detector 318 is in the second position, the reflective surface 354 registers with the third window 246. When the striker detector 318 is in the second position, the reflective surface 354 registers with the fourth sensor 320 to generate a signal to the latch control circuit 235 indicating that the striker detector 318 is in the second position.

The reflective surfaces can be provided by bright or reflective paint or metallization on the corresponding surfaces. It is possible to use other sensors such as Hall effect sensors or microswitches in place of the opto-electronic sensors used in the illustrative embodiment. If Hall effect sensors are used the reflective surfaces would be replaced by magnets embedded in the corresponding parts. If microswitches are used, all three windows would have to be in the shape of elongated arc-shaped slots with pins attached to the corresponding parts passing through the support plate 215 to actuate the microswitches on the circuit board 230.

In the illustrated embodiment, the end of the arm 268 of the pawl spring 262 is intended to be bent down into the opposite side of the same hole 356 in the pawl 204 that is occupied in part by the reflective pin 219. Alternatively, the pin 219 can be made long enough to project out of the opposite end of the hole 356 in the pawl 204 for engagement by the arm 268 of the pawl spring 262.

Figure 23:
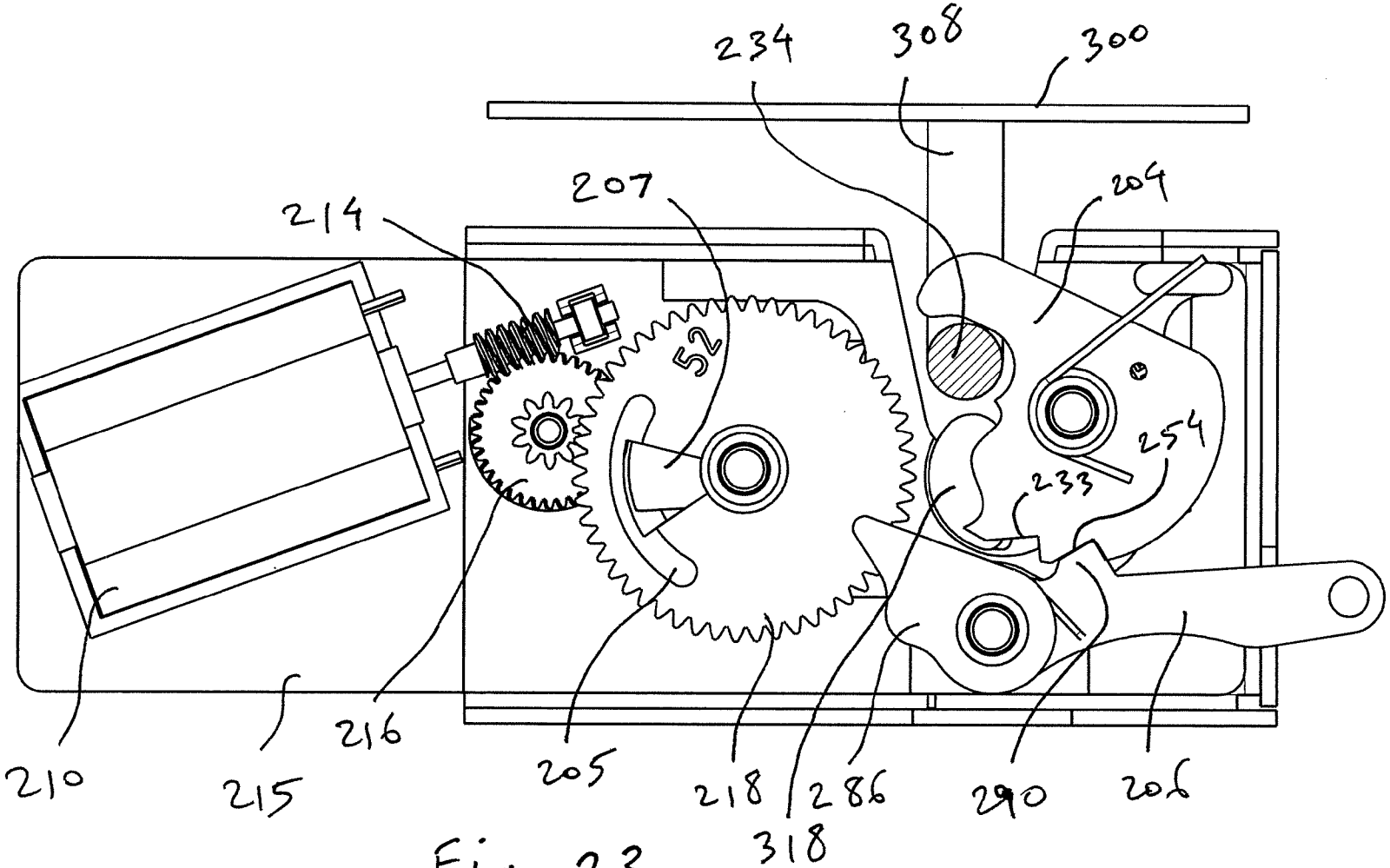
FIGS. 23-25 are fragmentary views of a latch according to the present invention showing the pawl in the first latched position with the cover removed to reveal internal detail.
Figure 24:
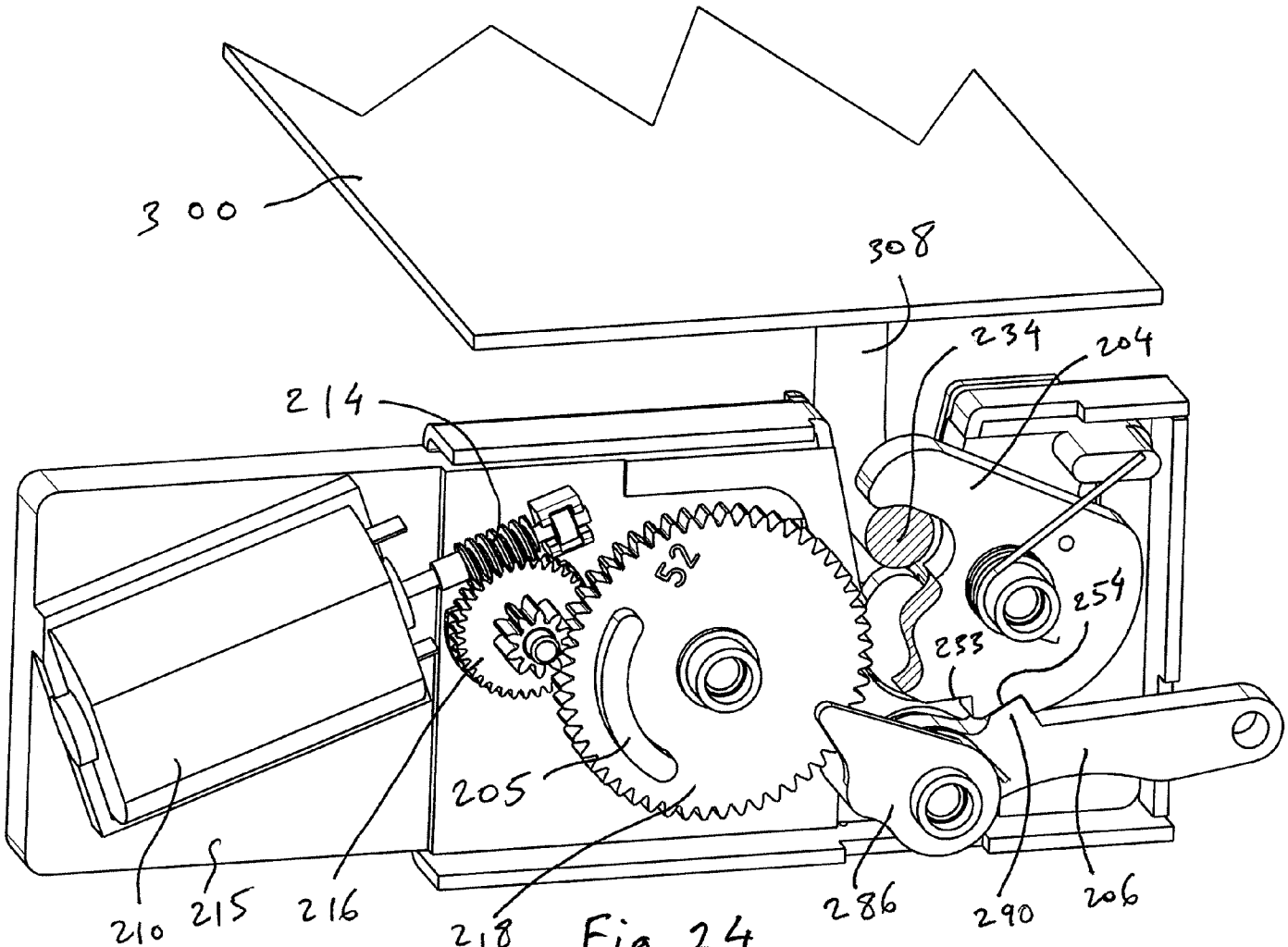
Figure 25:
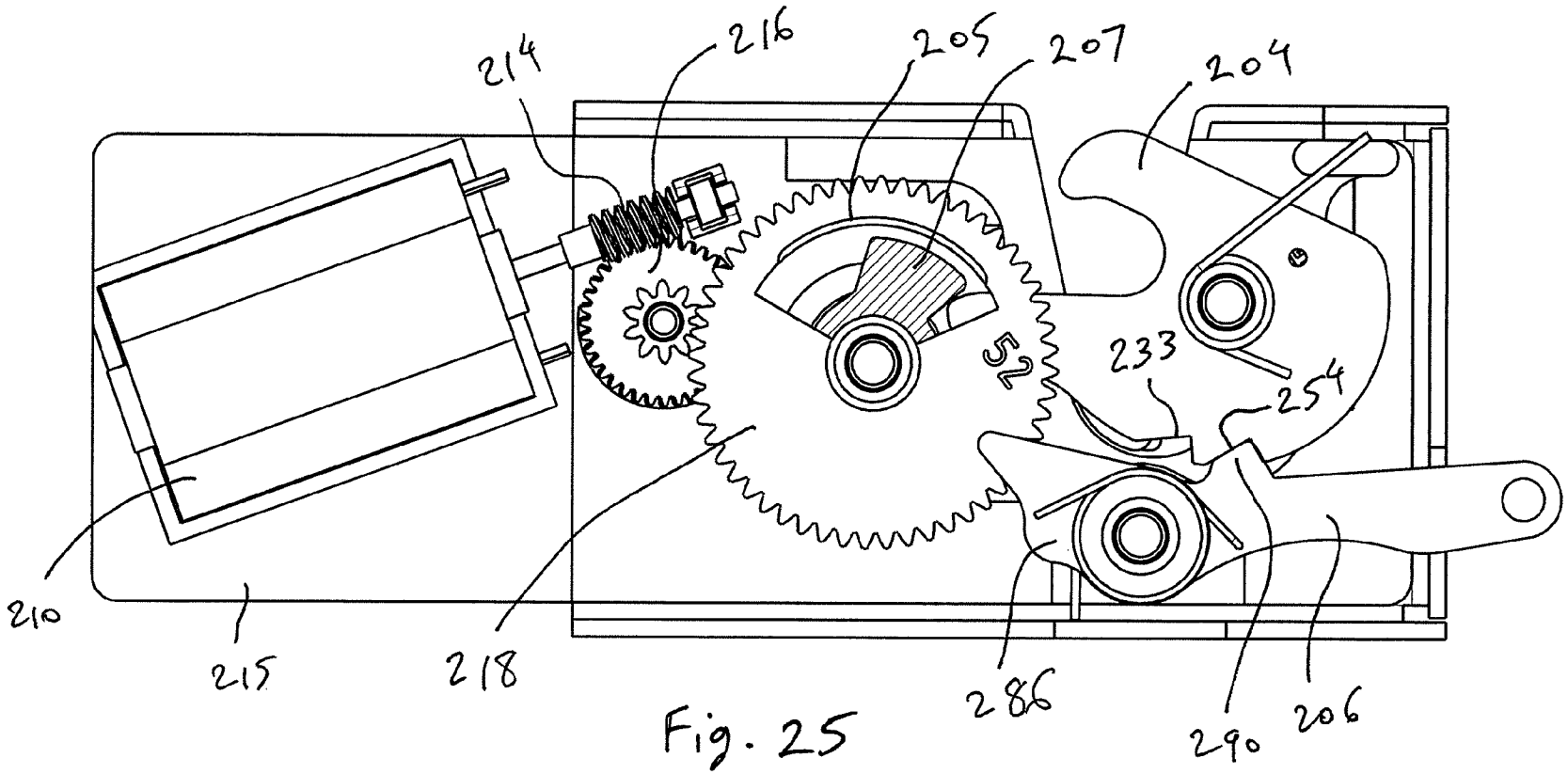
Figure 26:
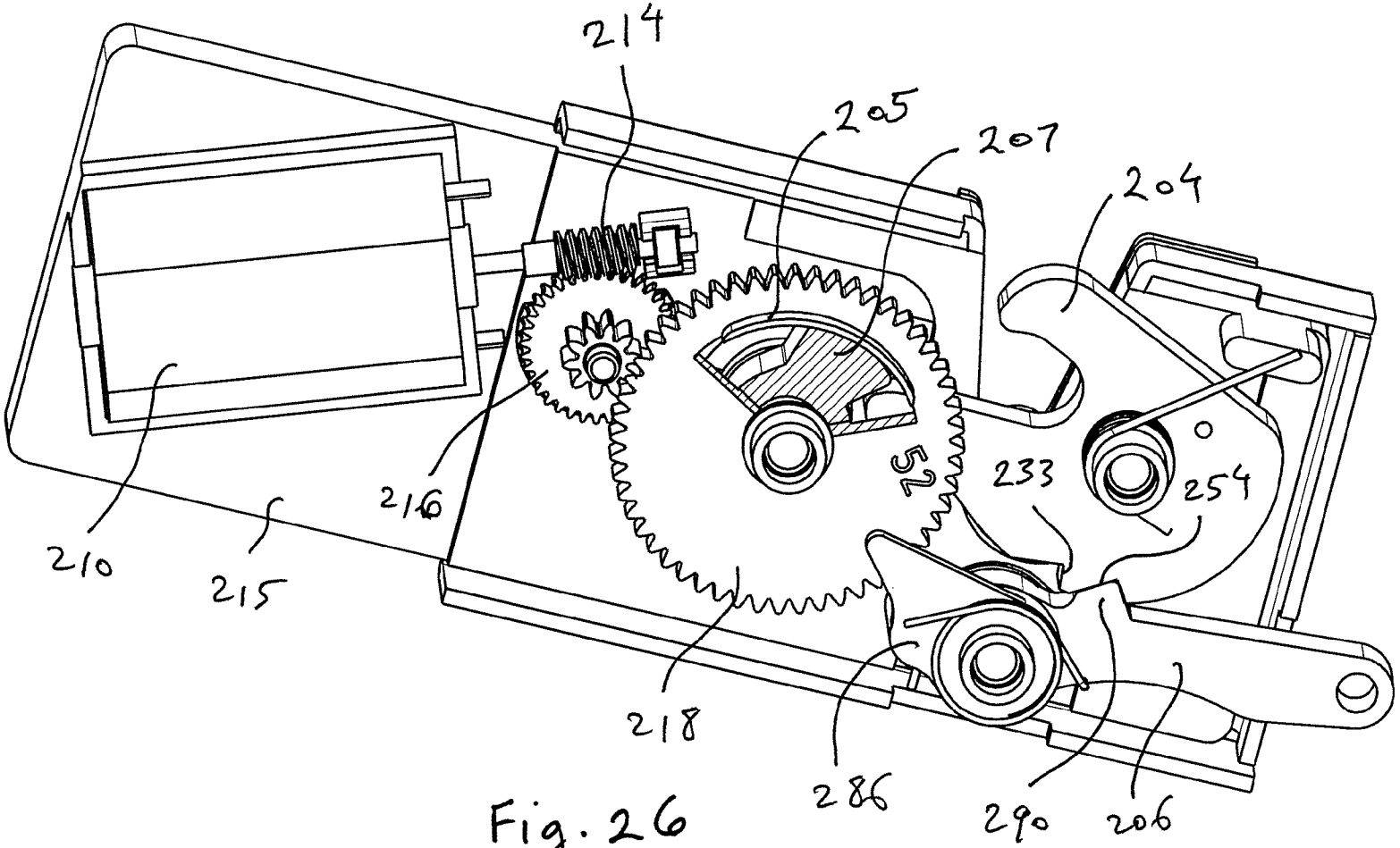
FIGS. 26-35 are a sequence of views of a latch according to the present invention showing the pawl moving from the first latched position to the second latched position and the cam gear returning to its starting position with the cover removed to reveal internal detail.
Figure 27:
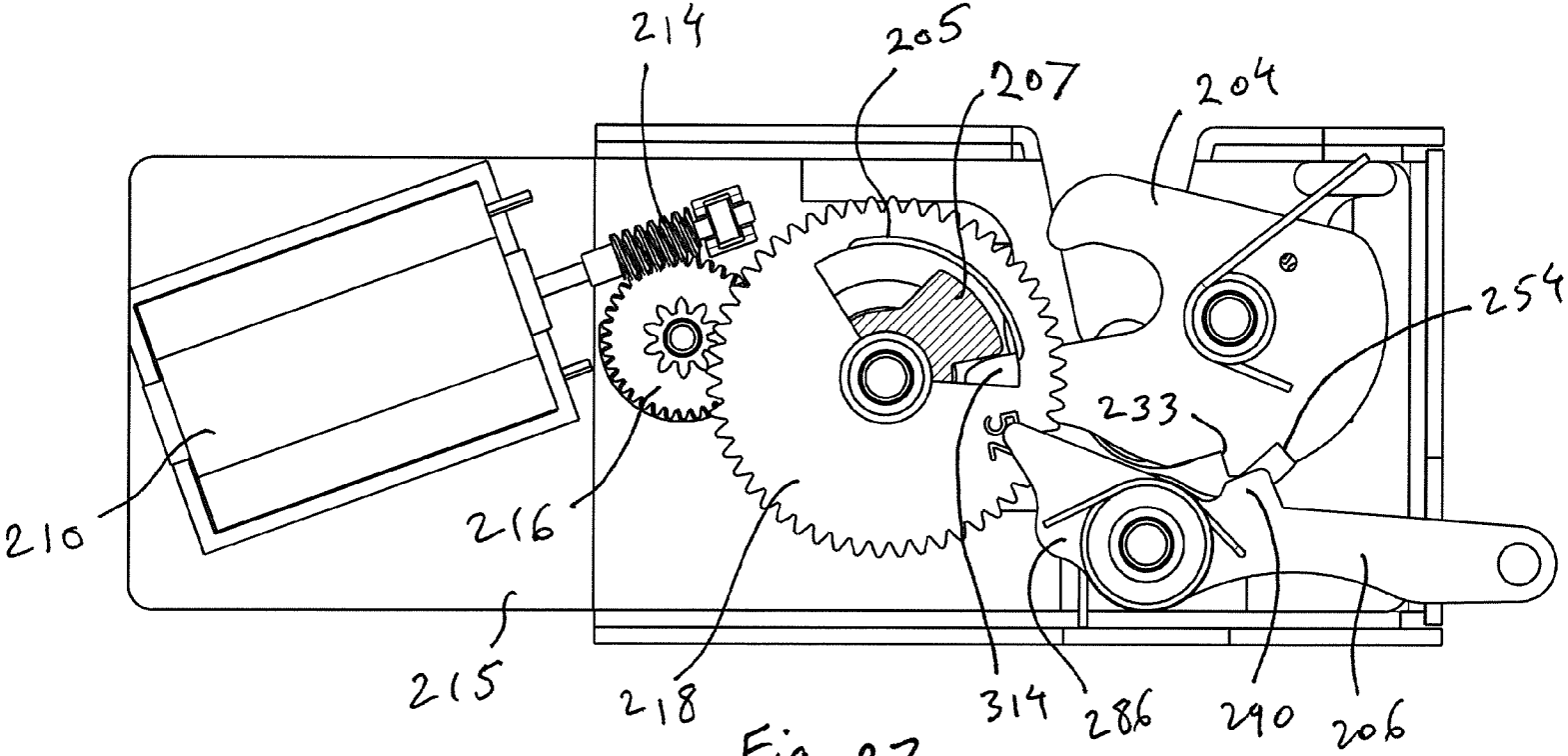
Figure 28:
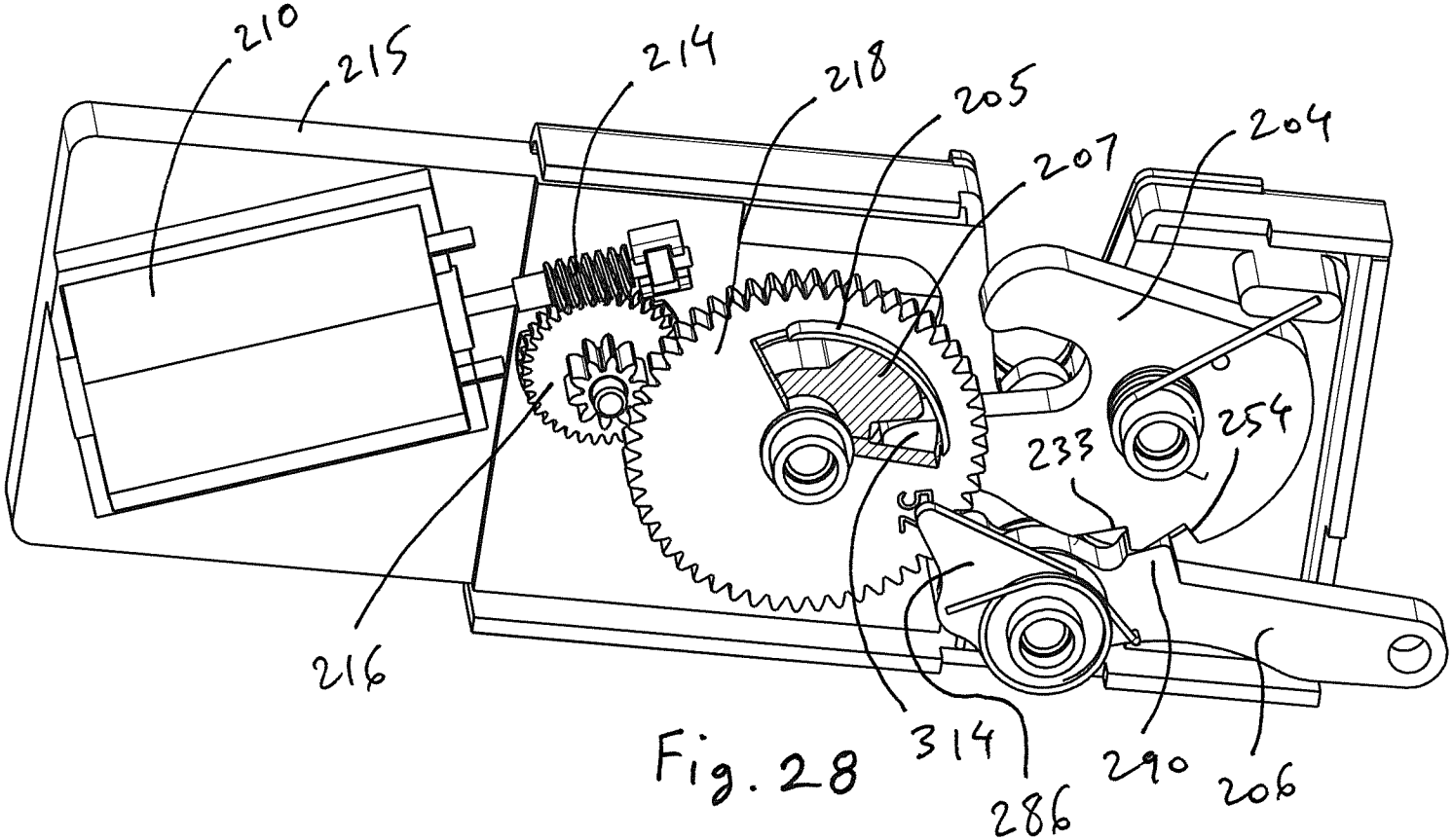
Figure 29:
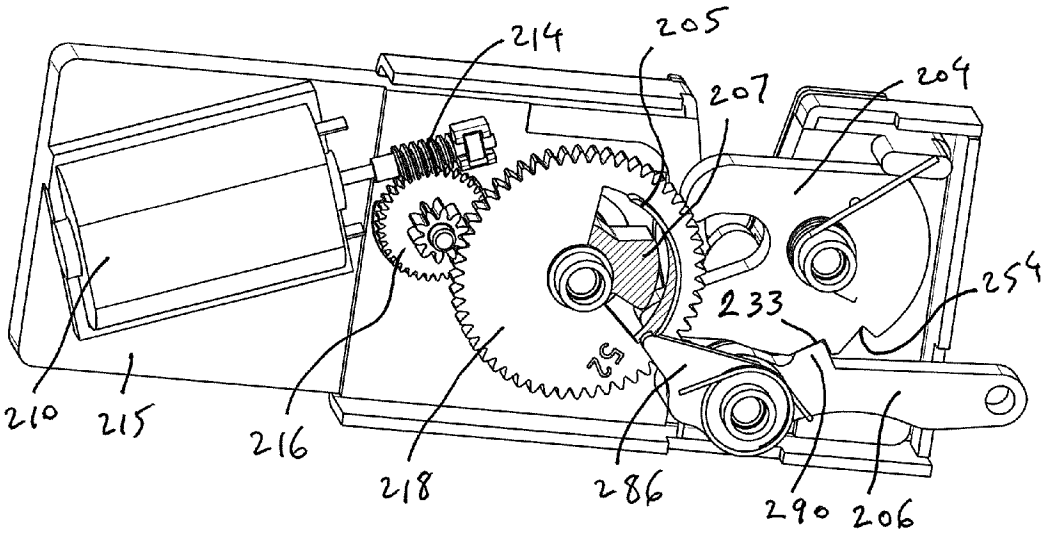
Figure 30:
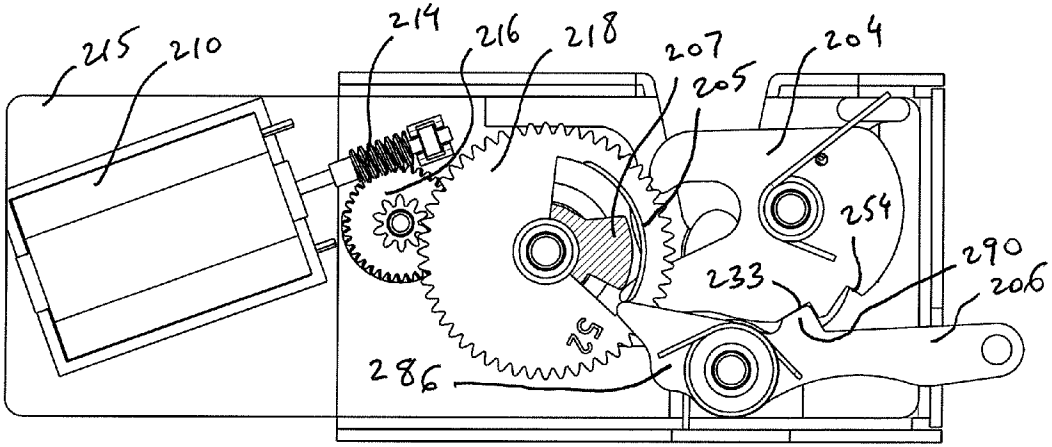

The operation of the latch 200 will now be explained. With the latch initially in the fully unlatched configuration of FIGS. 13-16, as the panel 300 is moved to the closed position, the rod-shaped portion 234 of the striker 308 will be positioned or caught in the pawl slot 258 with the pawl 204 being moved to the first latched position relative to the support plate 215 as a result of the contact of the striker 308 with the pawl 204. The pawl 204 is now in the first latched position relative to the support plate 215 as illustrated in FIGS. 21-26. The trigger 206 is in its first engaged position relative to the support plate 215 and retains the pawl 204 in its first latched position. The cam lobe 207 of the cam gear 218 is in its initial position shown in FIGS. 23-24 where it does not contact the pawl 204. As shown in FIG. 23, when the pawl 204 reaches the first latched position a pin 219 carried by the pawl communicates the position of the pawl 204 through the arc-shaped slot 221 in the support plate 215 to the sensor 332 that is mounted on the circuit board 230 on the side of the support plate 215 opposite the pawl 204. Once the sensor 332 detects that the pawl 204 is in the first latched position, a signal is generated to an electronic latch control circuit 235 (shown diagrammatically), that may be located remotely or provided on the circuit board 230, that controls the current supplied to the motor 210, and in response the control circuit 235 causes the supply of electrical current to the motor 210 with a first polarity to cause the rotation of the cam gear 218 in a first direction from its start position illustrated in FIGS. 23-30 to the position illustrated in FIGS. 29-30. During this movement of the cam gear 218, the cam lobe 207 of the cam gear 218 engages the elongated prong 314 of the pawl 204 and thus rotates the pawl 204 to its second latched position relative to the housing 202. At this point the trigger 206 engages the pawl 204 to retain the pawl 204 in the second latched position. The motor 210 continues to be energized until the cam gear 218 rotates back to its initial or starting position. At that point, the sensor 326 detects that the cam gear 218 is in its initial position and signals the control circuit 235 to shut off electrical current to the motor 210, which stops further rotation of the cam gear 218. The latch 200 now locks the panel 300 in its closed position. As the pawl 204 is rotated to its second latched position, a sealing gasket (not shown) is compressed to form a seal between the panel 300 and opening of the compartment closed off by the panel 300.

If normal closing is blocked, for example by items being caught between the panel 300 and the compartment opening, after a predetermined time without a signal from the sensor 326, the control circuit 235 reverses the current to the motor to disengage the trigger 206 from the pawl 204 by the reverse movement of the second cam 205 and the panel 300 is released and the latch 200 is returned to the initial fully unlatched configuration.

To open the latch 200 the motor 210 is energized by the user using a remotely located switch (not shown). The cam gear 218 rotates from the initial position of FIGS. 32-33 in a second direction, opposite the first direction, to bring the second cam 205 into contact with the trigger actuator lever 286 as shown in FIGS. 36-39. The rotation of the cam gear 218 in the second or reverse direction causes the second cam 205, acting via the trigger actuator lever 286, to rotate the trigger 206 out of engagement with the pawl 204 in order to release the pawl 204 for rotation to the unlatched position as shown in FIGS. 38-43. The striker 308 is now released and the panel 300 can be opened. The motor 210 remains energized until the cam gear 218 is once again in its initial position as detected by the sensor 326. When the sensor 326 senses that the cam lobe 207, and consequently the cam gear 218, has returned to its initial position, the sensor 326 signals the control circuit 235 to stop energizing the motor.

Figure 31:
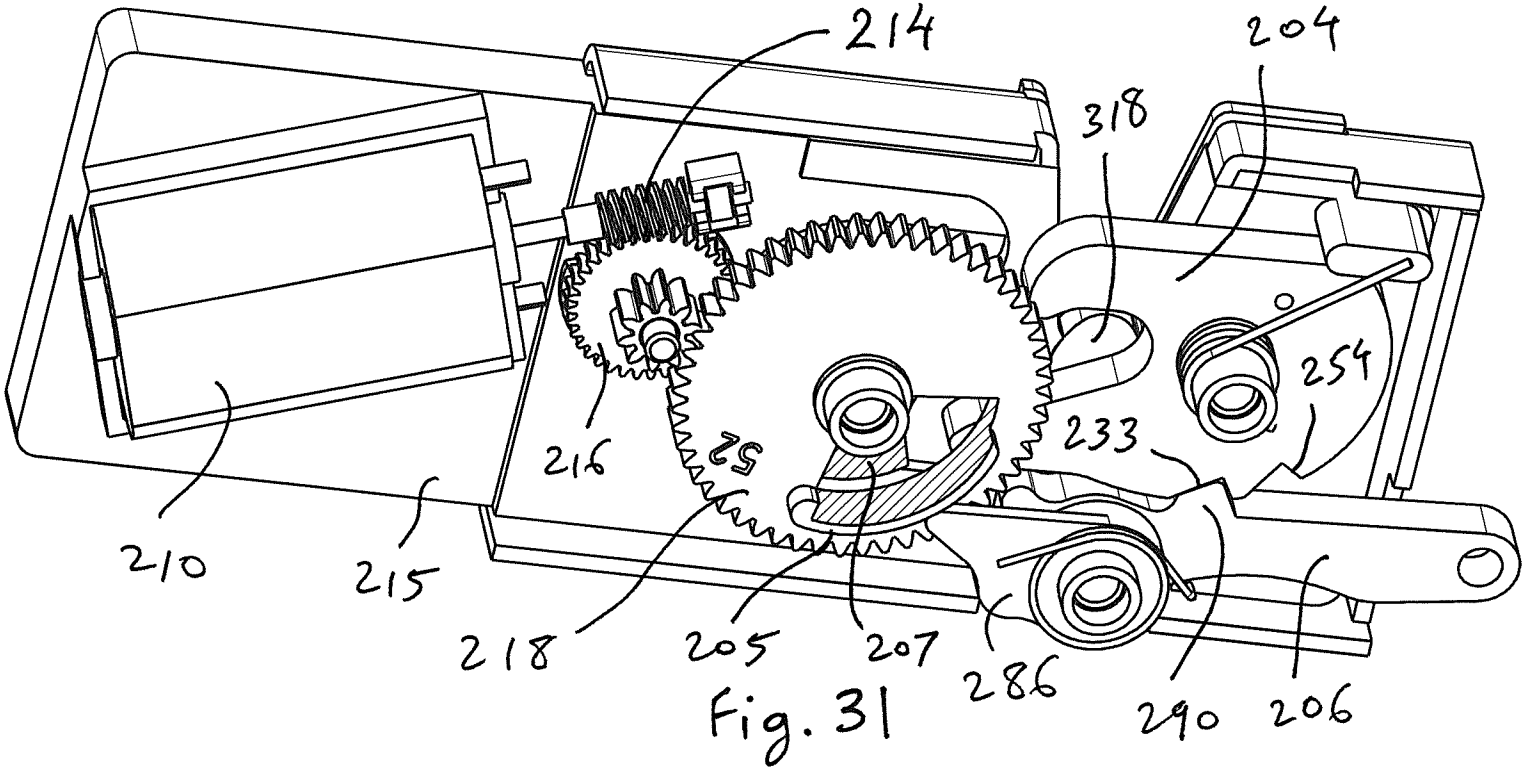
Figures 32, 33:
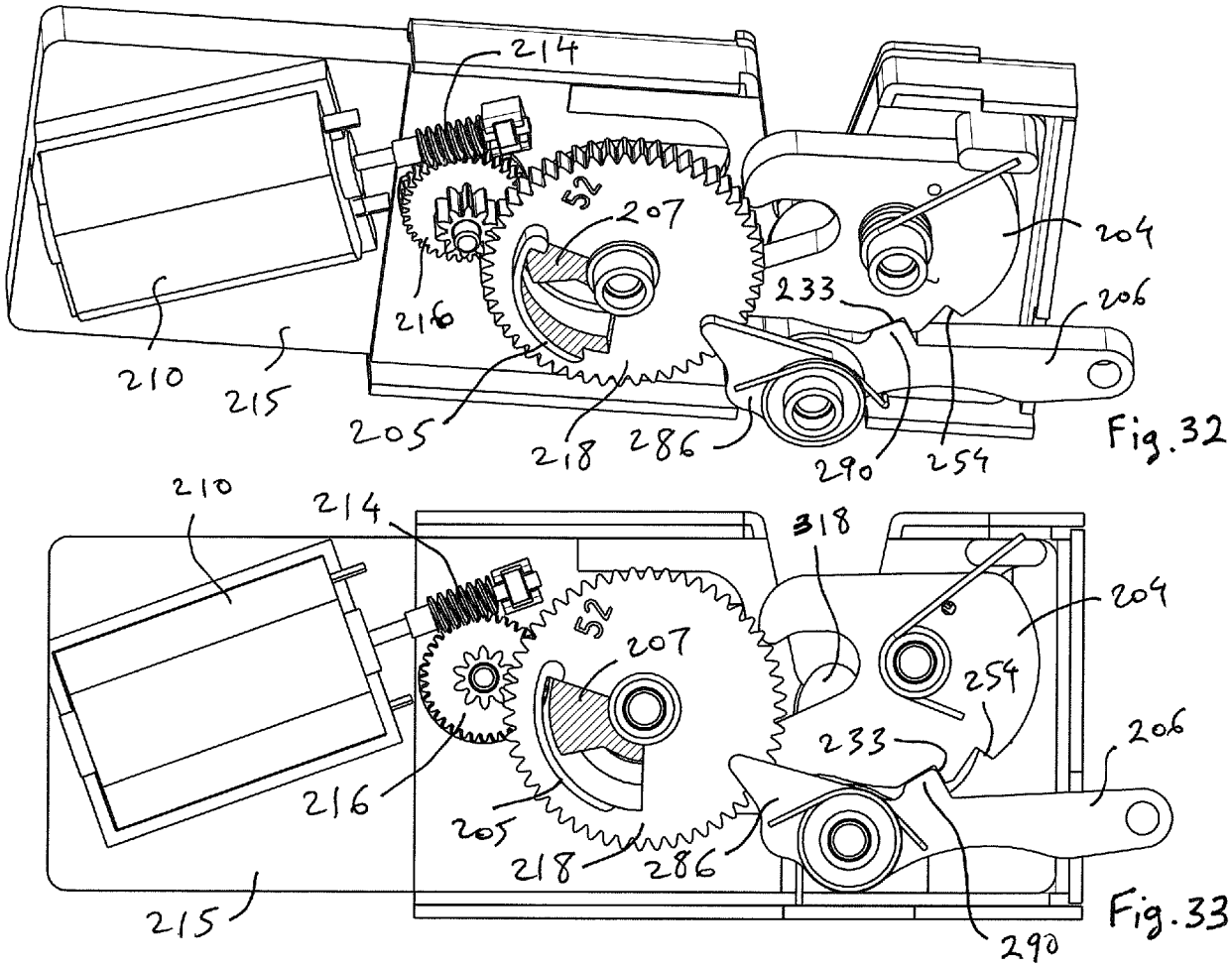
Figure 34:
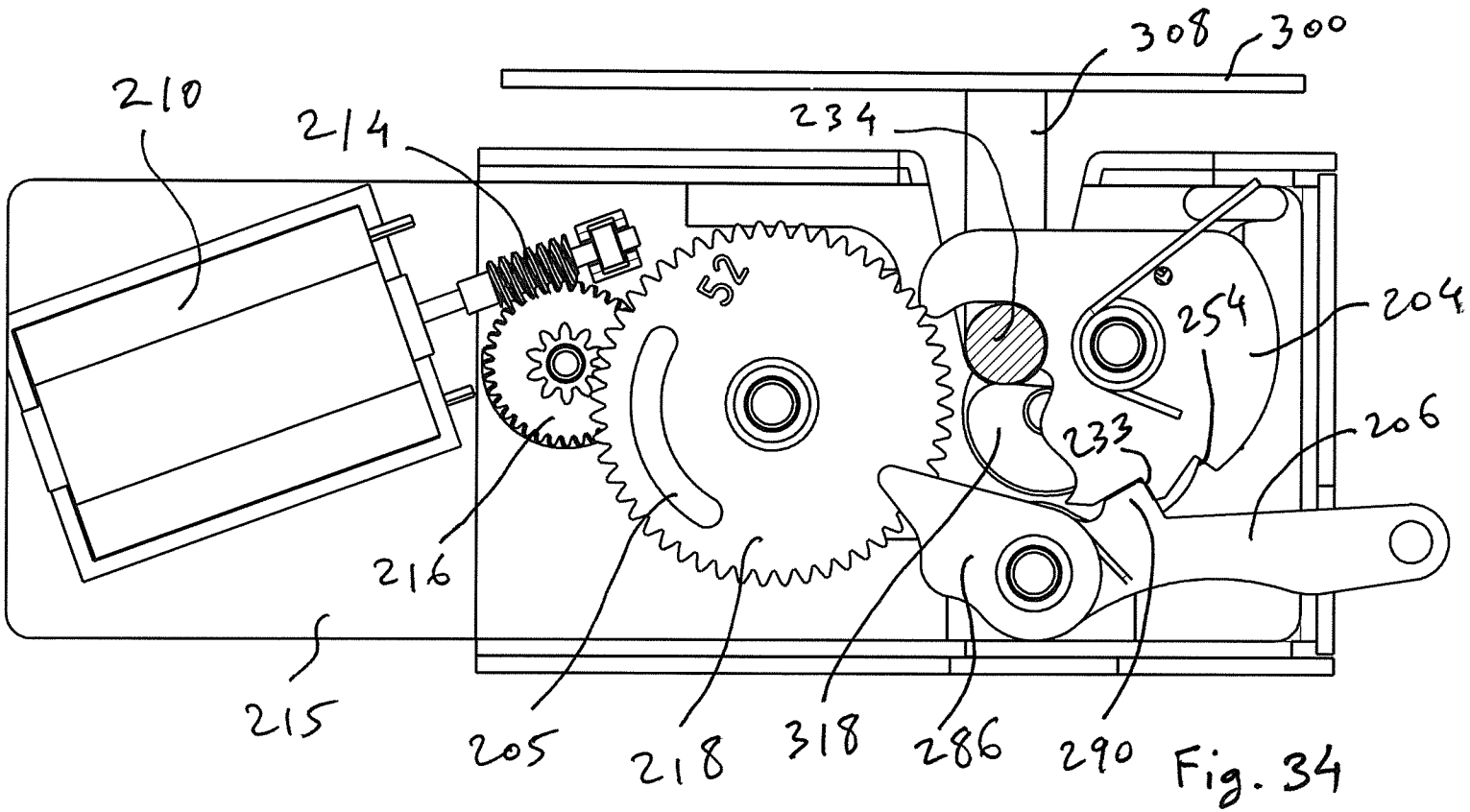
Figure 35:
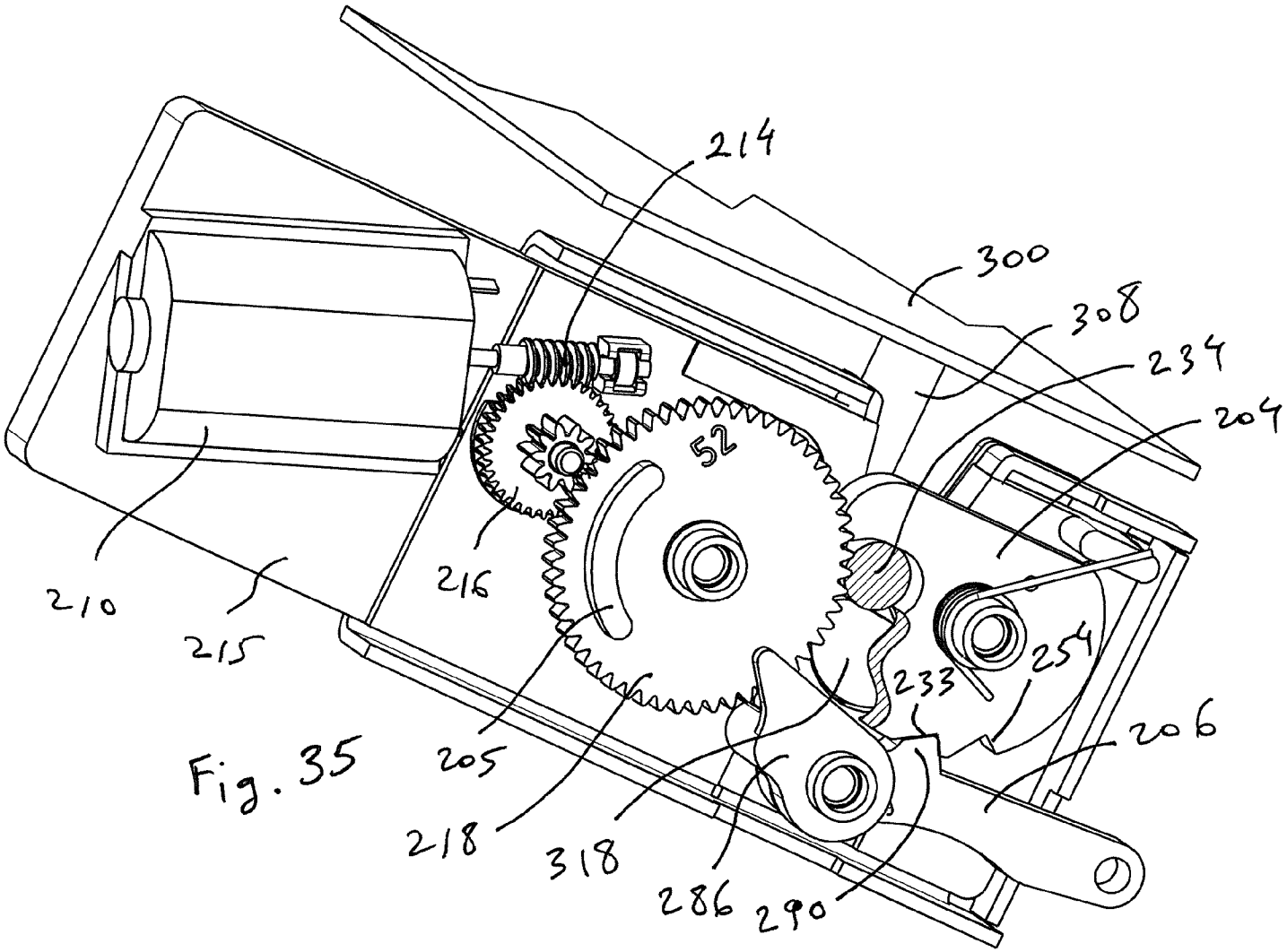
Figure 36:
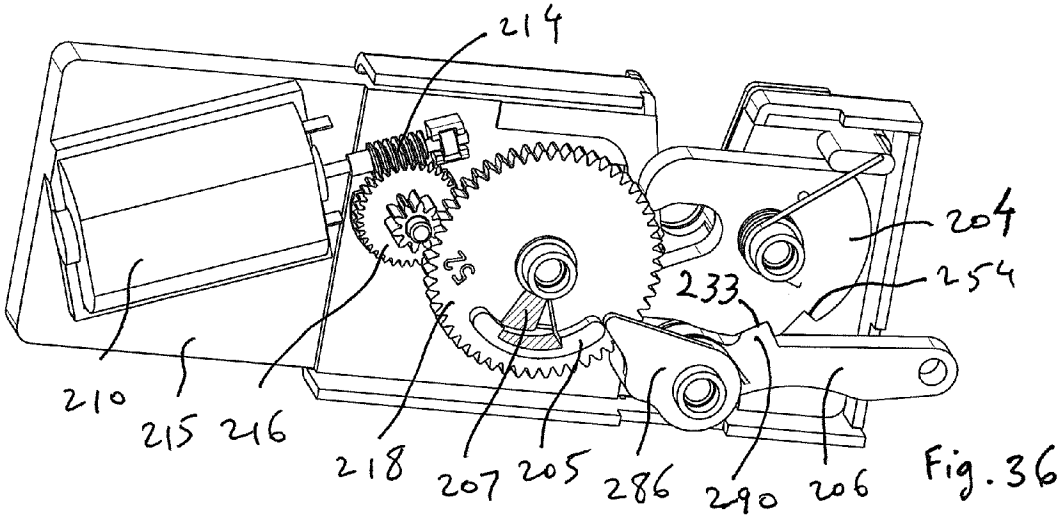
FIGS. 36-49 are a sequence of views of a latch according to the present invention showing the pawl moving from the second latched position to the unlatched position and the cam gear returning to its starting position with the cover removed to reveal internal detail.
Figure 37:
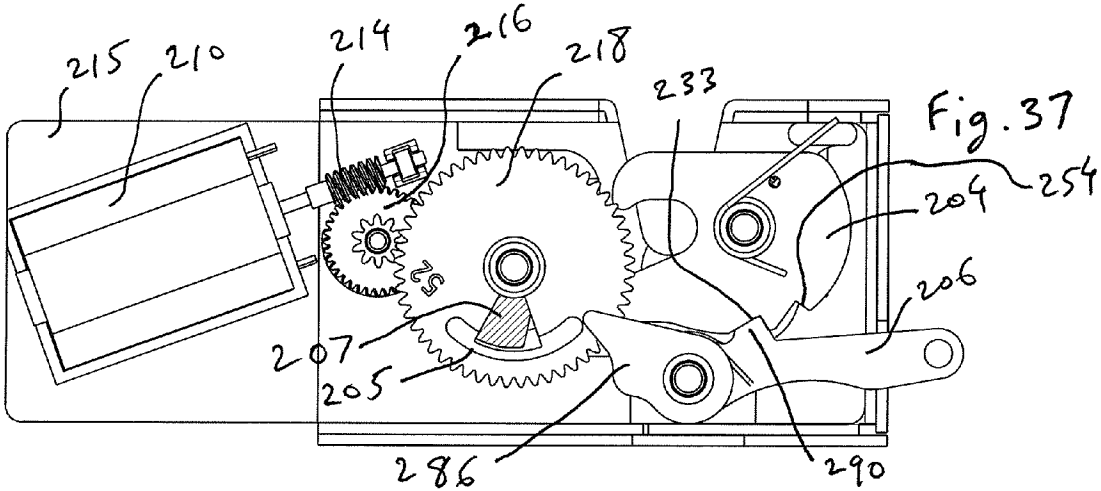
Figure 38:
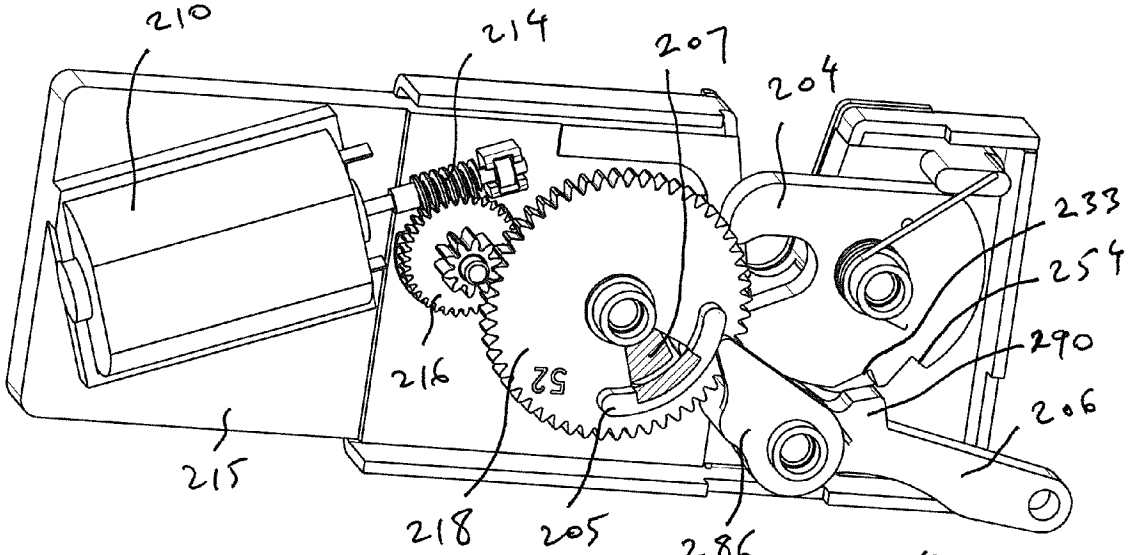

Referring to FIGS. 31-33, if the pawl 204 is moved to the second latched position as detected by the sensor 316, while the striker detector 318 does not indicate that the striker 308 is captured by the pawl 204, then the control circuit 235 reverses the current to the motor to disengage the trigger 206 from the pawl 204 by the reverse movement of the second cam 205 and the panel 300 is released and the latch 200 is returned to the initial fully unlatched configuration. If the motor 210 or associated circuitry fail with the latch fully latched and the panel 300 closed, the trigger lever 284 is provided with a hole 322 that allows a cable (not shown) to be attached to the trigger lever 284 as a back-up mechanical release mechanism that will be operated by a lever (not shown) from the interior of the vehicle. The cable can then be pulled to disengage the trigger 206 from the pawl 204 in order to release the pawl 204, and consequently the striker 308, such that the panel 300 can then be opened.

Figure 19:
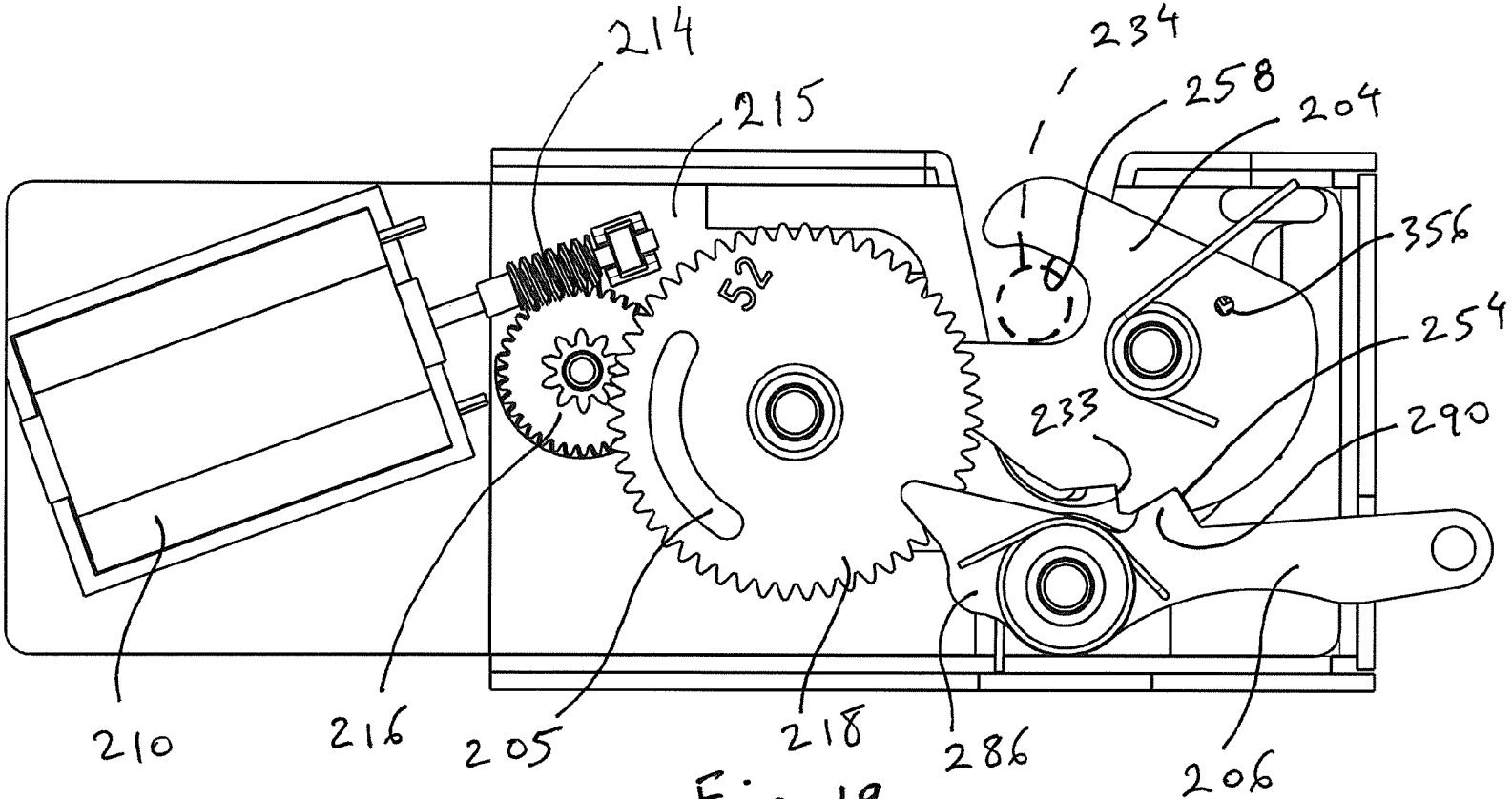
Figure 20:
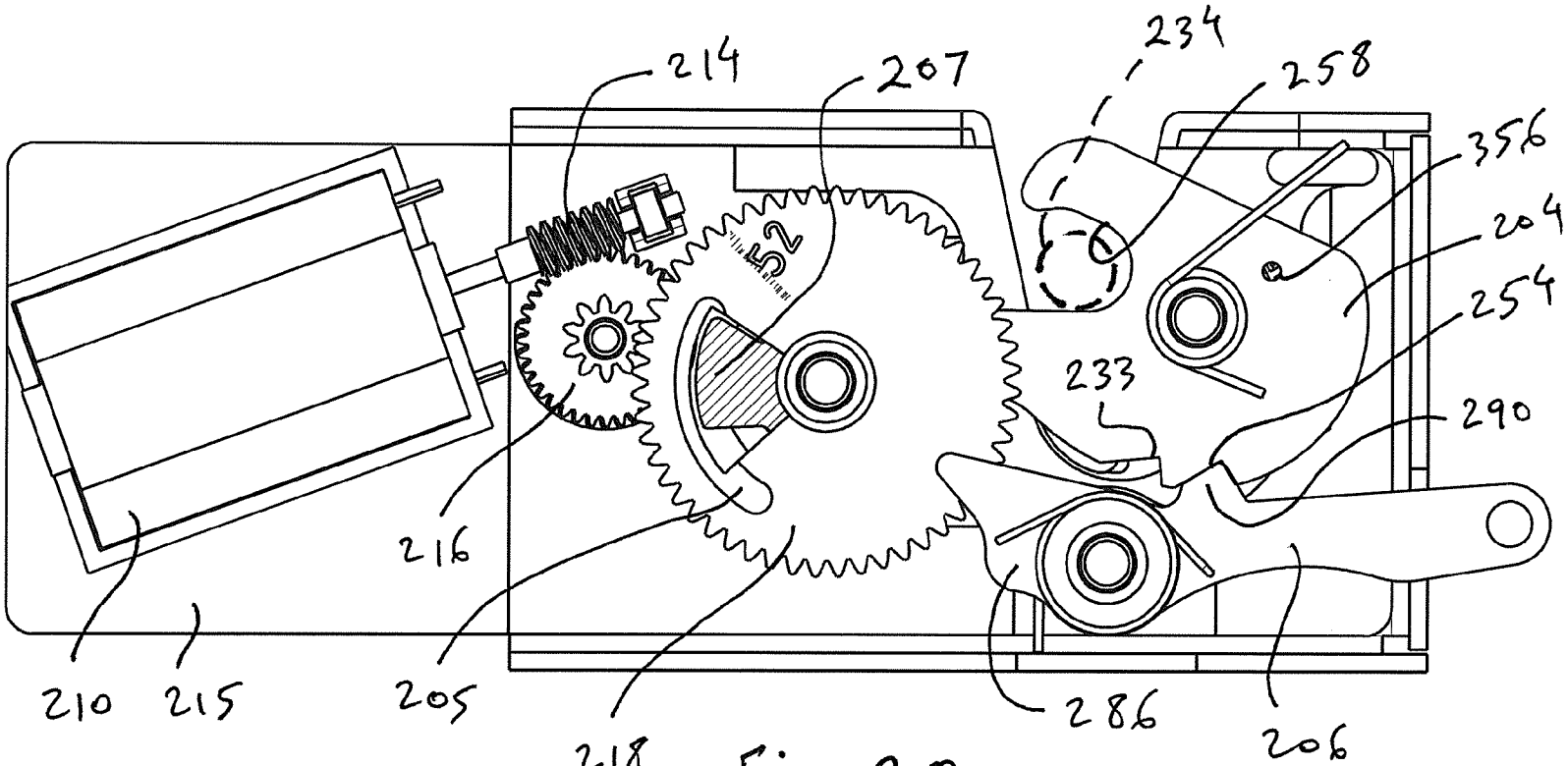
Figure 21:
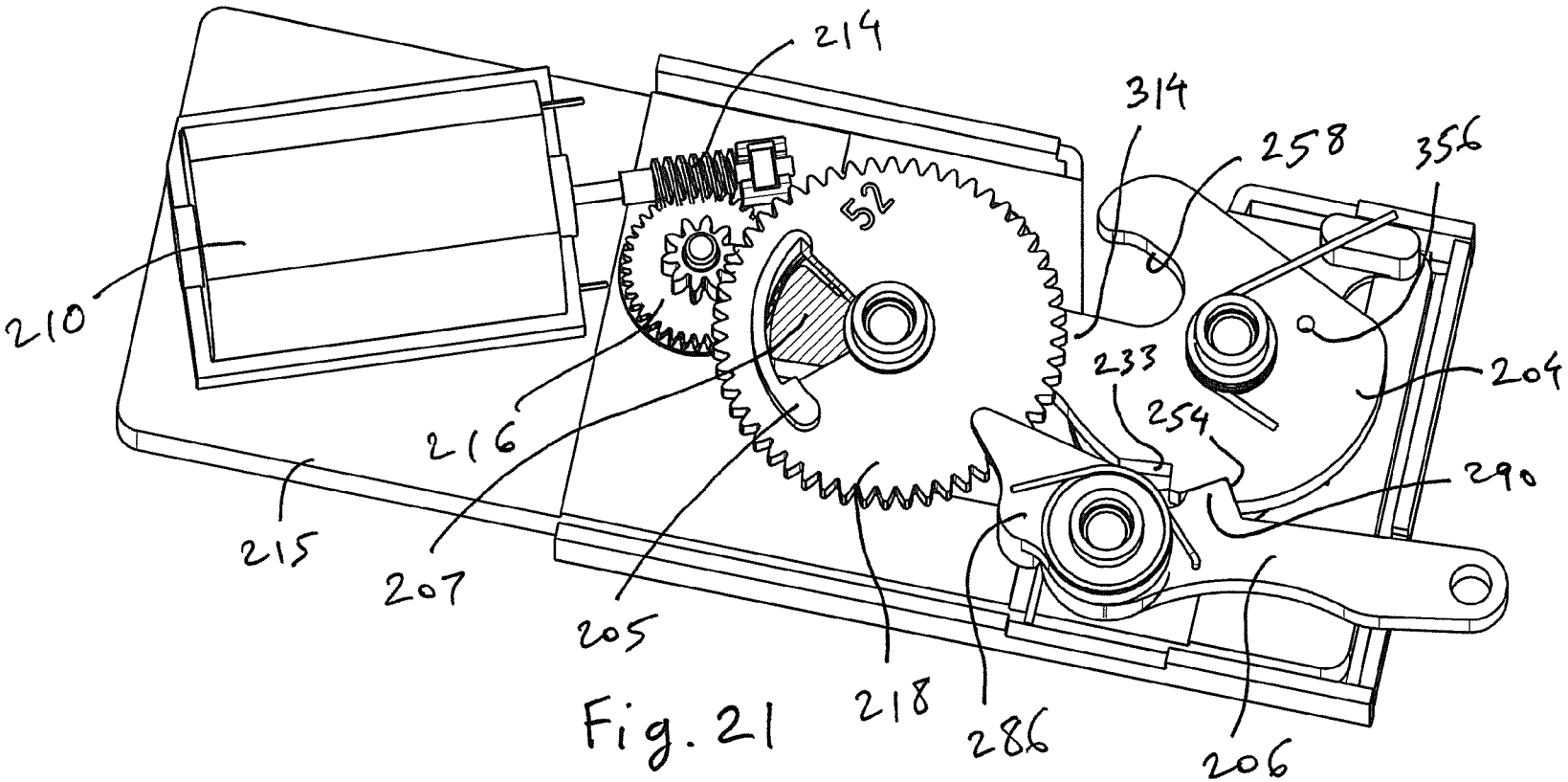
Figure 22:
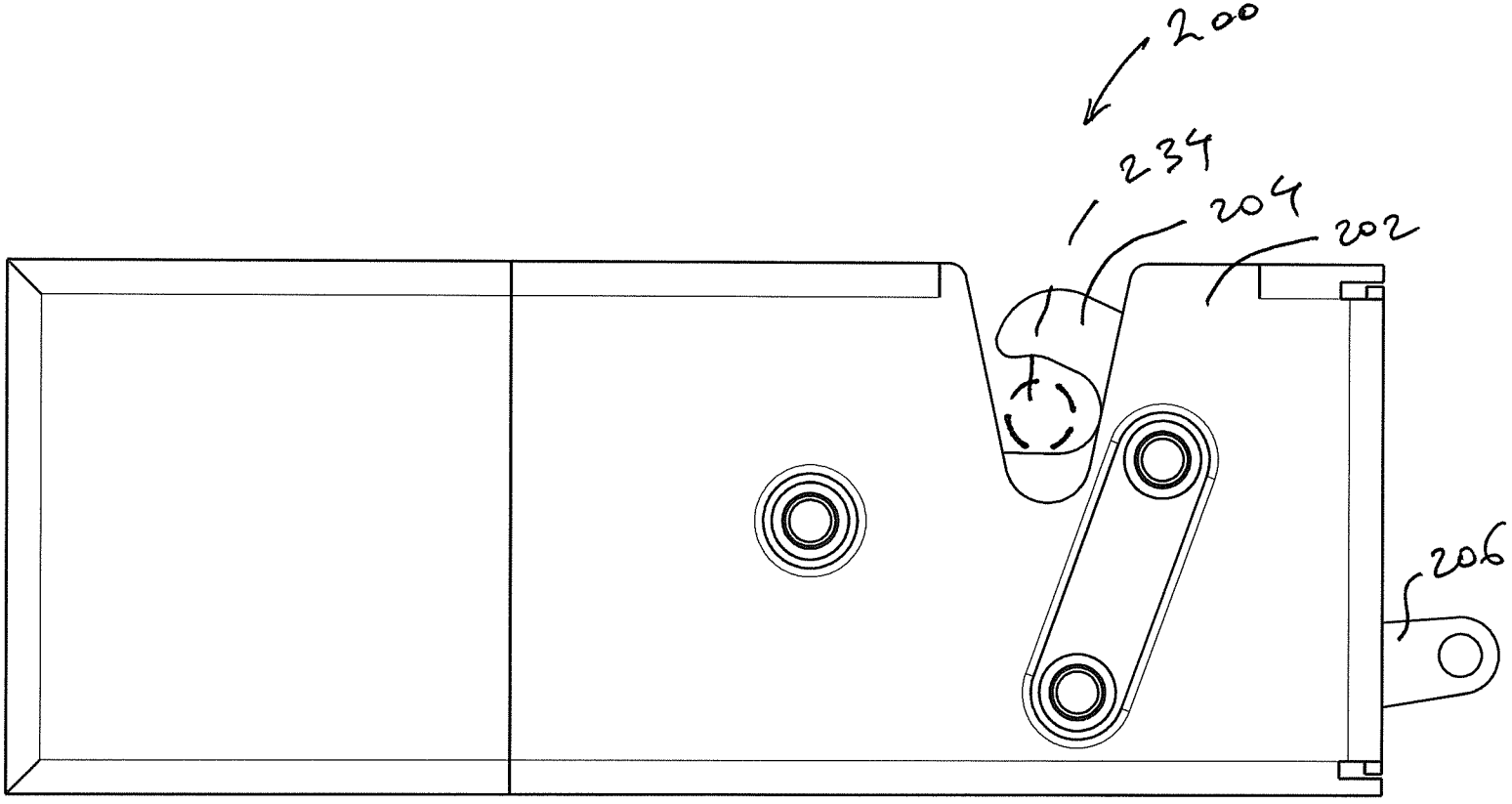
FIG. 22 is a view of a latch according to the present invention showing the pawl in the first latched position.

If the panel 300 is closed on the inoperable latch 200, the striker 308 can engage and move the pawl 204 to the first latched position where the pawl 204 is held by the trigger 206 and the striker 308 is captured by the pawl slot 258. This first latched configuration is illustrated in FIGS. 19-20. This arrangement allows the panel 300 to be secured in a near closed position until the vehicle can be taken in for service.

During the operation of the latch 200, the latch control circuit 235 also continuously monitors the current supplied to the motor 210. If a sudden rise in the motor current is detected due to an unexpected load during closing, the rotation of the cam gear 218 is reversed to release the latch pawl 204 as a safety measure.

The bushing 500 is provided for supporting the end of the motor shaft 220. In the assembly views the various springs are only shown diagrammatically.

It is to be understood that the present invention is not limited to the embodiments disclosed above, but includes any and all embodiments within the scope of the appended claims.

The invention claimed is:

1. A latch (200) adapted for securing a closure member (300) in a predetermined position, the closure member being provided with a striker (308), the latch comprising:

a latch housing (202);

a pawl (204);

a trigger (206), wherein said trigger (206) is biased into engagement with said pawl (204), said trigger (206) engaging said pawl (204) to thereby hold said pawl (204) in one of a first latched position and a second latched position, said trigger (206) being movable out of engagement with said pawl (204) to thereby allow said pawl to move to an unlatched position;

a cam gear (218) including a gear wheel (222) and a first cam (203), said cam gear (218) being rotationally supported in said housing (202) for rotation about an axis of rotation, said first cam (203) having a cam lobe (207) located at a distance from said axis of rotation of said cam gear (218), said first cam (203) acting to drive said pawl (204) from said first latched position to said second latched position when said cam gear (218) is rotated in a first direction;

a circuit board (230);

a latch control circuit (235);

a motor (210) selectively powering rotation of said cam gear; and at least two sensors (332, 326), including a first sensor (332) and a second sensor (326), mounted on said circuit board (230);

wherein said pawl (204) is provided with a pawl slot (258) to capture and hold the striker (308) when said pawl (204) is in one of said first latched position and said second latched position, wherein with said pawl (204) initially in said unlatched configuration, as the closure member (300) is closed, the striker (308) will be positioned and captured in said pawl slot (258) with said pawl (204) being moved to said first latched position, and wherein said first sensor (332) detects when said pawl (204) reaches said first latched position, whereupon said first sensor (332) generates a signal to said latch control circuit (235) that causes electrical current to be supplied to said motor (210) to thereby cause rotation of said cam gear (218) to move said pawl (204) to said second latched position.

2. The latch according to claim 1, wherein the latch (200) is adapted for attachment to a second member such that the latch can be engaged by the striker (308) for securing the closure member (300) in the predetermined position relative to the second member.

3. The latch according to claim 1, wherein said housing (202) has an opening latch according to claim 1, wherein said housing (202) has an opening that allows at least a portion of the striker (308) to enter said housing (202) for engagement by said pawl (204).

4. The latch according to claim 3, wherein the latch further comprises a support plate (215) fixedly positioned within said housing (202), said opening is in the form of a slot (212) that passes through a first portion (211) of said housing (202), said slot (212) forms an open, approximately U-shaped cut-out in said housing (202) as viewed in profile, said slot (212) allows an unobstructed path for the striker (308) to engage said pawl (204) when said pawl is in an open configuration relative to said support plate (215), and said slot (212) is sized such that said housing (202) will not interfere with movement of the striker (308) relative to said housing (202) as said pawl (204) is moved from an open configuration to a closed configuration relative to said support plate (215) by contact with the striker (308) and as said pawl (204) is rotated from said first latched position to said second latched position relative to said housing (202) by said electrically operated actuator assembly (208).

5. The latch according to claim 1, wherein said cam gear (218) further comprises a second cam (205), wherein said first cam (203) acts to drive said pawl (204) from said first latched position to said second latched position when said cam gear (218) is rotated in a first direction, wherein said second cam (205) is in the form of a raised, arc-shaped, and elongated rib eccentrically positioned relative to said axis of rotation of said cam gear (218), and wherein said second cam (205) acts to disengage said trigger from said pawl when said cam gear is rotated in a second direction opposite said first direction.

6. The latch according to claim 5, further comprising:

a one-way trigger actuating lever (286) mounted so as to be rotatable about a common axis with said trigger (206), said trigger actuator lever (286) has a one-way rotation stop (236), said one-way rotation stop (236) is biased into engagement with said trigger (206), said one-way rotation stop (236) blocks relative rotation between said trigger (206) and said trigger actuating lever (286) when said one-way rotation stop (236) is in engagement with said trigger (206) and said trigger actuating lever (286) is being used to rotate said trigger (206) together with said trigger actuating lever (286) in a first direction, said one-way rotation stop (236) does not block relative rotation between said trigger (206) and said trigger actuating lever (286) when said trigger actuating lever (286) is being rotated in a second direction opposite said first direction, such that said trigger actuating lever (286) moves said trigger (206) when rotated in said first direction, but that does not move said trigger (206) when rotated in said second direction.

7. The latch according to claim 5, wherein said second sensor (326) is used to detect the position of said cam gear (218), wherein said second sensor (326) at least detects when said cam gear (218) is in its starting position, and wherein said second sensor (326) then generates a signal to said latch control circuit (235) when said cam gear (218) is in its starting position to thereby allow said latch control circuit (235) to detect that said cam gear (218) is in its starting position.

8. The latch according to claim 7, further comprising:

a one-way trigger actuating lever (286) mounted so as to be rotatable about a common axis with said trigger (206), said trigger actuator lever (286) has a one-way rotation stop (236), said one-way rotation stop (236) is biased into engagement with said trigger (206), said one-way rotation stop (236) blocks relative rotation between said trigger (206) and said trigger actuating lever (286) when said one-way rotation stop (236) is in engagement with said trigger (206) and said trigger actuating lever (286) is being used to rotate said trigger (206) together with said trigger actuating lever (286) in a first direction, said one-way rotation stop (236) does not block relative rotation between said trigger (206) and said trigger actuating lever (286) when said trigger actuating lever (286) is being rotated in a second direction opposite said first direction, such that said trigger actuating lever (286) moves said trigger (206) when rotated in said first direction, but that does not move said trigger (206) when rotated in said second direction.

9. The latch according to claim 7, further comprising a third sensor (316) provided on said circuit board (230), wherein said third sensor (316) is used to detect when said pawl (204) reaches said second latched position, whereupon said third sensor (316) generates a signal to said latch control circuit (235) to thereby allow said latch control circuit (235) to detect when said pawl (204) is in said second latched position.

10. The latch according to claim 9, further comprising:

a one-way trigger actuating lever (286) mounted so as to be rotatable about a common axis with said trigger (206), said trigger actuator lever (286) has a one-way rotation stop (236), said one-way rotation stop (236) is biased into engagement with said trigger (206), said one-way rotation stop (236) blocks relative rotation between said trigger (206) and said trigger actuating lever (286) when said one-way rotation stop (236) is in engagement with said trigger (206) and said trigger actuating lever (286) is being used to rotate said trigger (206) together with said trigger actuating lever (286) in a first direction, said one-way rotation stop (236) does not block relative rotation between said trigger (206) and said trigger actuating lever (286) when said trigger actuating lever (286) is being rotated in a second direction opposite said first direction, such that said trigger actuating lever (286) moves said trigger (206) when rotated in said first direction, but that does not move said trigger (206) when rotated in said second direction.

11. The latch according to claim 9, further comprising:

a striker detector (318) pivotally supported within said latch housing (202), said striker detector (318) being provided with a striker detector spring (244) that biases said striker detector (318) into occupying a first position coincident with a position occupied by the striker (308) when the striker (308) is captured by said pawl (204) and said pawl (204) is in said second latched position, wherein when the striker (308) is captured by said pawl (204) and said pawl (204) is in said second latched position, said striker detector (318) is pushed to a second position by the striker (308).

12. The latch according to claim 11, further comprising:

a fourth sensor (320) is provided on said circuit board (230), said fourth sensor (320) at least detecting when said striker detector (318) is in its second position, said fourth sensor (320) generating a signal to said latch control circuit (235) when said striker detector (318) is in its second position to thereby allow said latch control circuit (235) to detect that the striker (308) is properly secured when said pawl (204) is in said second latched position.

13. The latch according to claim 12, further comprising:

a one-way trigger actuating lever (286) mounted so as to be rotatable about a common axis with said trigger (206), said trigger actuator lever (286) has a one-way rotation stop (236), said one-way rotation stop (236) is biased into engagement with said trigger (206), said one-way rotation stop (236) blocks relative rotation between said trigger (206) and said trigger actuating lever (286) when said one-way rotation stop (236) is in engagement with said trigger (206) and said trigger actuating lever (286) is being used to rotate said trigger (206) together with said trigger actuating lever (286) in a first direction, said one-way rotation stop (236) does not block relative rotation between said trigger (206) and said trigger actuating lever (286) when said trigger actuating lever (286) is being rotated in a second direction opposite said first direction, such that said trigger actuating lever (286) moves said trigger (206) when rotated in said first direction, but that does not move said trigger (206) when rotated in said second direction.

14. The latch according to claim 5, further comprising:

a striker detector (318) pivotally supported within said latch housing (202), said striker detector (318) being provided with a striker detector spring (244) that biases said striker detector (318) into occupying a first position coincident with a position occupied by the striker (308) when the striker (308) is captured by said pawl (204) and said pawl (204) is in said second latched position, wherein when the striker (308) is captured by said pawl (204) and said pawl (204) is in said second latched position, said striker detector (318) is pushed to a second position by the striker (308).

15. The latch according to claim 14, further comprising:

a one-way trigger actuating lever (286) mounted so as to be rotatable about a common axis with said trigger (206), said trigger actuator lever (286) has a one-way rotation stop (236), said one-way rotation stop (236) is biased into engagement with said trigger (206), said one-way rotation stop (236) blocks relative rotation between said trigger (206) and said trigger actuating lever (286) when said one-way rotation stop (236) is in engagement with said trigger (206) and said trigger actuating lever (286) is being used to rotate said trigger (206) together with said trigger actuating lever (286) in a first direction, said one-way rotation stop (236) does not block relative rotation between said trigger (206) and said trigger actuating lever (286) when said trigger actuating lever (286) is being rotated in a second direction opposite said first direction, such that said trigger actuating lever (286) moves said trigger (206) when rotated in said first direction, but that does not move said trigger (206) when rotated in said second direction.

16. The latch according to claim 1, further comprising:

a striker detector (318) pivotally supported within said latch housing (202), said striker detector (318) being provided with a striker detector spring (244) that biases said striker detector (318) into occupying a first position coincident with a position occupied by the striker (308) when the striker (308) is captured by said pawl (204) and said pawl (204) is in said second latched position, wherein when the striker (308) is captured by said pawl (204) and said pawl (204) is in said second latched position, said striker detector (318) is pushed to a second position by the striker (308).

17. The latch according to claim 16, further comprising:

a one-way trigger actuating lever (286) mounted so as to be rotatable about a common axis with said trigger (206), said trigger actuator lever (286) has a one-way rotation stop (236), said one-way rotation stop (236) is biased into engagement with said trigger (206), said one-way rotation stop (236) blocks relative rotation between said trigger (206) and said trigger actuating lever (286) when said one-way rotation stop (236) is in engagement with said trigger (206) and said trigger actuating lever (286) is being used to rotate said trigger (206) together with said trigger actuating lever (286) in a first direction, said one-way rotation stop (236) does not block relative rotation between said trigger (206) and said trigger actuating lever (286) when said trigger actuating lever (286) is being rotated in a second direction opposite said first direction, such that said trigger actuating lever (286) moves said trigger (206) when rotated in said first direction, but that does not move said trigger (206) when rotated in said second direction.

18. The latch according to claim 5, wherein said motor (210) has an output shaft (220) and wherein the latch further comprises:

a worm gear (214) attached to said output shaft (220) of said motor (210) such that said worm gear (214) rotates with said shaft (220) as a unit; and a combination gear (216) that drives said cam gear (218), said output shaft (220) rotating in response to said motor being energized by supplying a current having a polarity to said motor, wherein reversing the polarity of the current supplied to said motor (210) causes a direction of rotation of said output shaft (220) to be reversed, and wherein rotation of said worm gear (214) causes rotation of said combination gear (216).

19. The latch according to claim 18, further comprising:

a one-way trigger actuating lever (286) mounted so as to be rotatable about a common axis with said trigger (206), said trigger actuator lever (286) has a one-way rotation stop (236), said one-way rotation stop (236) is biased into engagement with said trigger (206), said one-way rotation stop (236) blocks relative rotation between said trigger (206) and said trigger actuating lever (286) when said one-way rotation stop (236) is in engagement with said trigger (206) and said trigger actuating lever (286) is being used to rotate said trigger (206) together with said trigger actuating lever (286) in a first direction, said one-way rotation stop (236) does not block relative rotation between said trigger (206) and said trigger actuating lever (286) when said trigger actuating lever (286) is being rotated in a second direction opposite said first direction, such that said trigger actuating lever (286) moves said trigger (206) when rotated in said first direction, but that does not move said trigger (206) when rotated in said second direction.

20. The latch according to claim 7, wherein after said pawl (204) is rotated to its second latched position, when the second sensor (326) detects that said can gear is back in its starting position then current supply to said motor (210) is turned off.

21. The latch according to claim 20, wherein when normal closing of the panel (300) is blocked, after a predetermined time without a signal from said second sensor (326) said latch control circuit (235) reverses the polarity of the current to said motor (210) to disengage said trigger (206) from said pawl (204) to allow the striker (308) to be released and to return the latch (200) to said unlatched configuration.

22. The latch according to claim 12, wherein after said pawl (204) is rotated to its second latched position, when the second sensor (326) detects that said can gear is back in its starting position then current supply to said motor (210) is turned off.

23. The latch according to claim 22, wherein when the striker (308) is properly secured with said pawl (204) being in said second latched position and said cam gear (218) being in its starting position, activation of the latch (200) by a user results in said latch control circuit (235) operating to rotate said cam gear (218) from its starting position in a direction opposite a direction of rotation of said cam gear (218) when said pawl (204) is being moved from said first latched position to said second latched position, to disengage said trigger (206) from said pawl (204) to allow the striker (308) to be released.

24. The latch according to claim 23, wherein when the second sensor (326) senses that said cam gear (218) has returned to its starting position, said second sensor (326) signals said latch control circuit (235) to cease energizing said motor (210).

25. The latch according to claim 12, wherein when said pawl (204) is moved to said second latched position as detected by said third sensor (316), while the striker detector (318) does not indicate that the striker (308) is captured by said pawl (204), said latch control circuit (235) reverses the current to said motor (210), as compared to the current supplied to said motor when said pawl (204) is being moved from said first latched position to said second latched position, to disengage said trigger (206) from said pawl (204) and return the latch (200) to said unlatched configuration.

26. The latch according to claim 24, wherein when said pawl (204) is moved to said second latched position as detected by said third sensor (316), while the striker detector (318) does not indicate that the striker (308) is captured by said pawl (204), said latch control circuit (235) reverses the current to said motor (210), as compared to the current supplied to said motor when said pawl (204) is being moved from said first latched position to said second latched position, to disengage said trigger (206) from said pawl (204) and return the latch (200) to said unlatched configuration.

27. A method of operating a latch (200) adapted for securing a closure member (300) in a predetermined position, the closure member being provided with a striker (308), wherein the latch comprises:

a latch housing (202);

a pawl (204);

a trigger (206); and an electrically operated actuator assembly (208) capable of selectively moving said trigger (206) out of engagement with said pawl (204) and rotating said pawl from a first latched position to a second latched position to move the striker (308) inward relative to said housing (202), wherein said electrically operated actuator assembly (208) comprises:

a cam gear (218) including a gear wheel (222), a first cam (203), and a second cam (205), said cam gear (218) being rotationally supported in said housing (202) for rotation about an axis of rotation, said first cam (203) having a cam lobe (207) located at a distance from said axis of rotation of said cam gear (218), said first cam (203) acting to drive said pawl (204) from said first latched position to said second latched position when said cam gear (218) is rotated in a first direction, said second cam (205) being in the form of a raised, arc-shaped, and elongated rib eccentrically positioned relative to said axis of rotation of said cam gear (218), said second cam (205) acting to disengage said trigger from said pawl when said cam gear is rotated in a second direction opposite to said first direction;

a circuit board (230);

a latch control circuit (235);

a motor (210) selectively powering rotation of said cam gear; and at least two sensors (332, 326), including a first sensor (332) and a second sensor (326), mounted on said circuit board (230);

wherein said pawl (204) is provided with a pawl slot (258) to capture and hold the striker (308) when said pawl (204) is in either one of a first latched position and a second latched position, wherein with the latch (200) initially in an unlatched configuration, as the closure member (300) is closed, the striker (308) will be positioned and captured in said pawl slot (258) with said pawl (204) being moved to said first latched position, wherein said second sensor (326) at least detects when said cam gear (218) is in its starting position, and wherein said second sensor (326) then generates a signal to said latch control circuit (235) when said cam gear (218) is in its starting position;

the method comprising the steps of:

detecting when said pawl (204) reaches said first latched position using said first sensor (332), whereupon said first sensor (332) generates a signal to said latch control circuit (235);

supplying current with a first polarity to said motor (210) to cause rotation of said cam gear (218) in a first direction to move said pawl (204) to said second latched position; and ceasing the supply of current to said motor (210) when said second sensor (326) detects that said cam gear (218) is in its starting position.

28. The method according to claim 27, further comprising the step of reversing the polarity of the current from the first polarity to a second polarity to reverse the direction of rotation of the cam gear (218) after a predetermined period of time has passed without detecting that the cam gear (218) has reached its starting position.

29. The method according to claim 27, further comprising the steps of:

detecting that a user has acted to activate the latch (200); and supplying current with a second polarity opposite the first polarity to a second polarity to rotate the cam gear (218) in a second direction opposite said first direction to thereby release the striker (308); and ceasing the supply of current to said motor (210) when said second sensor (326) detects that said cam gear (218) is in its starting position.

30. The method according to claim 27, wherein the latch further comprises:

a third sensor (316) provided on said circuit board (230), wherein said third sensor (316) is used to detect when said pawl (204) reaches said second latched position, whereupon said third sensor (316) generates a signal to said latch control circuit (235) to thereby allow said latch control circuit (235) to detect when said pawl (204) is in said second latched position;

a striker detector (318) pivotally supported within said latch housing (202), said striker detector (318) being provided with a striker detector spring (244) that biases said striker detector (318) into occupying a first position coincident with a position occupied by the striker (308) when the striker (308) is captured by said pawl (204) and said pawl (204) is in said second latched position, wherein when the striker (308) is captured by said pawl (204) and said pawl (204) is in said second latched position, said striker detector (318) is pushed to a second position by the striker (308); and a fourth sensor (320) is provided on said circuit board (230), said fourth sensor (320) at least detecting when said striker detector (318) is in its second position, said fourth sensor (320) generating a signal to said latch control circuit (235) when said striker detector (318) is in its second position to thereby allow said latch control circuit (235) to detect that the striker (308) is properly secured when said pawl (204) is in said second latched position;

the method further comprising the steps of:

detecting whether or not said pawl (204) has reached said second latched position using said third sensor (316);

detecting whether or not the striker (308) is properly secured using said fourth sensor (320); and supplying current with a second polarity opposite the first polarity to a second polarity to rotate the cam gear (218) in a second direction opposite said first direction to thereby return the latch (200) to the unlatched configuration if it is detected that said pawl (204) has reached said second latched position and that the striker (308) is not properly secured.

* * * * *